US006278853B1

(12) United States Patent
Ban et al.

(10) Patent No.: US 6,278,853 B1
(45) Date of Patent: Aug. 21, 2001

(54) RECYCLING METHOD OF TONER CONTAINER

(75) Inventors: Yutaka Ban, Tokyo; Katsuya Murakami, Yokohama; Fumio Tazawa, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/433,946

(22) Filed: Nov. 4, 1999

(30) Foreign Application Priority Data

Nov. 4, 1998 (JP) ..... 10-328846

(51) Int. Cl.[7] ..... G03G 15/00
(52) U.S. Cl. ..... 399/109; 399/257
(58) Field of Search ..... 399/257, 262, 399/119, 120, 109

(56) References Cited

U.S. PATENT DOCUMENTS 4,931,838 6/1990 Ban et al. .
4,932,355 * 6/1990 Neufeld ..... 399/257
5,243,388 * 9/1993 Berns et al. ..... 399/257
5,974,286 10/1999 Ban et al. ..... 399/106

* cited by examiner

*Primary Examiner*—William J. Royer
(74) *Attorney, Agent, or Firm*—Fitzpatrick, Cella, Harper & Scinto

(57) ABSTRACT

A recycling method for a toner supply container that is detachably mountable to a main assembly of an image forming apparatus to supply toner into the main assembly, includes the steps of providing a toner supply container including a filling opening for filling the toner, a supply opening for supplying the toner, a first seal member for sealing the filling opening, and a second seal member for sealing the supply opening; a first step of dismounting the first and second seal members from the toner supply container; a second step, after the first step, of cleaning an inside of the toner supply container by blowing air into the toner supply container through either one of the filling opening and the supply opening, and simultaneously sucking the air through the other one of the openings; a third step, after the second step, of filling the toner through the filling opening.

30 Claims, 30 Drawing Sheets

RECYCLING METHOD OF TONER CONTAINER

FIELD OF THE INVENTION AND RELATED ART

The present invention relates to a recycling method of a toner supply container for supplying toner into a main assembly of an image forming apparatus such as an electrophotographic copying machine, an electrophotographic printer or the like, the toner container being detachably mountable to a main assembly of the image forming apparatus.

In an electrophotographic image forming apparatus such as an electrophotographic copying machine, an electrophotographic printer or the like, fine toner powder is used as a developer. When the toner in the main assembly of the apparatus is consumed, the toner is supplied into the main assembly using a toner supplying container, which is detachably mountable to a main assembly of the electrophotographic image forming apparatus.

When the toner is supplied into the main assembly, a stirring and feeding member in the toner supply container is rotated by the main assembly, so that the toner is fed to gradually feed the toner through the toner supply opening to fill the main assembly.

It is desired that the toner supply container be reused after the toner has been discharged therefrom. In this case, it is desirable that before the toner is refilled into the container, the toner container is easily cleaned with high efficiency.

SUMMARY OF THE INVENTION

Accordingly, it is a principal object of the present invention to provide a recycling method of a toner supply container wherein the container is efficiently and easily cleaned after the toner is supplied into the main assembly.

It is another object of the present invention to provide a recycling method of a toner supply container by which resources and energy can be saved.

It is a further object of the present invention to provide a recycling method of a toner supply container wherein the container can be recycled substantially up to a new product.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinafter, the method of refurbishing a toner supply container, in this embodiment, will be described.

In the following, the term "longitudinal direction" refers to the direction in which a toner supply container is inserted into the main assembly of an electrophotographic image forming apparatus. The term "intersectional direction" refers to the direction perpendicular to the direction in which a toner supply container is inserted into the main assembly of an electrophotographic image forming apparatus. The term "bottom portion" of a toner supply container refers to the portion of a toner supply container, which comes to be on the downward side after the installation of a toner supply container into the main assembly of an electrophotographic image forming apparatus. The terms "top, bottom, and side surfaces" refers to the surfaces, that become the top, bottom, and side surfaces after the installation of a toner supply container into the main assembly of an electrophotographic image forming apparatus.

[Overall Structure of Electrophotographic Image Forming Apparatus]

Figure 1:
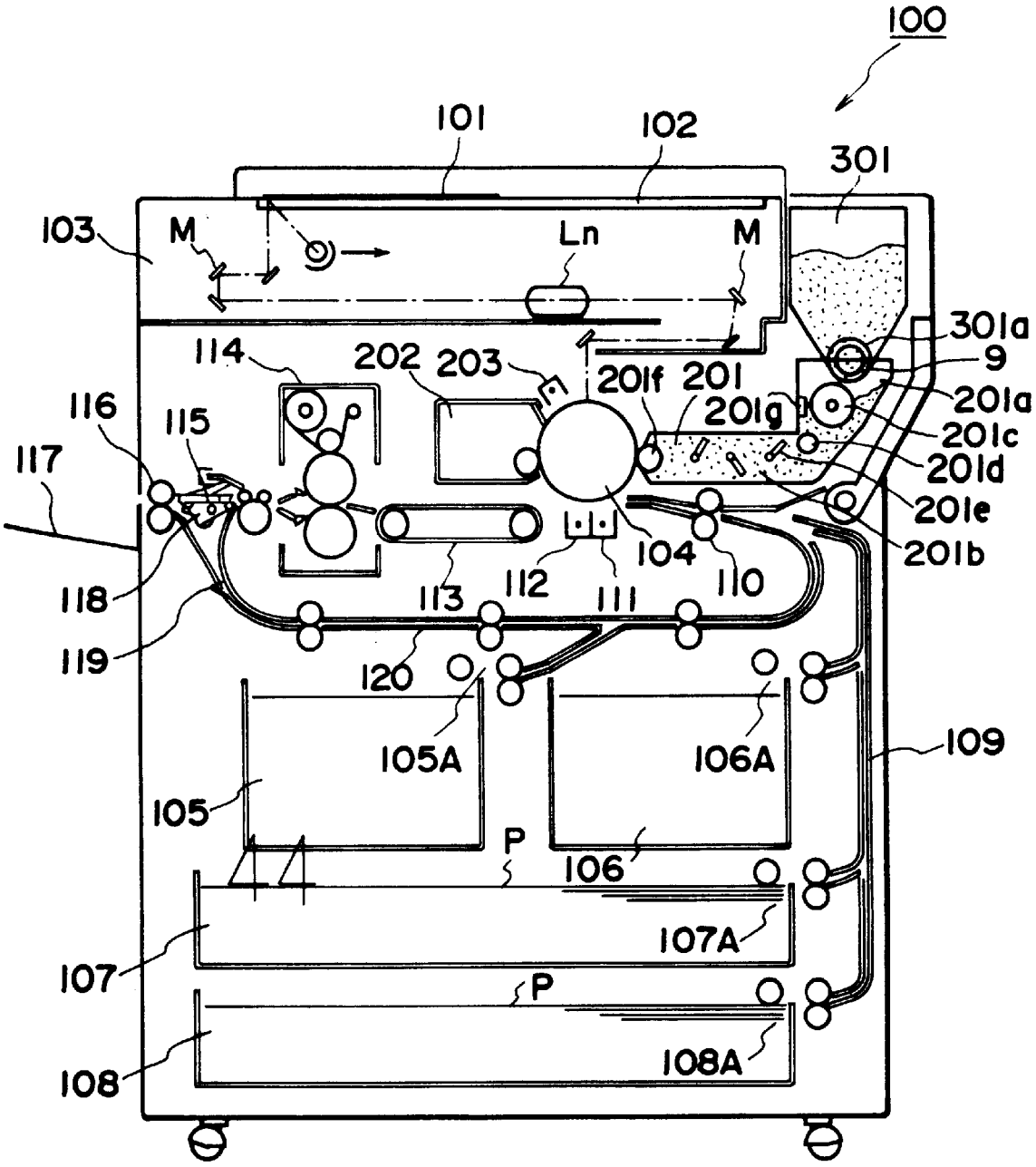
FIG. 1 is an illustration of an electrophotographic copying machine as an example of an electrophotographic image forming apparatus to which a toner supply container according to an embodiment of the present invention is mounted.

First, referring to FIG. 1, the structure of an electrophotographic copying machine, that is, an example of an electrophotographic image forming apparatus, in which a toner supply container in accordance with the present invention is installed, will be described.

In the drawing, a reference character 100 designates the main assembly of an electrophotographic copying machine (hereinafter, "apparatus main assembly"). A reference character 101 designates an original, which is placed on a glass platen for an original. An optical image corresponding to image formation data regarding the original is formed on the peripheral surface of an electrophotographic photosensitive member 104 in the form of a drum (hereinafter, "photosensitive drum") by a plurality of mirrors M and a lens Ln of an optical portion 103. Designated by reference characters 105–108 are cassettes. Among various recording media P (hereinafter, "paper") placed in these cassettes 105–108, correct recording medium P is selected based on the information inputted by a user through a control panel 100*a* (FIG. 2), or the size of the original 101. The choice of recording medium is not limited to paper. For example, OHP sheets or the like may be used as necessary.

A sheet of the selected paper P is separated and fed into the apparatus main assembly by one of the feeding-separating apparatuses 105A–108A, and is conveyed to a registration roller 100 by way of a conveyance path 109. Then, the paper P is conveyed further in synchronism with the rotation of the photosensitive drum 104 and the scanning timing of the optical portion 103. Designated by reference characters 111 and 112 are an electric-discharged based transfer device and an electric-discharge based separating device, respectively. The toner image formed on the photosensitive drum 104 is transferred onto the paper P by the electric-discharge based transfer device 111. Then, the paper P with the transferred toner image is separated from the photosensitive drum 104 by the electric-discharge based separating device 112.

Thereafter, the paper P is conveyed by a conveying portion 113 to a fixing portion 114, in which the toner image on the paper P is fixed to the paper P with the application of heat and pressure. Next, when the image forming apparatus is in the single-sided copy mode, the paper P with the fixed toner image is passed through a reversing-discharging portion 115, and is discharged into a delivery tray 117 by a discharge roller 116. When the apparatus is in the double-sided copy mode, the flapper 118 of the reversing-discharging portion 115 is controlled to send the paper P back to the registration roller 110 through recycling path portions 119 and 120. Then, the paper P with the fixed toner image is sent through the path for the single-sided copy mode, to be discharged into the delivery tray 117.

More specifically, in the case of the double-sided copy mode, the paper P is partially exposed out of the apparatus by the discharge roller 116 through the reversing-discharging portion 115 during the first run. Then, the paper P is sent back into the apparatus to be recycled through the apparatus, by controlling the flapper 118 and rotating in reverse the discharging roller 116, with such timing that the rear end portion of the paper P is still being pinched by the discharge roller 116 after passing the flapper 118. Thereafter, the paper P is conveyed to the registration roller 110 by way of the recycling path portions 119 and 120, and then, is discharged into the delivery tray 117 following the same path as in the single-sided copy mode.

In the apparatus main assembly 100, a development portion 201, a cleaning portion 202, a primary charge device 203, and the like, are disposed along the peripheral surface of the photosensitive drum 104. The development portion 201 is a portion that develops, with the use of toner, an electrostatic latent image formed on the peripheral surface of the photosensitive drum 104 by the optical portion 103 on the basis of the data for the original 101. Disposed also in the apparatus main assembly 100 is a toner supply container 301, which can be removably installed into the apparatus main assembly 100 so that the development portion 201 can be provided with a fresh supply of toner by a user of the apparatus. The development portion 201 comprises a toner hopper 201*a* and a developing device 201*b*. The toner hopper 201*a* has a stirring member 201*c* for stirring the toner supplied from the toner supply container 301 through a toner reception opening 9. After being stirred by the stirring member 201*c*, the toner is sent to the developing device 201*b* by a magnetic roller 201*d*. The developing device 201*b* has a development roller 201*f* and a conveying member 201*e*. After being sent from the toner hopper 201*a* by the magnetic roller 201*d*, the toner is delivered to the development roller 201*f* by the conveying member 201*e*, and then, is supplied to the photosensitive drum 104 by the development roller 201*f*.

A cleaning portion 202 is for removing the toner which remains on the photosensitive drum 104. The primary charge device 203 is for charging the photosensitive drum 104.

Figure 2:
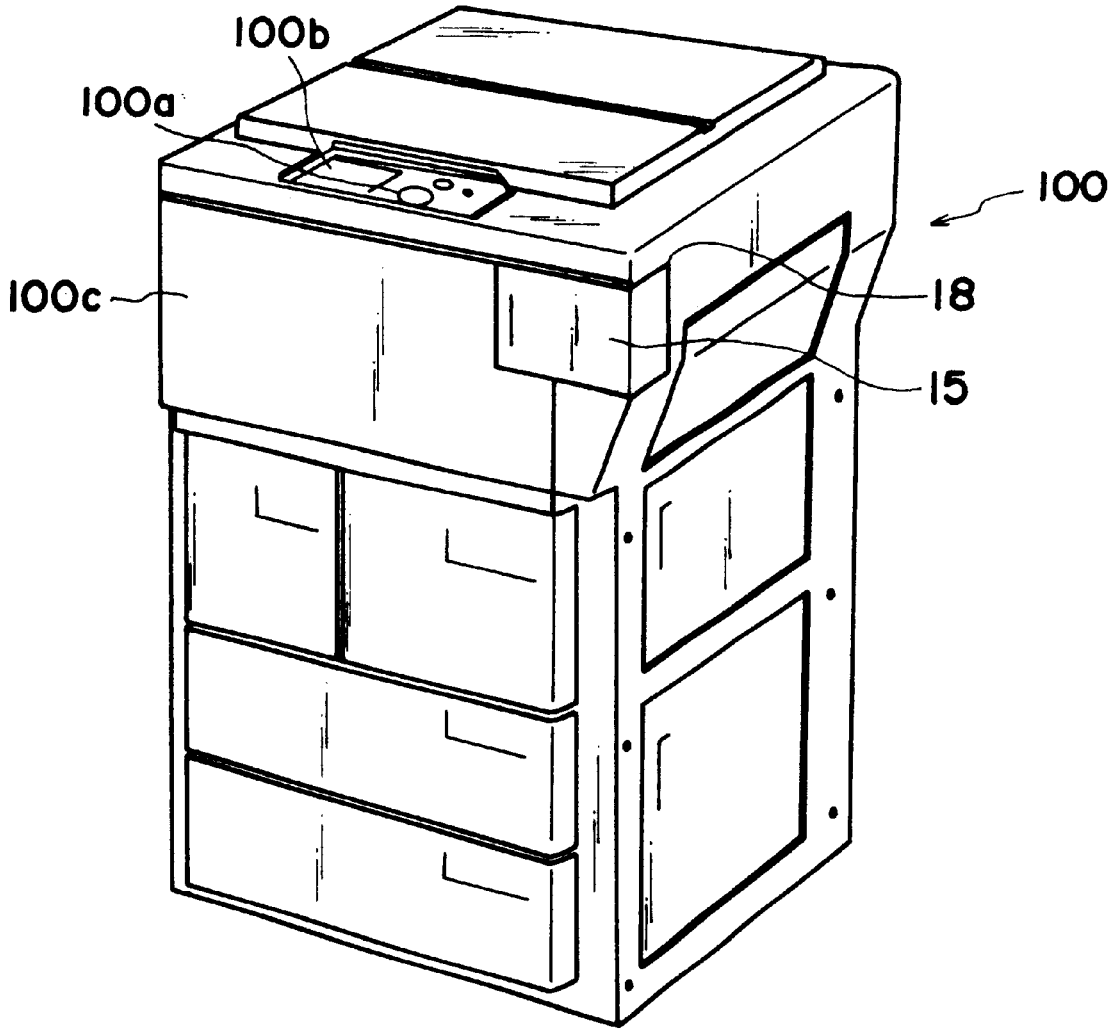
FIG. 2 is a perspective view of the electrophotographic copying machine.
Figure 3:
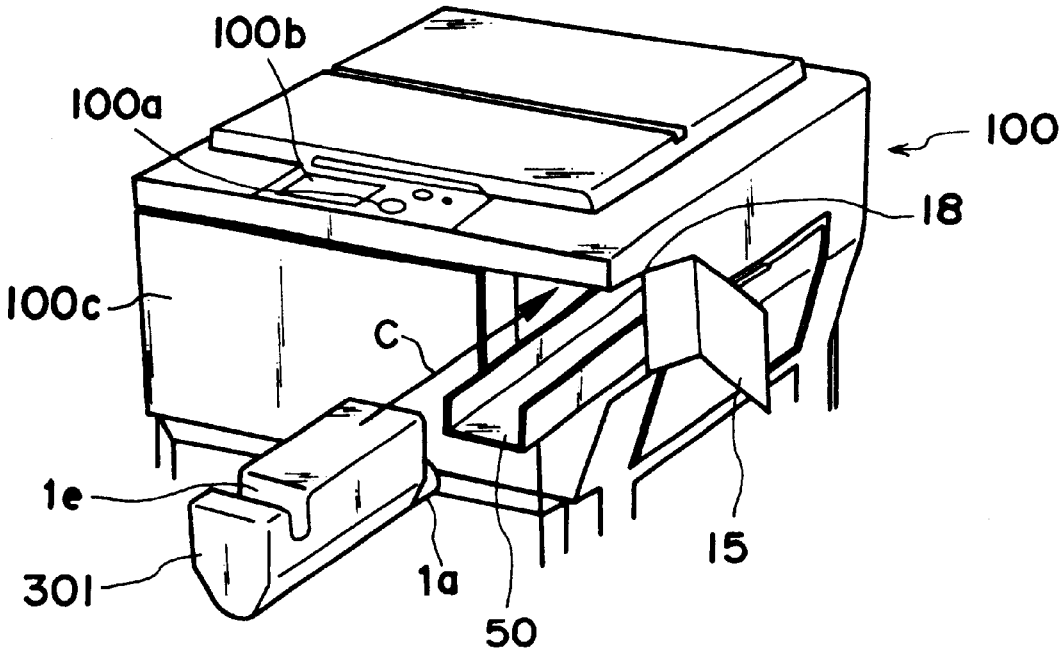
FIG. 3 is an illustration of mounting of the toner supply container into the electrophotographic copying machine after opening a cover in the electrophotographic copying machine.

As a toner supply container exchange cover 15 (hereinafter, exchange cover), which is a part of the carrier cover of the apparatus shown in FIG. 2, is opened by the user as shown in FIG. 3, a container holder 50 is pulled out to a predetermined position by a driving system (unillustrated). The toner supply container is to be set in this container holder 50. If the user wants to remove the toner supply container 301 from the apparatus main assembly 100, the user is to remove the toner supply container 301 in the open container holder after opening this exchange cover 15. The exchange cover 15 is a dedicated cover for installing or removing (for exchanging) the toner supply container 301; it is opened or closed only for installing or removing the toner supply container 301. The maintenance of the apparatus main assembly 100 is carried out by opening a front cover 100*c*.

It is not mandatory to provide the apparatus main assembly 100 with the container holder 50. In other words, the apparatus main assembly 100 may be structured so that the toner supply container 301 can be directly installed into, or removed from, the apparatus main assembly 100.

[Overall Structure of Toner Supply Container]

Next, the toner supply container in accordance with the present invention will be described.

The toner supply container in this embodiment is provided with a conveying member 302, and a stirring member 305 independent from the conveying member 302. The conveying member 302 and stirring member 305 are disposed within the toner supply container housing 301A.

Figure 6:
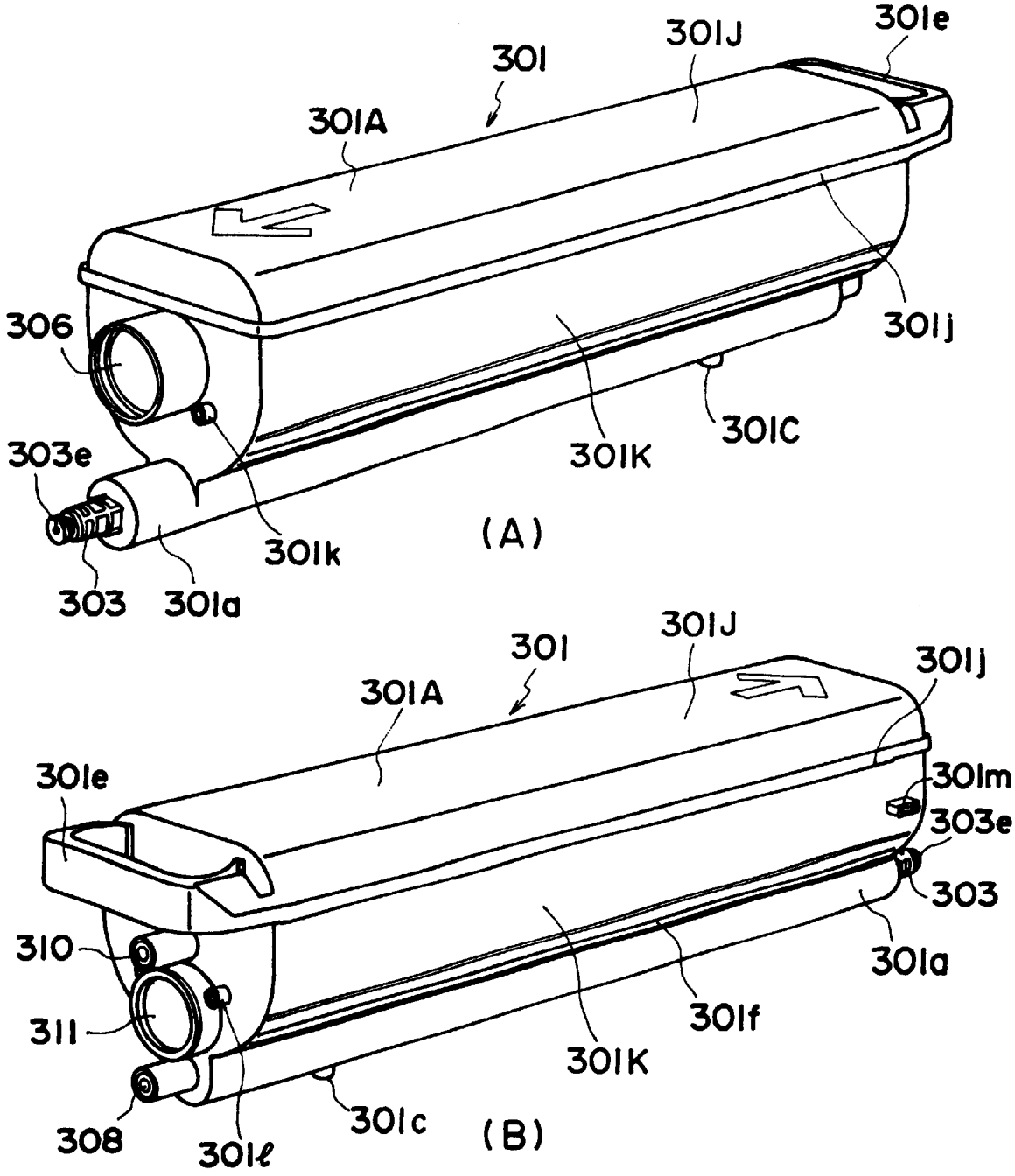
FIG. 6, (A) is a perspective view of a toner supply container according to an embodiment of the present invention as seen from a sealing member side, and (B) is a perspective view thereof as seen from the grip side.

FIG. 6 is a perspective view of the toner supply container in this embodiment.

Figure 7:
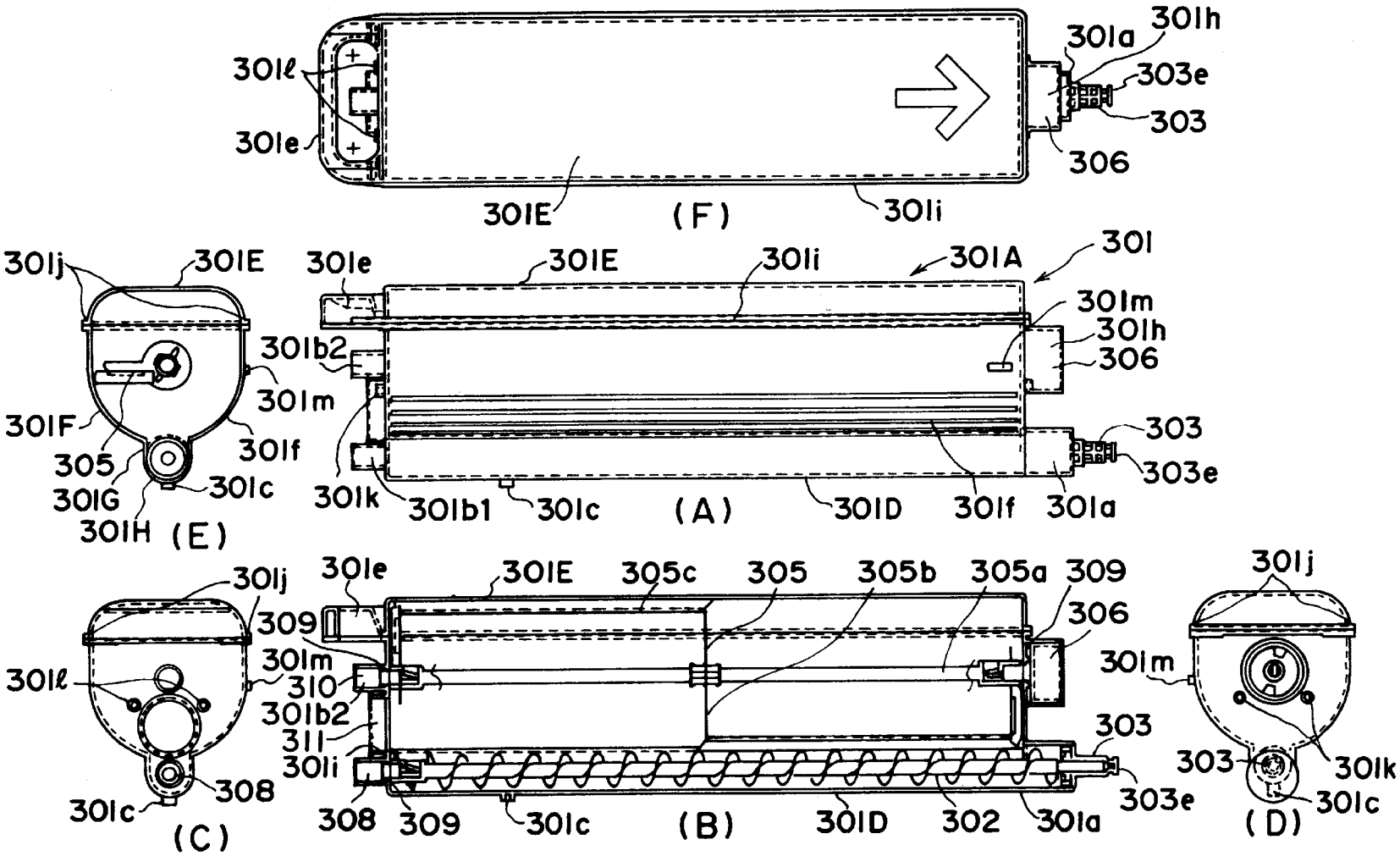
FIG. 7, (A) is a front view of a toner supply container according to an embodiment of the present invention, (B) is a sectional view thereof, (C) is a left side view thereof, (D) is a right side view thereof, (E) is a sectional side view thereof, and (F) is a top plan view.
Figure 8:
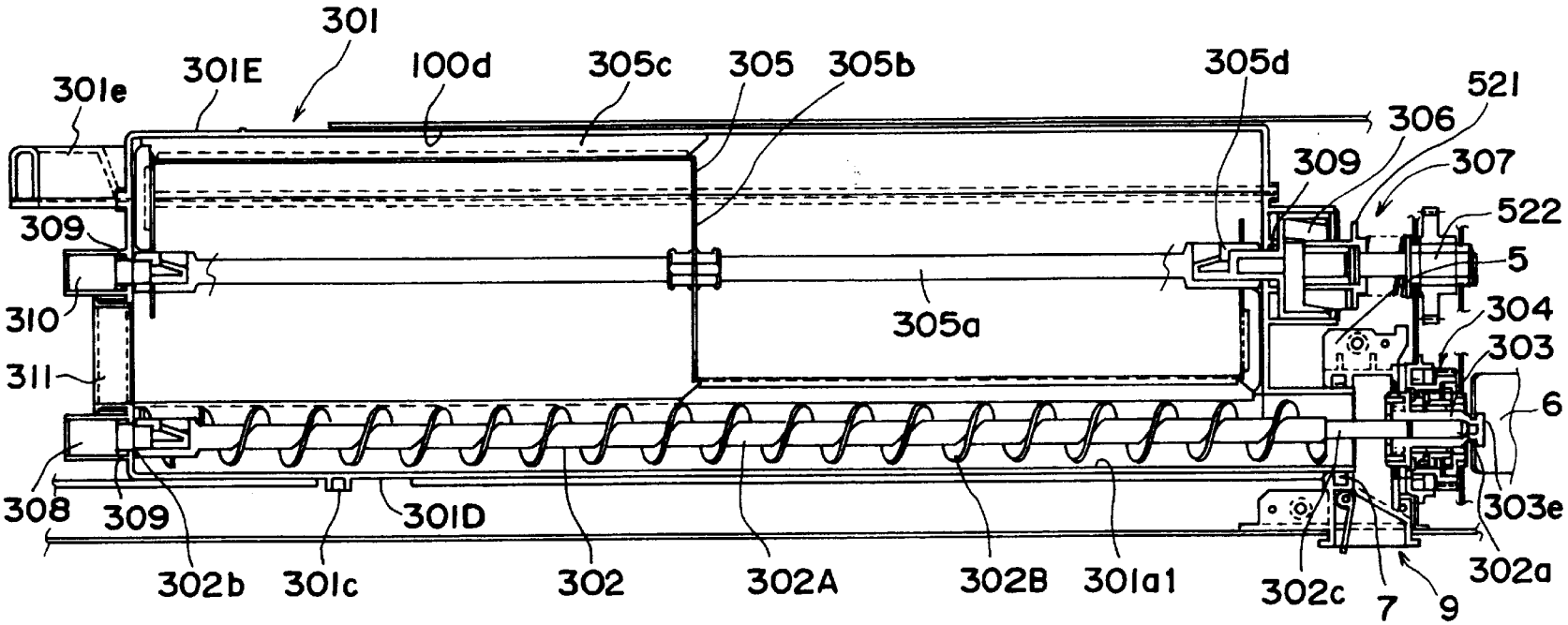
FIG. 8 is a sectional front view of a toner supply container when it is mounted to the main assembly of the apparatus wherein the supply opening is unsealed.
Figure 9:
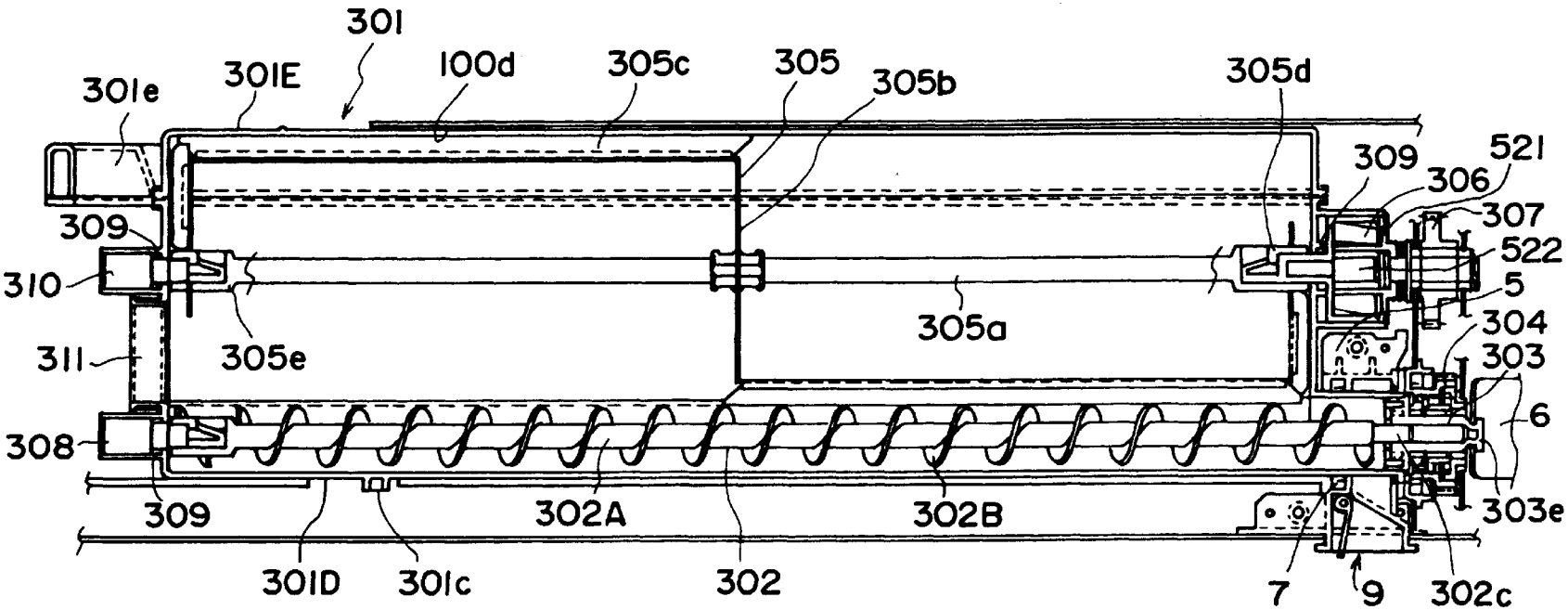
FIG. 9 is a sectional front view of the toner supply container when it is mounted to the main assembly of the apparatus, wherein the supply opening is sealed.

FIG. 7, (A), is a front view of the toner supply container in this embodiment; FIG. 7, (B), is a vertical cross-sectional view thereof at a plane parallel to the longitudinal direction thereof; FIG. 7, (C), is a left side view thereof; FIG. 7, (D), is a right side view thereof; FIG. 7, (E), is a vertical cross-sectional view thereof at a plane perpendicular to the longitudinal direction thereof; and FIG. 7, (F), is a top view thereof. FIG. 8 is a vertical cross-sectional view of the toner supply container and its adjacencies, parallel to the longitudinal direction of the toner supply container, with the toner supply outlet unsealed, after the installation of the toner supply container into the apparatus main assembly. FIG. 9 is a vertical cross-sectional view of the toner supply container and its adjacencies, parallel to the longitudinal direction of the toner container, with the supply outlet remaining sealed, after the installation of the toner supply container into the main assembly.

Referring to FIGS. 6–9, a reference character 301A designates the housing of the toner supply container 301, and a reference character 302 designates a conveying member for conveying the toner stored in the toner supply container housing 301A, toward a toner supply outlet 301*a*. A reference character 303 designates a sealing member for sealing the toner supply outlet opening 301*g*, and a reference character 304 designates a first coupling for transmitting a driving force to the sealing member 303 after the installation of the toner supply container 301 into the apparatus main assembly 100. A reference character 305 designates a stirring member for stirring the toner within the toner supply container housing 301A. A reference character 306 designates a transmitting member for transmitting a rotational driving force from the apparatus main assembly 100 to the stirring member 305, by engaging with the stirring member 305. A reference character 307 designates a second coupling for transmitting driving force to the transmitting member 306 after the installation of the toner supply container 301 into the apparatus main assembly 100.

Designated by a reference character 309 is an oil seal for preventing toner leakage from one of the longitudinal ends of the toner supply container 301.

[Structure of Toner Supply Container Housing]

Figure 10:
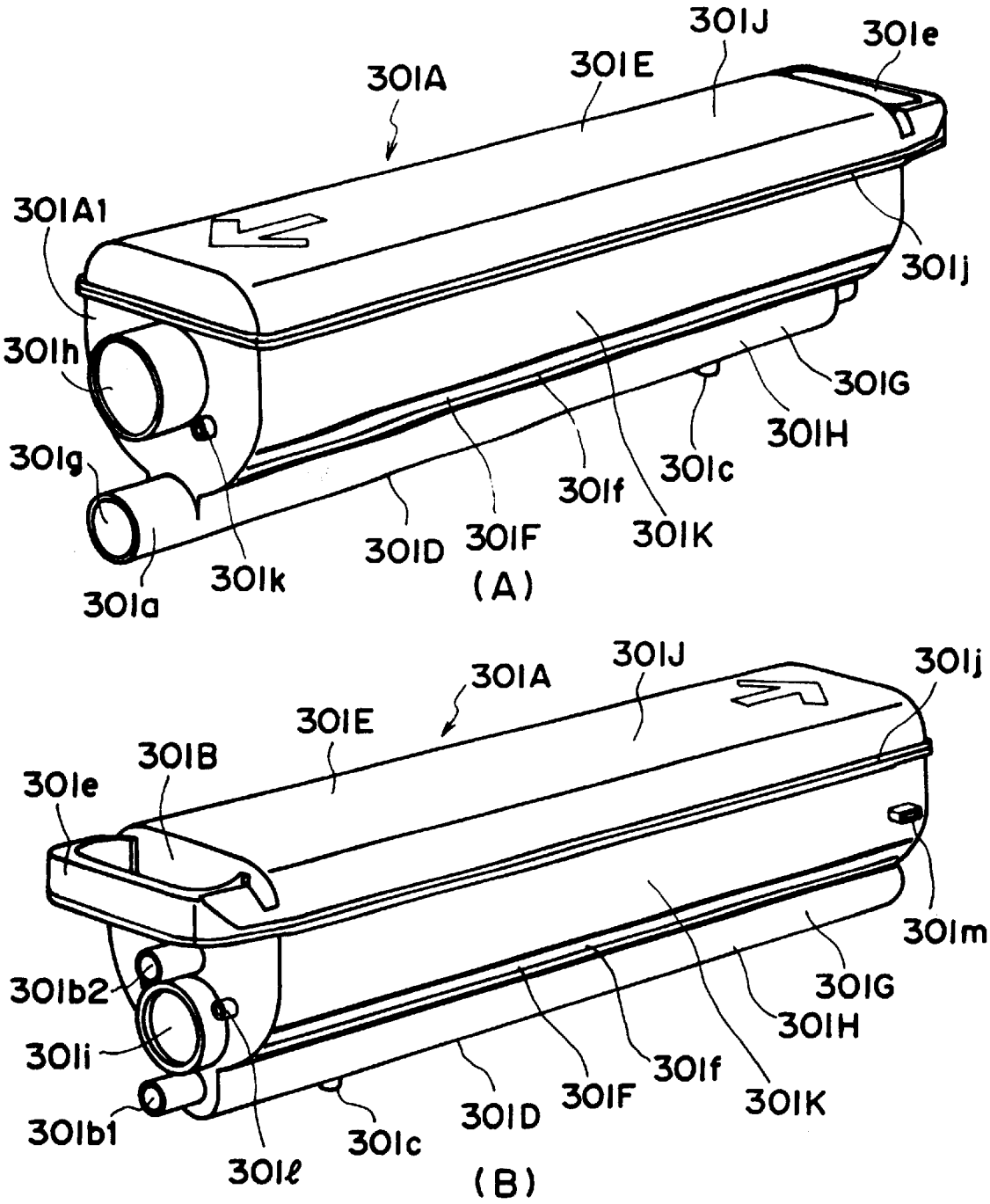
FIG. 10, (A) is a perspective view of a toner accommodating container part according to an embodiment of the present invention, (B) is a perspective view thereof as seen from the grip side.

At this point, referring to FIGS. 10 and 11, the housing of the toner supply container, that is, one of the main components of the toner supply container, will be described. FIG. 10 is a perspective view of the toner supply container housing.

Figure 11:
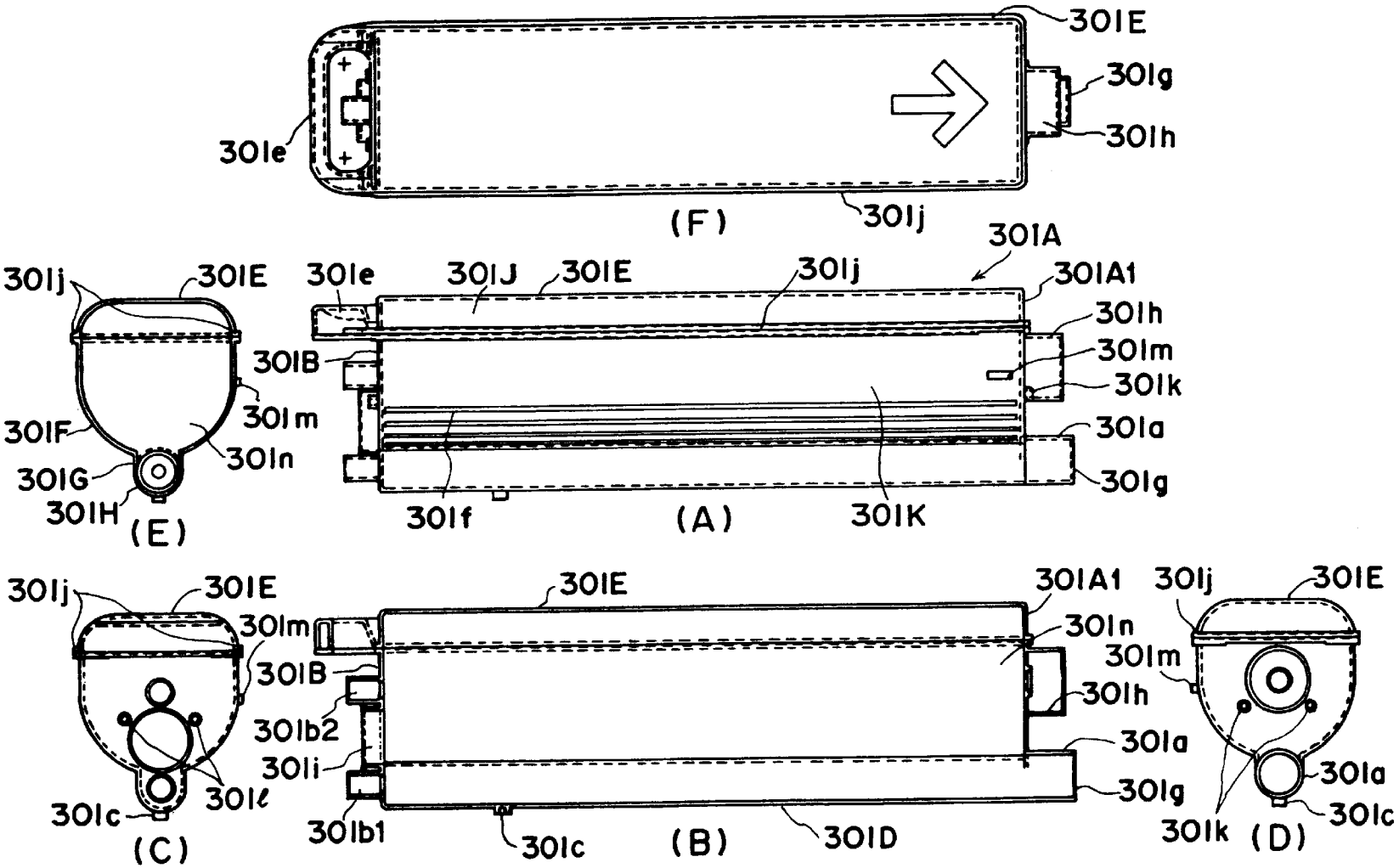
FIG. 11, (A) is a front view of a toner accommodating container part, (B) is a sectional view thereof, (C) is a left side view, (D) is a left side view thereof, (E) is a sectional side view thereof, and (F) is a top plan view thereof.

FIG. 11, (A), is a front view of the toner supply container housing; FIG. 11, (B), is a vertical cross-sectional view thereof at the central plane thereof, parallel to the longitudinal direction thereof; FIG. 11, (C), a left side view thereof; FIG. 11, (D), a right side view thereof; FIG. 11, (E), a vertical cross-sectional view thereof at a plane perpendicular to the longitudinal direction thereof; and FIG. 11, (F) is a top view thereof.

The toner supply container housing 301A comprises a top piece 301J (hereinafter, top frame), and a bottom piece 301K (hereinafter, bottom frame). The top and bottom frames 301J and 301K are welded together, creating a toner storage chamber 301*n*. In other words, the toner supply container housing 301A constitutes the shell of the toner chamber 301*n*. In terms of the cross-sectional view perpendicular to the longitudinal direction of the toner supply container housing 301A, the wall of the bottom frame 301J comprises: a pair of curved portions 301F with such a curvature that gradually reduces the width of the bottom frame 301J toward its bottom across the range correspondent to these curved portions; a pair of straight portions 301G, which downwardly, vertically, and contiguously extend from the corresponding bottom edges of the curved portions 301F, so that the width of the bottom frame 301K remains substantially the same toward the bottom across the range correspondent to these straight portions, and a substantially semicircular portion 301H, which is located immediately below the pair of the straight portions 301G, and connects the bottom edges of the pair of straight portions 301G.

A side plate 301A1 of this container housing 301A, i.e., one of the side plate perpendicular to the longitudinal direction of the container housing 301A, is provided with a cylindrical toner supply outlet 301*a*, which perpendicularly projects outward from the bottom portion of the side plate 301A1, more specifically, from the bottom portion corresponding to the aforementioned straight and semicircular portions of the longitudinal wall of the container housing 301A, and through which the toner stored in the toner storage chamber 301*n* is supplied to the apparatus main assembly 100. The outward end of the toner supply outlet 301*a* opens as the toner supply opening 301*g*. The other side plate of the 301B of the toner supply container housing 301A, which also is perpendicular to the longitudinal direction of the toner supply container housing 301A, is provided with the first bearing portion 301*b*1 for rotationally supporting the conveying member 302 (FIG. 7). More specifically, the first being portion 301*b*1 projects from the side surface 301B, from the location corresponding to the toner supply outlet 301*a*.

The outward surface of the bottom wall 301B of the container housing 301A is provided with a positioning portion 301*c* which cooperates with the corresponding portion of the apparatus main assembly 100 to position the container housing 301A relative to the apparatus main assembly 100 when the container housing 301A is installed into the apparatus main assembly 100. This positioning portion 301*c* also functions as an engagement portion, which engages with the toner supply outlet opening-closing means, with which the apparatus main assembly 100 is provided, to move the toner supply container 301 in the installing or removing direction of the toner supply container 301. In this embodiment, the engagement portion 301*c* (positioning portion) is an dowel-like projection that projects outward from the outward surface of the bottom wall 301D.

One of the side walls of the top frame 301J is provided with a handle 301*e*, which is grasped by the user when the toner supply container 301 is installed into, or removed from, the apparatus main assembly 100. Both curved portions 301F, one on the front side and the other on the rear side, are provided with a groove 301*f* which makes it easier for the user to hold the container housing 301A when the user installs the toner supply container 301 into the apparatus main assembly 100. The two grooves extend substantially parallel to each other in the longitudinal direction of the container housing 301A.

The side wall 301B of the container housing 301A is provided with a second hearing portion 301*b*2, which is located above the first bearing portion to rotationally support the stirring member 305. The side plate 301B is also provided with a toner supply inlet 301*i* through which toner supply is filled into the container housing 301A. As seen from the longitudinal direction of the container housing 301A, the toner supply inlet 301*i* is positioned in such a manner that the center of the toner supply inlet 301*i* is included in the line that connects the rotational centers of the conveying member 302 and stirring member 305.

The toner supply outlet 301*a* is provided on the side surface 301A1, that is, one of the end surfaces in terms of the longitudinal direction of the container housing 301A, opposite to the side surface 301B1 on which the handle 301*e* is provided. Therefore, the user is prevented from inadvertently touching the toner supply outlet 301*a* when installing the toner supply container 301 into the apparatus main assembly 100. Further, the toner supply outlet 301*a* is provided on the bottom portion of the side surface 301A1. Therefore, even after the amount of the toner stored in the container housing 301A becomes small, toner is efficiently discharged from the container housing 301A.

The toner supply outlet 301*a* projects 20 mm–40 mm, preferably, approximately 27.8 mm, from the side surface 301A1. It is a cylindrical portion with an external diameter of 20 mm–30 mm, preferably, 26 mm–29 mm, most preferably, approximately 27.6 mm.

As described above, the outward surface of the bottom wall 301D is provided with the engagement portion 301*c* (positioning portion). When the toner supply container 301 is installed into the apparatus main assembly 100, this engagement portion 301*c* is positioned by an engagement portion 51*c* (FIG. 4) with which the apparatus main assembly 100 is provided. Also as described above, the engagement portion 301*c* is a dowel-like cylindrical projection that perpendicularly projects 2 mm–8 mm from the outward surface of the bottom wall 301D. The external diameter of the cylindrical portion 301*c* is 5 mm–12 mm, preferably, approximately 8 mm. The portion of the cylindrical dowel-like projection 301*c* is 60 mm–80 mm, preferably, approximately 71 mm, from the side wall 301B, i.e., the side wall opposite to the side wall with the toner supply outlet 301*a*.

Although the engagement portion 301*c* (positioning portion) is desired to by cylindrical, it may be in the form of a square prism, a semicylinder, or the like.

The side wall 301A1 and the other side wall 301B are provided with a pair of bosses 301*k* for positioning the container housing 301A when examining the measurement of the container housing 301A before the shipment of the toner supply container 301 from a factory.

Designated by a reference character 301*m* is an erroneous installation prevention rib.

The position of the rib 301*m* is differentiated depending on the toner supply container type, so that the user is prevented from installing a toner supply container of a wrong type into the apparatus main assembly 100.

It is desired that the container housing 301A is formed of plastic material, such as resin, with the use of such a production method as injection molding, blow molding, injection blow molding, or the like. However, various materials and methods different from those listed above may be used. It is recommended that the container housing 301A be manufactured with the use of a method, according to which the container housing 301A is formed in two or more pieces, the number of which is optional, and the pieces are joined together with a means such as welding, pasting, or the like.

In this embodiment, the container housing 301A is formed of high impact polystyrene by injection molding, in two pieces, that is, the top frame 301J and bottom frame 301K, and the two pieces are joined by vibration welding.

[Structure of Conveying Member]

Referring to FIG. 8, the conveying member 302 comprises a shaft portion 302A and a rigid spiral conveying blade 302B. The conveying blade 302B is a conveying member, which is fixed to the shaft portion 302A, and conveys powder toner in a predetermined direction (toward toner supply outlet 301*a*) as the shaft portion 301A rotates. The conveying member 302 is attached to the container hosing 301A in such a manner that, as seen from its longitudinal direction, sweeping range of the conveying blade 302B falls within the approximately circular toner supply outlet opening 301*g*, and the rotational center of the shaft portion 302A substantially coincides with the center of the toner supply outlet opening 301*g*.

The choice of the conveying member 302 does not need to be limited to the so-called screw type, that is, the type of the conveying member 302 in this embodiment. For example, it may comprise a shaft portion such as the shaft portion 302A, and a flexible blade attached to the shaft portion. Further, the shaft portion and blade portion may be integral, or may be separate pieces. In this embodiment, the shaft portion 302A and conveying blade 302B are integrally formed of plastic material.

Further, in this embodiment, the conveying member 302 has an extension portion 302, which is to be inside toner supply outlet 301*a*. The inward end of the extension portion 302*c* includes a longitudinal end portion of the conveying blade 302B, the length of which is equivalent to no less than one full turn about the shaft portion 302A. Further, the outward end of the extension portion 302*c* extends outward from the toner supply outlet 301*a*, forming an outward end portion 302*a* (FIG. 8) through which the conveying member 302 receives a driving force from the apparatus main assembly 100. Thus, the outward end portion 302*a* is fitted with a sealing member 303, which is movable in the axial direction of the shaft portion 302A.

The aforementioned outward end portion 302*a* (driving force reception portion) is shaped suitably for the reception of the rotational force from the apparatus main assembly 100. In this embodiment, it is in the form of a polygonal prism, in particular, a square prism. The end portion of the shaft portion 302A is supplied by the sealing member 303, by the outward end portion 302*a* of the extension portion 302*c* of the shaft portion 302A. The end portion 302*b* of the shaft portion 302A, on the opposite side, is provided with a first bearing 308, by which the shaft portion 302A is supported by the container housing 301A so that the shaft portion 302A is rotatable during the unsealing of the toner supply container 301.

The conveying member 302 is supported by the sealing member 303 in such a way that the conveying blade 302B does not come into contact with the inward surface 301*a*1 of the toner supply outlet 301*a*, and the inward surface 301*a*1 of the toner supply outlet 301*a* and the shaft portion 302A remain substantially horizontally in terms of their longitudinal directions. With the supporting or the conveying member 302 in the above described manner, the toner can be substantially horizontally conveyed toward the toner supply outlet opening 301*g* by the rotation of the conveying member 302. Further, it is possible to prevent the following problematic phenomena: adhesion of melted toner to the inward surface of the toner supply outlet 301*a*, and creation of larger toner particles. More specifically, as the conveying blade 302B rotates, toner particles, which are microscopic in size, are pinched between the inward surface 301*a*1 of the toner supply outlet 301*a* and the perimeter edge of the conveying blade 302B, and are vigorously rubbed by the inward surface 301*a*1 and the perimeter edge of the blade 302B. As a result, some of the pinched toner particles melt and adhere to the inward surface 301*a*1, or form toner particles of a larger size. These phenomena can be prevented by the supporting of the conveying member 302 in the above described manner.

Also as described above, the conveying member 302 is desired to be manufactured using resinous material such as plastics, and a method such as injection molding, because these materials and methods are simple and easy. However, materials and methods different from those listed above may be used. Further, the conveying member 302 may be manufactured in pieces, which are to be bonded together in the form of the conveying member 302. Where the driving lines are drawn across the conveying member 302 is optional.

[Structure of Sealing Member]

Figure 12:
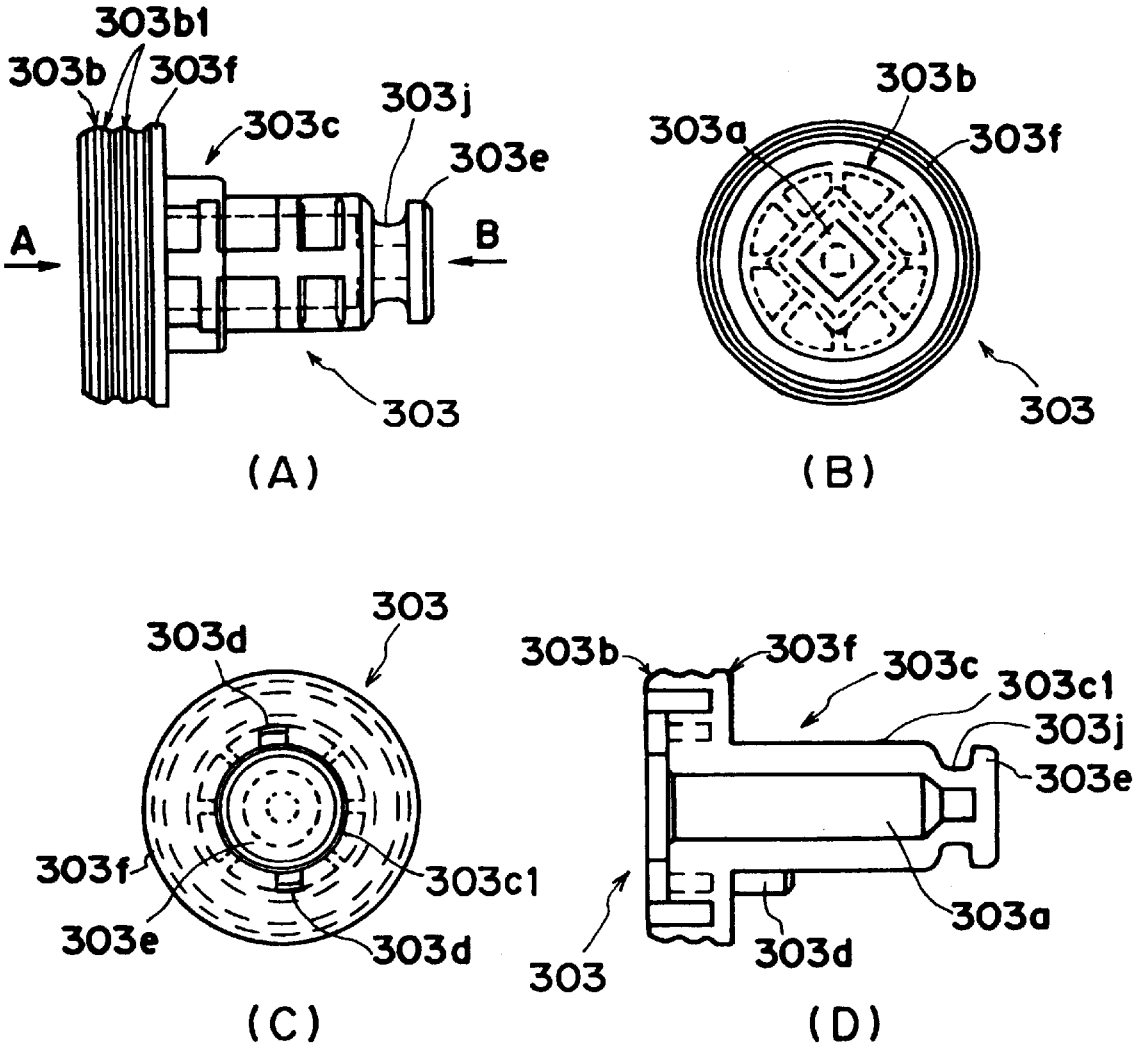
FIG. 12, (A) is a front view of a sealing member, (B) is a view taken along A, (C) is a view taken along B, and (D) is a sectional front view.

Next, referring to FIG. 12, the sealing member 303 will be described. FIG. 12, (A) is a front view of the sealing member 303: (B), is a view of the sealing member 303 as seen from the direction indicated by an arrow mark A; (C), is a view of the sealing member 303 as seen from the direction indicated by an arrow mark B; and FIG. 12, (D), is a sectional view of the sealing member 302 as seen from the front.

In FIGS. 12, (A)–(D), a reference character 303*b* designates a sealing portion, which is on the side that faces toner supply container 301, and usealably seals the toner supply outlet opening 301*g* of the toner supply container 301. The external diameter of this sealing portion 303*b* is made to be substantially larger than the internal diameter of the toner supply outlet opening 301*g*. The toner supply outlet opening 301*g* is sealed by pressing the engagement portion 3031*b* of the sealing portion 303*b* into the toner supply outlet opening 301*g*.

The sealing member 303*c* doubles as a coupling engagement portion which functions as a driving force transmission portion (driving portion), i.e., a driving force receiving portion through which a driving force for rotating the conveying member 302 is received from the apparatus main assembly 100. The coupling engagement portion 303*c* is provided with a projection portion 303*c*1, which projects in such a direction that makes the projecting portion 303*c*1 extend away from the toner supply container 301A, substantially coaxially with the shaft portion 302A of the conveying member 302, after the attachment of the sealing member 303 to the container housing 301A. The coupling engagement portion 303*c* is also provided with a spline 303*d* as an engagement portion, which is on the peripheral surface of the projection portion 303*c*1 and engages with the first coupling 304. In this embodiment, the projecting portion 303*c*1 is provided with two splines 303*d* separated by equal distances in terms of the circumferential direction of the projecting portion 303*c*1.

More specifically, two splines 303*d* are separated by approximately 180 degrees in terms of the angle about the longitudinal axis of the sealing member 303.

The spline 303*d* projects 0.5 mm–3 mm, preferably, approximately 1.8 mm, from the peripheral surface of the projecting portion 303*c*1 of the sealing member 303.

The external diameter of the projection portion 303*c*1 is 10 mm–14 mm, preferably, approximately 12 mm.

In summary, tallying from one longitudinal end to the other, the sealing member 303 comprises, on its peripheral surface, the sealing portion 303*b*, coupling engagement portion 303*c* (driving force receiving portion), and spline 303*d* (engagement portion), in the listed order:

The sealing member 303 is provided with a square engagement hole 303*a* as a driving force transmitting portion, which engages with one (end portion 302*a*) of the end portion of the conveying member 302 and transmits to the conveying member the driving force it receives from the apparatus main assembly 100. This engagement hole 303*a* extends through the center of the sealing member 303 from the point corresponding to the sealing portion 303*b* at one longitudinal end of the sealing member 303 to the point corresponding to the coupling engagement portion 303*c* on the other longitudinal end. The engagement hole 303*a* has a square shape, which corresponds to the square shape of the end portion 302*a* of the conveying member 302, which projects from the toner supply outlet 301*a*. The engagement hole 303*a* is made slightly larger than the shaft end portion 302*a* so that the shaft end portion 302*a* loosely fits into the engagement hole 303*a*.

Since the shaft end portion 302*a* loosely fits into the engagement hole 303*a*, they are allowed to move relative to each other in their axial direction while remaining engaged with each other in terms of their rotational directions. Thus, the sealing member 303 can be freed from the container housing 301A to unseal (expose) the toner supply outlet opening 301*g* during the installation of the toner supply container 301.

The margin by which the shaft end portion 302*a* fits into the engagement hole 303*a* is such a length that does not cause the sealing member 303 to entirely disengage from the container housing 301A when the sealing member 103 is freed from the container housing 301A. Thus, even after the freeing of the sealing member from the container housing 301A, the conveying member 302 can receive the driving force through the sealing member 303 (coupling engagement portion 303*c*).

The sealing member 303 is also provided with a mandible-like portion 303*f*, which is located between the coupling engagement portion 303*c* and sealing portion 303*b*, and collides with the end portion of a powder toner supplying portion 301*a* (toner supply outlet portion) as the sealing portion 303*b* is pressed into the toner supply outlet 301*a*. The external diameter of the mandible-like portion 303*f* is approximately the same as that of the toner supply outlet 301*a* (preferably, smaller than the toner supply outlet 301*a*). With the presence of this mandible-like portion 303*f*, the sealing portion 303*b* is controlled to be pressed into the toner supply outlet 301*a* by a margin exactly equal to the length of the sealing portion 303*b*.

Designated by a reference character 303*e* is an engagement projection, which is located at the end of the coupling engagement portion 303*c*, an engages with an engagement member 5 (FIG. 4) with which the apparatus main assembly 100 is provided. When unsealing the toner supply outlet opening 301*g*, the sealing member 303 is held in place as this engagement projection 303*e* becomes engaged with the engagement member 6.

The sealing member 303 with the above described structure is also desired to be manufactured using resinous material such as plastics, and injection molding. However, various materials and manufacturing methods other than those listed above may be used. Further, the sealing member 303 may be manufactured in pieces, which are to be bonded together in the form of the sealing member 303. Where the dividing lines are drawn across the sealing member 303 is optional. The sealing member 303 is required to have a proper amount of elasticity to seal the toner supply portion 301*a* (toner supply outlet opening) by being pressed thereinto. Thus, low density polyethylene is most preferable as the material for the sealing member 303. Next, in terms of the order of preference as the material for the sealing member 303, polypropylene, nylon, high density polyethylene, or the like, are desirable.

A reference character 303*j* designates an engagement groove into which the engagement member 6 on the apparatus main assembly 100 side fits. The engagement groove 303*j* is desired to be 1.5 mm–5 mm, preferably, approximately 3 mm, in width, and 0.5 mm–5 mm, preferably, approximately 2.5 mm, in depth.

As described above, the sealing member 303 has the substantially cylindrical engagement portion 303*b*1 which fits into the toner supply outlet 301*a*. It is substantially coaxial with the mandible-like portion 303*f*. Also as described above, the sealing member 303 is provided with the projecting portion 303*c*1, which is on the opposite side of the mandible-like portion with reference to the engagement portion 303*b*1 in terms of the longitudinal direction of the container housing 301A, and projects outward in terms of the longitudinal direction of the container housing 301A, away from the mandible-like portion 303*f*. The projected portion 303*c*1 is substantially coaxial with the engagement portion 303*b*1. There is provided the driving force receiving portion 303*d* (spline) at the base of the projecting portion 303*c*1. The projecting portion 303*c*1 is provided with the engagement groove 303*j*, which is made in the outward end portion of the projection portion 303*c*1. The outward portion of the sealing member 303, beyond the engagement groove 303*j*, is the engagement portion 303*e*. Further, the sealing member 303 is provided with the hole that extends from the longitudinal end of the engagement portion 303*b*1 side to the engagement portion 303*e*. This hole is the driving force transmitting portion 303*a* (engagement hole). Since the hole 303*a* is a blind hole, being closed on the engagement portion 303*e* side, the toner does not leak out of the toner supply container 301 through the hole 303*a*, during or after the fitting of the engagement portion 303*b*1 into the toner supply outlet 301*a*. In other words, the toner supply outlet 301*a* is sealed by the attachment of the sealing member 303.

In this embodiment, the sealing member 303 has for functions: (1) the function to seal the toner supply outlet 301*a*; (2) function to receive the rotational driving force transmitted from the apparatus main assembly 100; (3) the function to transmit the rotational driving force to the conveying member 302; and (4) the function to engage with the engagement portion 6 provided on the apparatus main assembly 100 side to open or close the toner supply outlet 301*a*. Thus, the sealing member 303 is capable of rotating the conveying member 302 by transmitting the driving force to the shaft portion 302A through the extension portion 302*c* after the reception of the driving force from the apparatus main assembly 100.

[Structure of Stirring Member]

Figure 13:
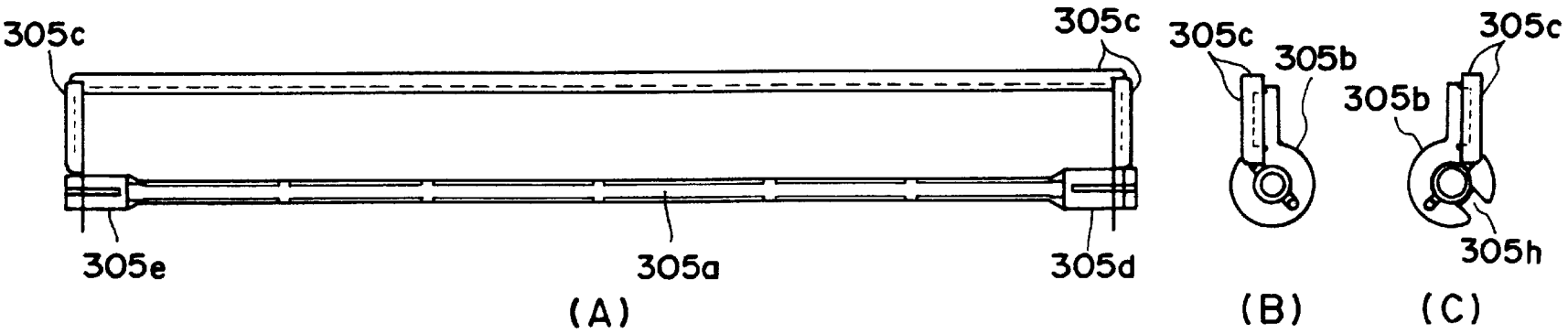
FIG. 13, (A) is a front view of a stirring member, (B) is a right side view thereof, (C) is a right side view thereof.

Next, referring to FIG. 13, the stirring member will be described. FIG. 13, (A) is a front view of the stirring member; (B), is a left side view thereof; and FIG. 13, (C) is a right side view thereof.

Figure 15:
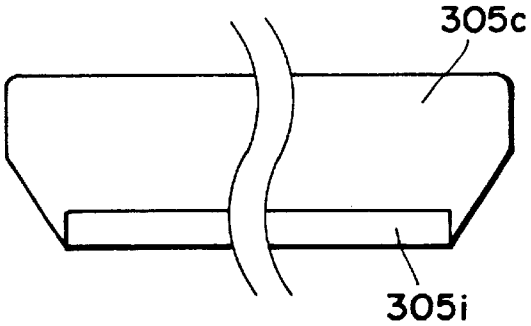
FIG. 15 is an enlarged view of a flexible blade portion.
Figure 14:
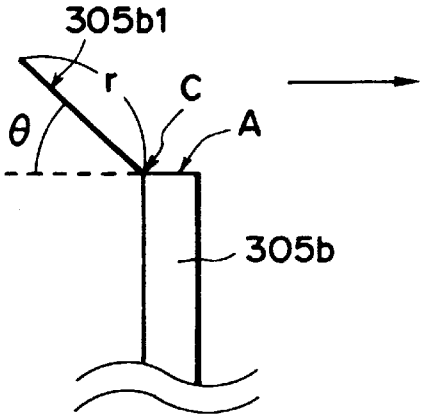
FIG. 14 is an enlarged side view of a rigid blade portion.

As shown in FIG. 13, the stirring member 305 comprises a shaft portion 305*a*, a rigid blade portion 305*b*, and a flexible blade portion 305*c*. FIG. 14 is an enlarged side view of the rigid blade portion 305*b*, and FIG. 15 is an enlarged side view of the flexible blade portion 305*c*. The shaft portion 305*a* manufactured from plastics with relatively high rigidity by injecting molding. The rigid blade portion 305*b* is formed of material with a very high level of rigidity, for example, metallic material such as stainless steel, whereas the flexible blade portion 305*c* is formed of material with a relatively low level of rigidity, for example, plastic film or sheet, or elastomer sheet. In this embodiment, polyester sheet was used as the material for the flexible blade portion 305*c*.

The longitudinal end 305*d* of the stirring member 305 engages with the aforementioned transmitting member 306 (FIG. 8), within the bearing portion 301*h* (FIG. 11) of the toner supply container housing 301A. The other longitudinal end 305*d* of the stirring member 305 engages with the stopping member 310 (second bearing portion) (FIG. 8), within the second bearing supporting portion 301*b*2 (FIG. 11) of the toner supply container housing 301A. As seen from the longitudinal direction of the stirring member, the rotational center (axis) of the stirring member 305 virtually coincides with the center of theoretical circle which includes inward surface of the curved portion 301F of the container housing 301A. Although the shaft portion 305*a* in this embodiment is formed of plastics with a relatively high level of rigidity by injection molding, different material, for example, metallic material, may be used.

The rigid blade portion 305*b* is desired to be formed of metallic material, in a single piece, for the sake of simplicity. However, different materials and manufacturing methods may be used. That is, it may be manufactured in two or more separate pieces, which are to be bonded together in the form of the rigid blade portion 305*b* by welding, gluing, or the like. Where the driving lines are drawn across the rigid blade portion 305*b* is optional. In this embodiment, a rigid blade portion made by pressing the approximately 0.8 mm thick stainless steel sheet is used as the rigid blade portion 305*b*. The portion of the rigid blade 305*b*, which engages with the aforementioned shaft portion 305*a*, is shaped to agree with the shape of the shaft portion 305*a* to receive a driving force from the shaft portion 305*a*. As the shaft portion 305*a* rotates, the stirring member 305 rotates with the shaft portion 305*a* to stir the toner in the container housing 301A.

Referring to FIG. 13, the provision of a notch 305*h* at one end as illustrated in FIG. 13 makes it easier to assemble the stirring member 305. The rigid blade portion 305*b* is in the form of a piece of flat plate, and is virtually parallel to the direction of rotational tangential line across its entire length, and its outward edge portion 305*b*1 in terms of the radial direction of its sweeping area is slanted in the downstream direction in terms of its rotational direction. Referring to FIG. 14, a length r of this outward edge portion 305*b*1, i.e., the slanted portion, is desired to be 2 mm–8 mm, and the angle Θ of the slanted portion 305*b*1 is desired to be 30–50 deg. Preferably, the length r of the slanted portion 305*b*1 is desired to be 3 mm–5 mm, and the angle Θ is desired to be approximately 50 deg.

In this embodiment the length and angle Θ of the slanted portion 305*b*1 are made to be approximately 5 mm and approximately 40 degrees, respectively. Although the distance r from the center of the rotational axis to the outward edge of the rigid blade portion 305*b* may be optionally determined depending on the size of the container hosing 301A, it is desired to be 70–95% of the internal diameter of the container housing 301A, that is, the diameter of the theoretical cylinder which includes the inward surface of the curved portions 301F of the container housing 301A, and is coaxial with the shaft portion 305*a* of the stirring member 305. In this embodiment, it is made to be approximately 39.4 mm (89%) because the diameter of this theoretical cylinder is approximately 44.5 mm.

The flexible blade portion 305*c* is formed of material with a relatively low level of rigidity, for example, a plastic film or sheet, or an elastomer sheet. Its thickness is desired to be approximately 50 μm–500 μm, preferably 100 μm–300 μm. In this embodiment, an approximately 100 μm thick sheet of polyester was used.

The flexible blade portion 305*c* extends across the entire length of the rigid blade portion 305*b* and is pasted to the slanted portion 305*b*1 of the rigid blade portion 305*b*, in such a manner that the outward edge of the flexible blade portion 305*c* in terms of the radial direction of the sweeping area of the stirring member 305 makes contact with the inward surface of the container housing 301A. It rotates together with the rigid blade portion 305*b*, while scraping the toner away from the inward surface of the container housing 301A. The dimension of the flexible blade portion 305*c* in terms of the radial direction of the sweeping area of the stirring member 305 is desired to be approximately 0.5 mm–10 mm greater than the distance of the outward edge of the rigid blade portion 305*b* from the inward surface of the container housing 301A in terms of the radial direction of the sweeping area of the stirring member 305, because such a dimensional arrangement enhances the above described affects.

In this embodiment, the dimension of the flexible blade portion 305*c* in terms of the radial direction of the sweeping area of the stirring member 305 is made to be approximately 6 mm greater than the distance of the outward edge of the rigid blade portion 305*b* from the inward surface of the container housing 301A in terms of the radial direction of the sweeping area of the stirring member 305. Also in this embodiment, the flexible blade portion 305*c* is pasted to the slanted portion 305*b*1 of the rigid blade portion 305*b* with the use of a piece of double-sided adhesive tape 3051 (DIC #8800CH) as shown in FIG. 15. The flexible blade portion 305*c* may be attached to the rigid blade portion 301*b* with the use of other known conventional means such as riveting, crimping or the like, instead of pasting.

Figure 16:
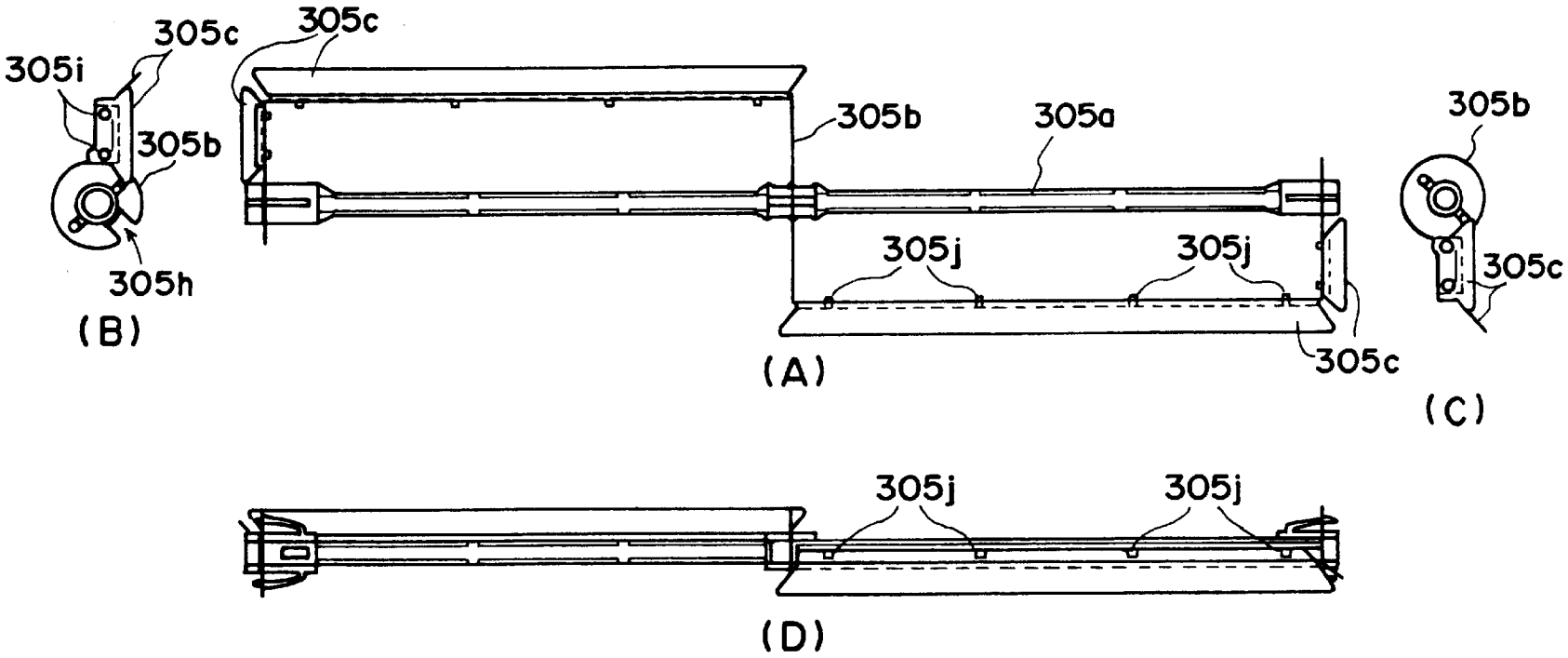
FIG. 16, (A) is a front view of a stirring member according to another embodiment of the present invention, (B) is a left side view, (C) is a right side view, and (D) is a bottom view.

Referring to FIG. 16, the rigid blade portion 305*b* may be divided at the approximate center in terms of the longitudinal direction, into two pieces which are different from each other by 180 degrees in rotational phase; the two pieces may be staggered along the shaft portion 305*a*. The number of pieces into which the rigid blade portion 305*b* is to be divided may be optionally determined depending on the shape and length of the container housing 301A; it may be three, four, or an even larger number. Further, the rigid blade 305*b* may be in the form of a longitudinal spiral, the rotational phase of which continually changes across its entire length. Both the longitudinal end portions of the rigid blade portion 305*b*, and the approximate center portion of the rigid blade 305*b*, which engages with the shaft portion 305*a*, may be provided with the notch 305*h*, as shown in the drawing, to increase assembly efficiency. In this embodiment, in order to reduce toner resistance by reducing the projected area of the rigid blade portion 305*b* in terms of its rotational direction, the dimension of the slanted portion 305*b*1 of the rigid blade portion 305*b* in terms of the radial direction of the sweeping area of the stirring member 305 was made to be approximately 3 mm. The above described dimension and angle of the slanted portion 305*b*1 are desired to be approximately 2 mm–8 mm, and 30–50 degrees, preferably 3 mm–5 mm, and approximately 45 degrees, respectively.

As for the means for attaching the flexible blade portion 305*c* to the rigid blade portion 305*b*, the former may riveted to the latter with the use of aluminum rivets 305*j*. In this case, it is possible that if the rivet holes of the flexible blade portion 305*c* are misaligned even slightly, the flexible blade portion 305*c* becomes wavy as it is riveted. Therefore, it is advisable that the flexible blade portion 305*c* is provided with perforations or a half cut A across the portion correspondent to the bend C of the rigid blade portion 305*b*. As for the attaching means, other known conventional means such as pasting with double-sided adhesive tape may be used instead of the above described method.

In this embodiment, a single stirring member, i.e., the stirring member 305, is disposed within the container housing 301A. However, a plurality of stirring members may be disposed within the container housing 301A as needed.

[Assembly Method for Toner Supply Container]

Next, a method for assembling the toner supply container 301 will be described (FIG. 7, (B)).

When assembling the toner supply container 301, first, the conveying member 302 is to be inserted, from above, into the bottom portion of the bottom from 301K. Then, the oil seal 309 is inserted into the first bearing portion 301*b*1, and the longitudinal end portion 302*b* of the conveying member 302 is fitted with the bearing 308. Next, the toner supply outlet opening 301*g* is sealed with the sealing member 303. Then, the stirring member 305 is inserted, from above, into the bottom frame 301K. Then, after the insertion of the oil seal 309 into the second bearing supporting portion 301*b*2, one longitudinal end portion of the stirring member 305 and the other longitudinal end of the stirring member 305 are fitted with the second bearing 310 and the transmitting member 306, respectively. Then, the top frame 301J is welded to the bottom frame 301K by vibration welding.

Next, a predetermined amount of toner is filled into the container housing 301A through the toner supply inlet 301*i* of the toner supply container housing 301A, and the toner supply inlet 301*i* is sealed with the sealing member 311. This completes the assembly of the toner supply container 301. As is evident from the above description, it is very simple to assemble the toner supply container 301, and also, the number of assembly steps can be very small.

It should be noted here that toner may be filled through the toner supply outlet opening 301*g*.

[Exchange Method for Toner Supply Container]

The toner supply container 301 in accordance with the present invention is replaced in the following steps.

As the amount of the toner in the toner supply container 301 is reduced to virtually nothing through image formation, the user is informed by the displaying means 100*b*, for example, a liquid crystal screen (FIG. 2), of a toner supply container vacancy detecting means (unillustrated); with which the apparatus main assembly 100 is provided, that virtually the entire amount of the toner in the toner supply container 301 is gone.

In this embodiment, the toner supply container 301 is exchanged with a fresh one by the user himself or herself. The exchanging steps are as follows.

Figure 4:
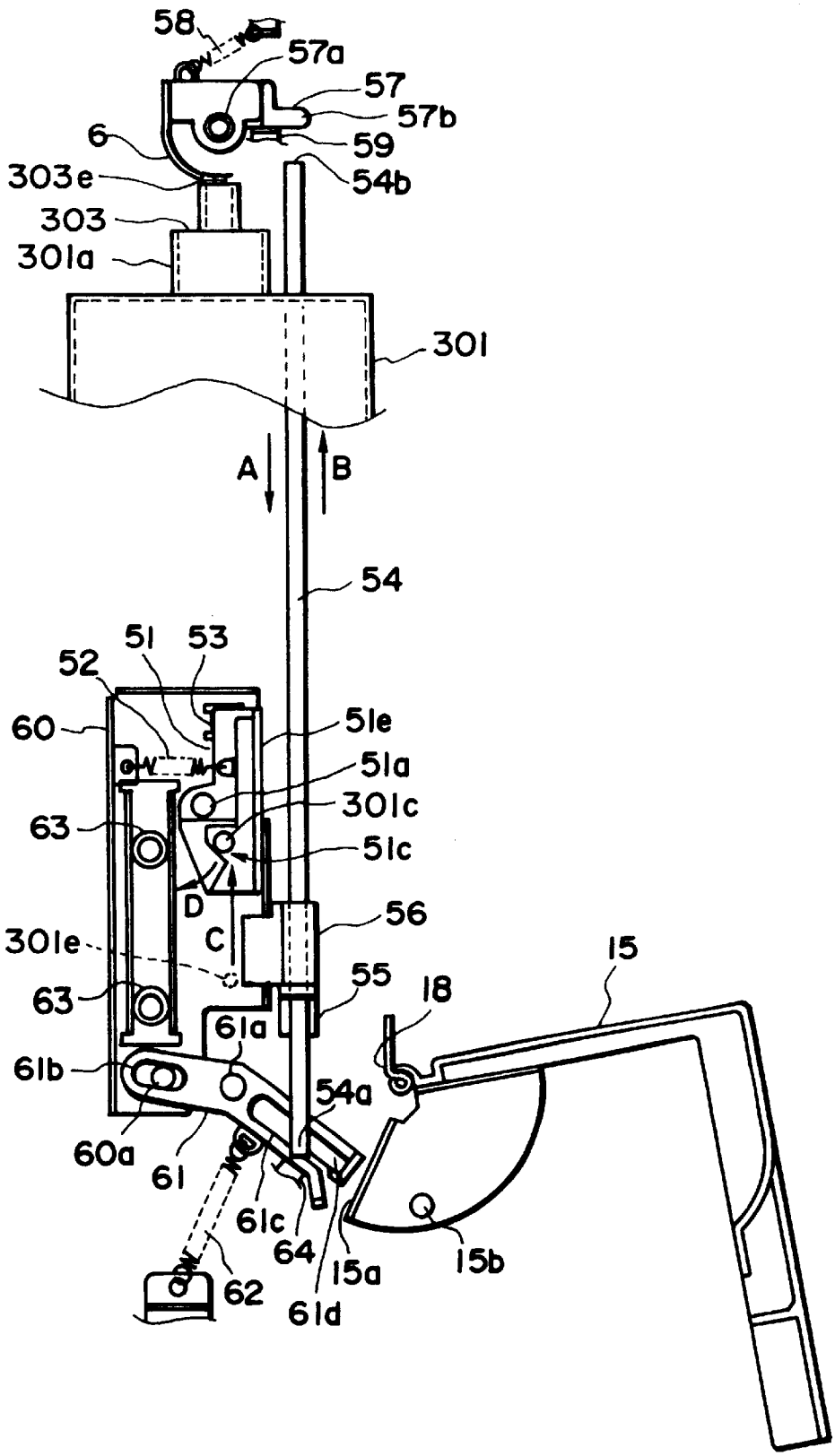
FIG. 4 is an illustration of opening and closing means for the toner supplying means when the cover of the electrophotographic copying machine is open.

First, referring to FIG. 2, the change cover 15, which has remained closed, is opened to a predetermined point by rotating it about a hinge 18 as shown in FIG. 3. As the exchange cover 15 is rotated, the toner supply container housing 301A is caused to move by the toner supply outlet opening-closing means, the movement of which is linked to the movement of the exchange cover 15. This opening-closing means will be described later. As the toner supply container housing 301A moves, the sealing member 303 (FIG. 5), which has been at its designated position at which it remains separated from toner supply outlet 301*a*, is pressed into the toner supply outlet 301*a*. As a result, the toner supply outlet opening 301*g* is closed (FIG. 4).

Next, the user is to pull out the toner supply container 301, which has been in the apparatus main assembly 100, and from which the toner has been almost entirely consumed, from the apparatus main assembly 100 in the direction opposite to the direction indicated by an arrow mark C in FIG. 3. Thereafter, the user is to insert a fresh toner supply container 301 into the apparatus main assembly 100 in the direction indicated by the arrow mark C, and close the exchange cover 15 (FIG. 2). As the exchange cover 15 is closed, the sealing member 303 is moved away from the toner supply outlet 301*a*, by the toner supply outlet opening-closing means, the movement of which is linked to the movement of the exchange cover 15. As a result, the toner supply outlet opening 301*g* is unsealed. The steps described above are the steps for exchanging the toner supply container 301 with a fresh one.

Figure 5:
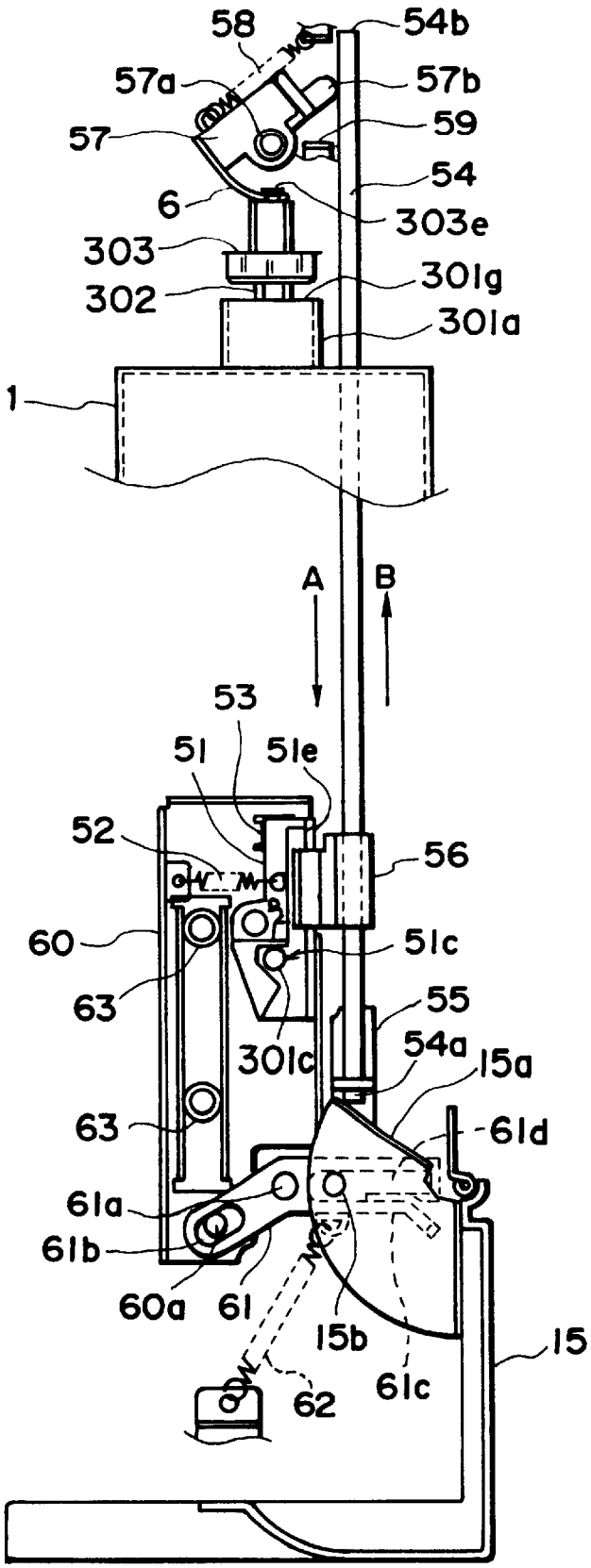
FIG. 5 is an illustration of opening and closing means for the toner supplying opening when the cover of the electrophotographic copying machine is closed.

Next, referring to FIGS. 4 and 5, the opening or closing of the toner supply outlet opening 301*g*, which is linked to the opening or closing movement of the exchange cover 15, will be described. The various structures which will be described below are all provided in the apparatus main assembly 100. In FIGS. 4 and 5, a reference character 6 designates the engagement member as an engaging means which engages with the sealing member 303, more specifically, the engagement projection 303*e* of the sealing member 303. A reference character 57 designates a supporting base to which the engagement member 6 is anchored. The supporting base 57 is rotatable about is rotational shaft 57*a*, and is kept under the pressure applied in the clockwise direction by a pressing generating member 58. A reference character 59 designates a stopper for positioning the supporting base 57.

Designated by a reference character 60 is a slidable base made slidable by the provision of rollers 63. A reference character 51 designates a container catching member provided on the slidable base 60. The container catching member 51 is rotatable about the rotational center 51*a*, and is kept under the pressure applied in the counterclockwise direction by a spring 52. A reference character 53 designates a stopper for positioning the container catching member 51.

The container catching member 51 and slidable base 60 make up a toner supply container moving means. Further, the container catching member 51, slidable base 60, and engagement member 6 make up the toner supply outlet opening-closing means.

The container catching member 51 is provided with an engagement portion 51*c* that engages with the engagement portion 301*c* of the container housing 301A. As the engagement portion 301*c* advances in the direction of the arrow mask C in FIG. 4 during the insertion of the toner supply container 301 into the apparatus main assembly 100, the container catching member 51 rotates in the direction indicated by an arrow mark D against the elastic force of the spring 52. As the engagement portion 301*c* advances further in contact with the engagement portion 51*c*, the container catching member 51 rotates backward due to the presence of the elastic force of the spring 52, and latches on the engagement portion 301*c*. This latching of the container catching member 51 on the engagement portion 301*c* makes it possible to move the toner supply container 301 in its inserting or removing direction (direction indicated by the arrow mark A or B, respectively, in FIG. 4) by sliding the slidable base 60.

Designated by a reference character 54 is a slidable shaft, which is slidable supported by a supporting means (unillustrated), being enabled to slide in its longitudinal direction. The slidable shaft 54 is kept under the pressure applied to the slidable shaft 54 by a pressure generating member (unillustrated) in the direction of the arrow mark A (downward in FIG. 4), that is, the direction to move the slidable shaft 54 away from he supporting base 57, being held (positioned) by a shaft topper 55.

A reference character 56 designates a locking member attached to the slidable shaft 54. The locking member 56 is a member which locks the container catching member 51 by engaging with the rib-like projection 51*e* of the container catching member 51 as the slidable shaft 54 is slid toward supporting base 57 as indicated by the arrow mark B. The directions indicated by the arrow marks A and B are the directions in which the toner supply container 301 is pulled out of, or inserted into, the apparatus main assembly 100, respectively.

The slidable base 60 is provided with a projection 60*a*, which is fitted in the elongated hole 61*b* made in the end portion of a pivotal arm 61 which pivots about a pivot shaft 61*a*. The pivotal arm 61 is kept under the elastic force applied to the pivotal arm 61 by a pressure generating member 62 in the clockwise direction. The position of the pivotal arm is controlled by the stopper 64. The pivotal arm 61 is also provided with a groove 61*d* with an open end, which is on the side opposite to the elongated hole 61*b*.

As for the exchange cover 15, it is provided with a projection 15*b*, which fits into the groove 61*d* as the exchange cover 15 is closed. Thus, the closing movement of the exchange cover 15 causes the projection 15 to advance through the groove 61*d*, and the advancement of the projection 15*b* through the groove 61*d* causes the pivotal arm 61 to pivot in the counterclockwise direction against the elastic force of the pressure generating member 62.

The exchange cover 15 is also provided with a wall portion 15*a*, which comes into contact with a longitudinal end 54*a* of the slidable shaft 54, and causes the slidable shaft 54 to slide in the direction of the arrow mark B as the exchange cover 15 is closed. As the slidable shaft 54 is slid in the direction of the arrow mark B, the longitudinal end 54*b*, i.e., the end opposite to the longitudinal end 54*a*, comes into contact with the projection 57*b*, and causes the supporting base 57 and engagement member 6 to rotate against the elastic force of the pressure generating member 58. As a result, the engagement member 6 latches on the engagement portion 303*e* of the sealing member 303.

As the toner supply container 301 is inserted into the apparatus main assembly 100 with the use of the above described structure, the engagement portion 301*c* , with which the container housing 301A is provided, enters the apparatus main assembly 100 in the direction of the arrow mark C in FIG. 4. Then, the engagement portion 301*c* is caught by the engagement portion 51*c* of the container catching member 51, and the toner supply container 301 is inserted further into the apparatus main assembly 100, with the engagement portion 301*c* caught by the engagement portion 51*c* of the container catching portion 51. In other words, the position of the toner supply container 501 relative to the apparatus main assembly 100 is fixed by the engagement portion 301*c*.

Next, as the exchange cover 15 is closed after the instillation of a fresh toner supply container 301, the wall portion 15*a* of the exchange cover 15 comes into contact with the longitudinal end 54*a* of the slidable shaft 54, causing the slidable shaft 54 to slide in the direction of the arrow B. As a result, the other longitudinal end 54*b* of the slidable shaft 54 comes into contact with the projection 57*b* of the supporting base 57, and causes the supporting base 57 and engagement portion 6 to rotate against the elastic force of the pressure generating member 58 until the engagement member 6 latches on the engagement projection 303*e* of the sealing member 303.

Meanwhile, as the slidable shaft 54 is slid, the locking member 56 of the slidable shaft 54 moves to the container catching member 51, and engages with the rib-like projection 51*e*. As a result, the container catching member 51 is locked in place.

Then, as the exchange cover 15 closes to the predetermined position, the projection 15*b* of the exchange cover 15 enters the groove portion 61*d* of the pivotal arm 61, and causes the pivotal arm 61 to pivot in the counterclockwise direction against the elastic force of the pressure generating member 62. This pivoting of the pivotal arm 61 causes the slidable base 60 to slide in the direction of the arrow mark A. With this sliding of the slidable base 60, the toner supply container 301, the engagement portion 301*c* of which has been caught by the container catching member 51, moves in the same direction as the slidable base 60.

During the movement of the toner supply container 301 in the direction of the arrow mark A, the sealing member 303 remains locked in place by the engagement portion 6, being thereby prevented from moving in the direction of the arrow mark A. Therefore, the toner supply output 301*a* is separated from the sealing member 303. As a result, the toner supply outlet opening 301*g* is opened as shown in FIG. 5. At the moment of opening the toner supply outlet opening 301*g*, the toner supply outlet 301*a* is held in the holder 5 (FIG. 8) on the apparatus main assembly 100 side, by the sealing member 7 (O ring) which tightly fits between the peripheral surface of the toner supply outlet 301*a* and the inward surface of the holder 5. In other words, as the toner supply container 301 is installed into the apparatus main assembly 100, the position of the toner supply container 301 relative to the apparatus main assembly 100 is fixed by the aforementioned engagement portion 301*c* and the toner supply outlet 301*a*. As is evident from the above description, in this embodiment, the sealing member 303 is made to remain separated from the toner supply outlet opening 301*g*, and the distance by which the sealing member 303 remains separated from the opening 301*g* is determined depending on the degree of ease with which the toner tends to aggregate so that the sealing member does not interfere with the discharging of the toner from the container housing 301A. Therefore, the clogging of the toner discharge path adjacent to the toner discharge opening (opening 301*g*), or various problems related to the clogging, do not occur.

On the other hand, as the user opens the exchange cover 15 after the virtually complete consumption of the toner in the toner supply container 301, the projection 15*b* of the exchange cover 15, which was in the state depicted in FIG. 5, comes into contact with the wall portion 61*c* of the pivotal arm 61, and causes the pivotal arm 61 to pivot in the clockwise direction. As a result, the slidable base 60 slides in the direction of the arrow mark B, and the toner supply container 301 moves in the same direction as the slidable base 60.

During the above described sequence, the container catching member 51 is subjected to the force applied by the engagement portion 301*c* of the toner supply container 301 in the clockwise direction. However, the locking member 56 remains locked on the catching member 51 from the correct side to prevent the container catching member 51 from rotating in the clockwise direction. Therefore, the engagement portion 301*c* does not become discharged from the container catching member 51. Thus, the toner supply container 301 moves until the toner supply output opening 301*g* comes into contact with the mandible-like portion 303*f* of the sealing member 303. As a result, the toner supply outlet opening 301*g* is closed.

Then, as the exchange cover 15 is opened wider, the slidable shaft 54 moves to the predetermined position set by the positioning of the shaft stopper 55, because the slidable shaft 54 is kept under the pressure applied by the pressure generating means in the direction of the arrow mark A as described above. As the slidable shaft moves to the predetermined position, the engagement member 6 rotates clockwise, and separates from the sealing member 303; in other words, the scaling means 303 is release from the engagement member 6. Also, the container catching member 51 is released from the locking member 56.

At this point, the toner supply container 301 can be taken out of the apparatus main assembly 100. In other words, the user can take the toner supply container 301 out of the apparatus main assembly 100 by pulling the toner supply container 301 in the direction of the arrow mark A. The engagement between the container catching member 51 and engagement portion 301*c* is broken as force is applied to the toner supply container 301 in the direction of the arrow mark A to pull the toner supply container 301 out of the apparatus main assembly 100.

As described above, as the toner supply container 301 is installed into the apparatus main assembly 100, the engagement projection 303*e* of the sealing member 303 is caught by the engagement member 6, so that the sealing member 303 is held separated from the toner supply outlet opening 301*g* of the toner supply container 301. In this state, that is, the state in which the sealing member 303 is held separated from the opening 301*g*, the engagement between the conveying member 302 and sealing member 303 in terms of their rotational direction remains unchanged.

Therefore, the conveying member 302 can be rotated by the rotational driving force that the sealing member received from the apparatus main assembly 100, and as it is rotated, it gradually supplies the toner into the apparatus main assembly 100 through the toner supply outlet opening 301*g*. In this embodiment, a toner hopper portion is provided with a toner detection sensor 201*g*. As the absence of toner is detected by the toner detection sensor 301*g*, the sealing member 303 rotates, and as the presence of the toner is detected, the sealing member 303 stops rotating. In other words, the sealing member 303 intermittently rotates in response to the toner consumption in the apparatus main assembly 100. Therefore, toner is intermittently and gradually supplied into the apparatus main assembly 100. However, it is possible to supply the entire amount of the toner in the toner supply container 301 into the apparatus main assembly 100 all at once immediately after the installation of the toner supply container 301 into the apparatus main assembly 100.

When the toner supply outlet 301*a* is unsealed by the aforementioned means for opening or closing the toner supply outlet, a reactional force applies to the toner supply outlet 301*a* and engagement portion 301*c* of the container housing 301A. However, the engagement portion 301*c* is located on the outward surface of he bottom wall 301D, and its location on the outward surface of the bottom wall 301D is on the side opposite, in terms of the longitudinal direction of the bottom wall 301D, to the side where the toner supply outlet 301*a* is located. Therefore, the container housing 301A is prevented from being lifted from the apparatus main assembly 100. In addition, even if the container housing 301A is lifted, the top wall 301E comes into contact with the ceiling portion 100*d* (FIG. 17) of the apparatus main assembly 100, controlling the container housing 301A so that the container housing 301A does not move upward more than a predetermined distance.

Figure 17:
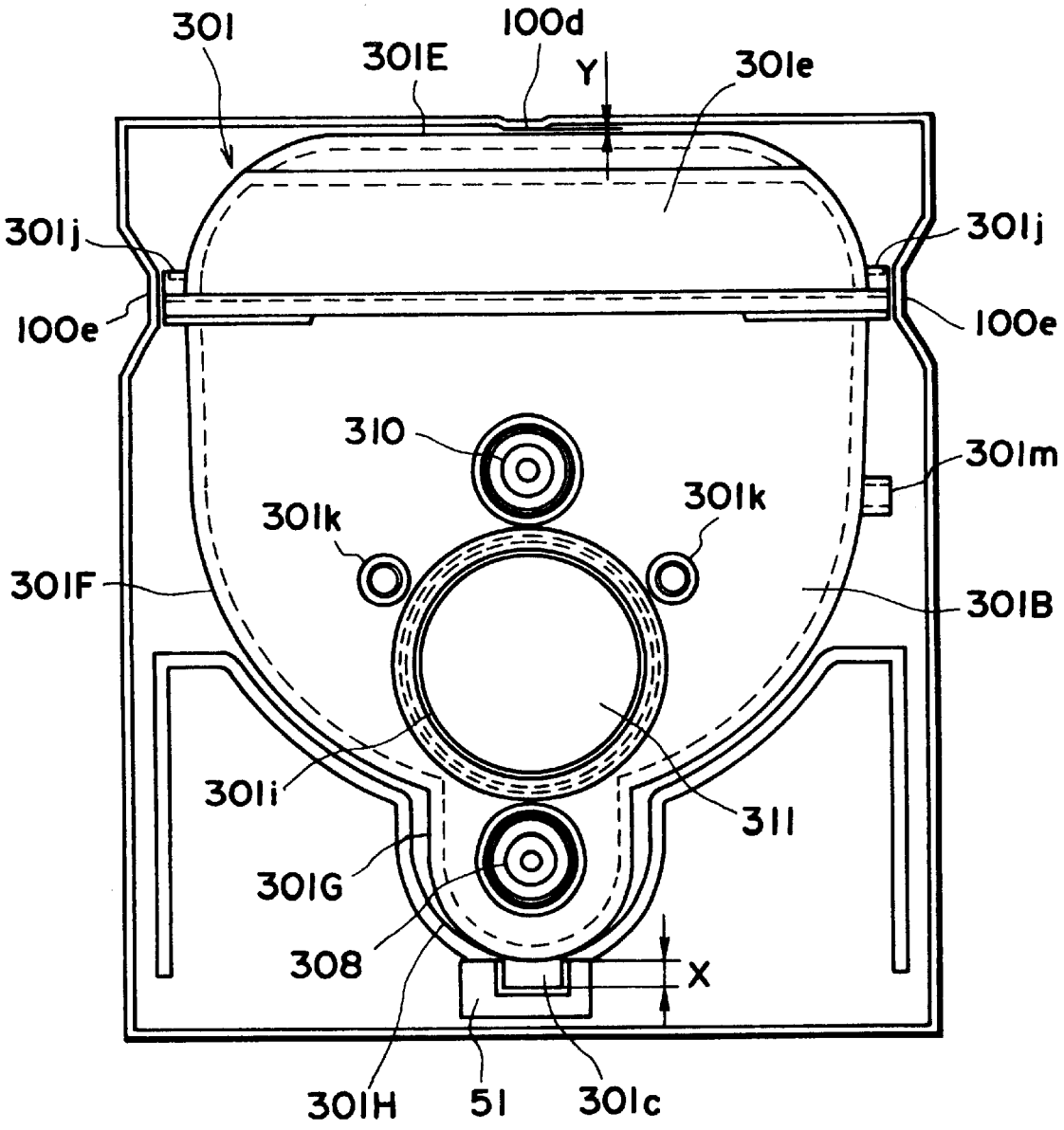
FIG. 17 is an illustration of a toner supply container which is mounted to the main assembly of the apparatus.

Referring to FIG. 17, the engagement portion 301*c* and toner supply outlet opening 301*g* of the toner supply container 301 are desired to be positioned so that they align perpendicularly to the sliding direction of the toner supply container 301. Such positioning of the engagement portion 301*c* and toner supply outlet opening 301*g* can present the generation of a leftward or rightward moment in the toner supply container 301. Also, even if leftward or rightward moment generated in the toner supply container 301, the ribs 301*j* as the horizontal movement regulating portions, provided on the side walls 301A1 and 301B, come into contact with the side walls 100*e* of the apparatus main assembly 100, to prevent the container housing 301A from moving sideways more than a predetermined distance.

In order to prevent the engagement portion 301*c* from becoming disengaged upward from the container catching member 51 during the sliding movement of the toner supply container 301, the height of the engagement portion 301*c* of the toner supply container 301 is set so that the margin of engagement X (FIG. 17) between the engagement portion 301*c* and container catching member 51 becomes greater than the character Y (FIG. 17) between the top wall 301E of the toner supply container 301 and the ceiling portion 100*d* of the apparatus main assembly 100.

Referring to FIG. 17, in order to prevent the toner supply container 301 from rattling sideways, the left and right ribs 301*j* are desired to be positioned on the top portion of the toner supply container 301. In this embodiment, they are positioned higher than the center portion in terms of the vertical direction of the toner supply container 301, with the provision of a proper amount of clearance between the toner supply container 301 and the corresponding side wall portions 100*e* of the apparatus main assembly 100.

[Description of Driving Mechanism for Toner Supply Container]

Next, the driving mechanism for the toner supply container 301 in this embodiment will be described.

Referring to FIG. 8, during the installation of the toner supply container 301, the coupling engagement portion 303*c* of the sealing member 303 engages with the first coupling 304 on the apparatus main assembly 100 side. This first coupling 304 is a member for transmitting to the sealing member 303, the driving force of a driving apparatus (unillustrated) provided on the apparatus main assembly 100 side.

Figure 18:
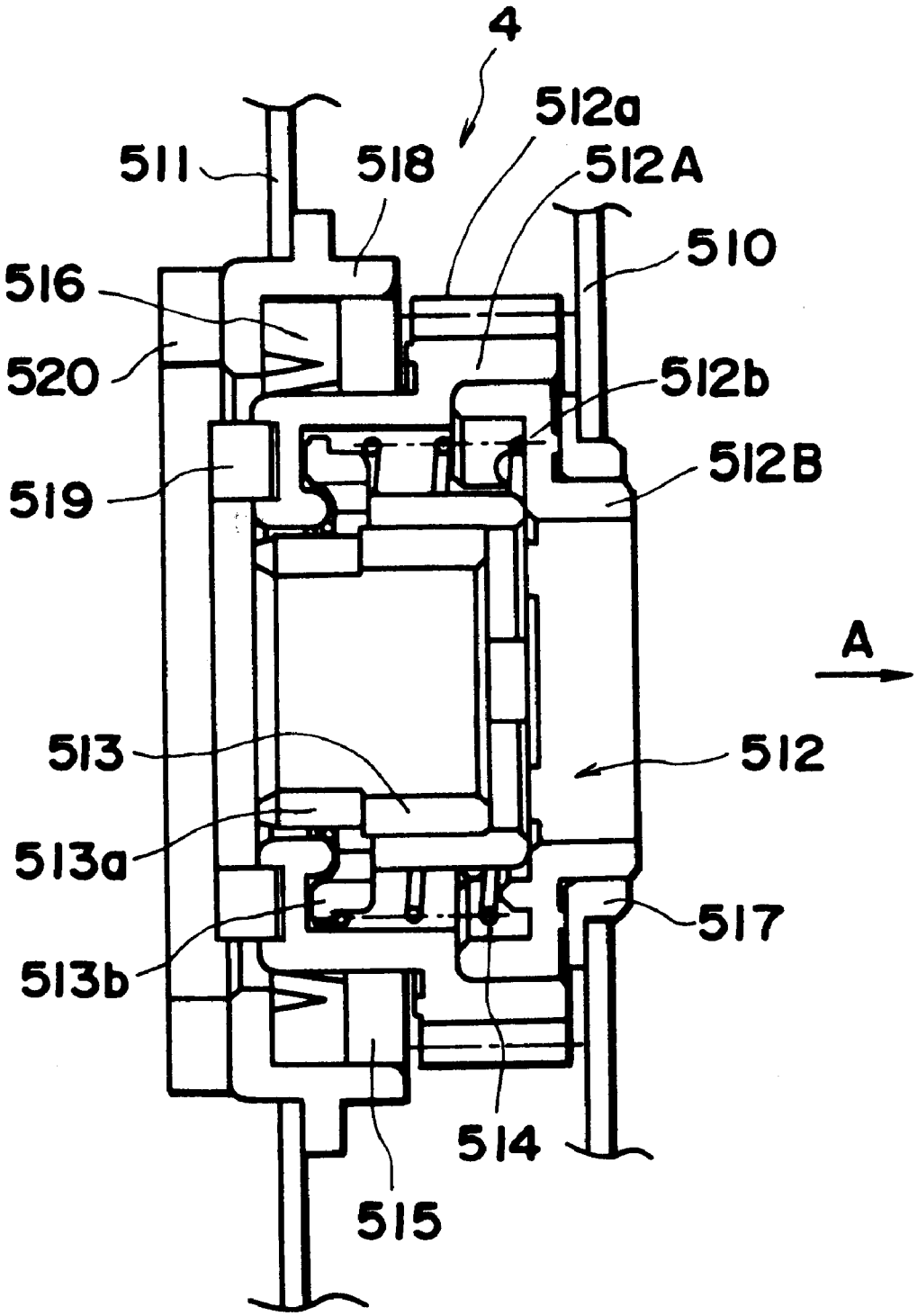
FIG. 18 is a detailed illustration of a first coupling member.

FIG. 18 is a drawing that shows detailed configuration of the first coupling 304.

In FIG. 18, a reference character 512 designates a compound gear, the teeth of which are cut in the peripheral surface 512*a* of the gear. The compound gear 512 comprises two portions: a tooth portion 512A and a cover portion 512B. The two portions are fixed to each other by snap fitting or pasting. The compound gear 512 comprises a pressure generating means 514 and a mobile member 513, which are within the compound gear 512. The pressure generating means 514 is in contact with the inward face 512*b* of the cover 512B and the inward face 513*b* of the mobile member 513.

Figure 19:
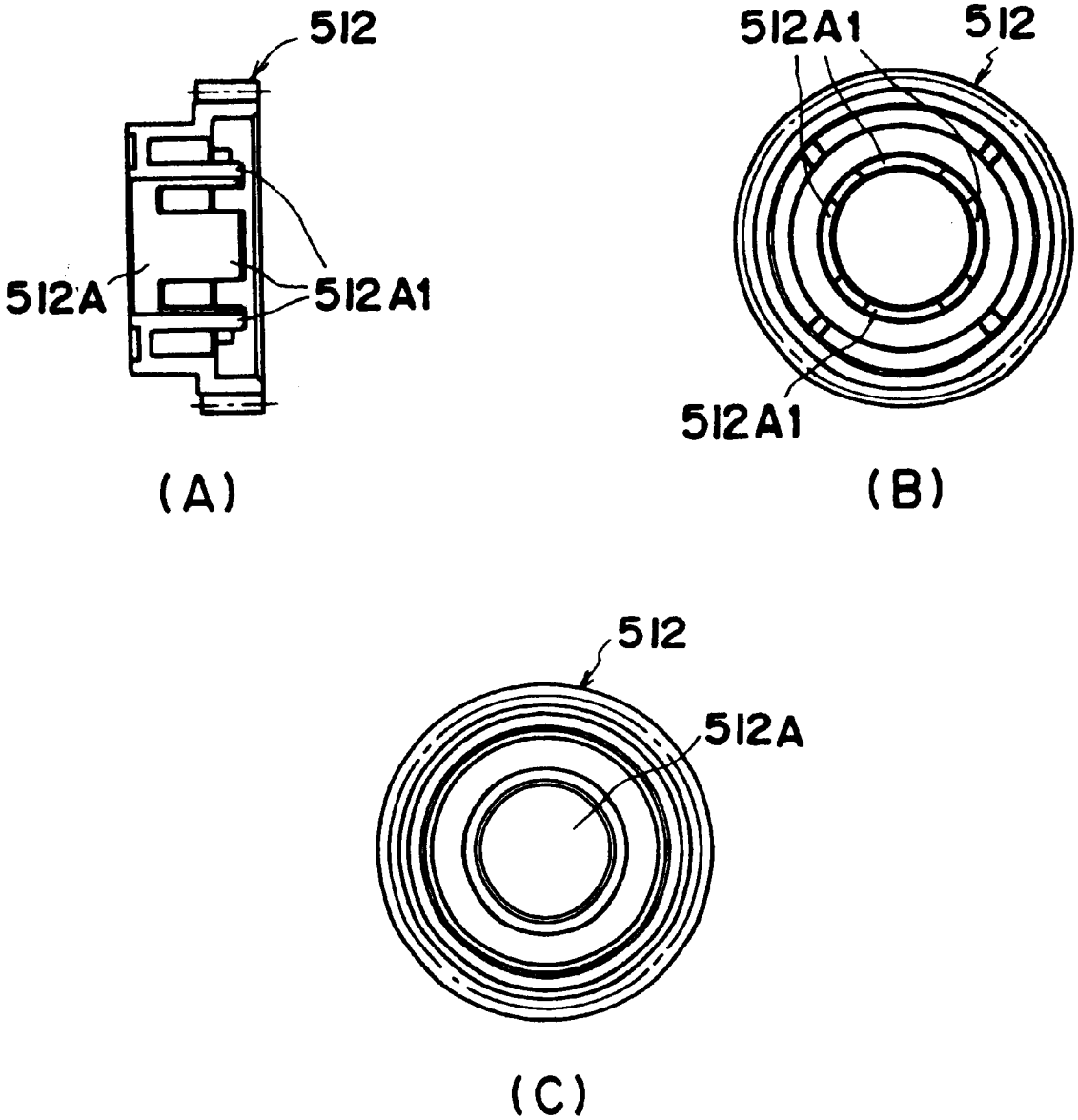
FIG. 19 a detailed view of a gear portion.
Figure 20:
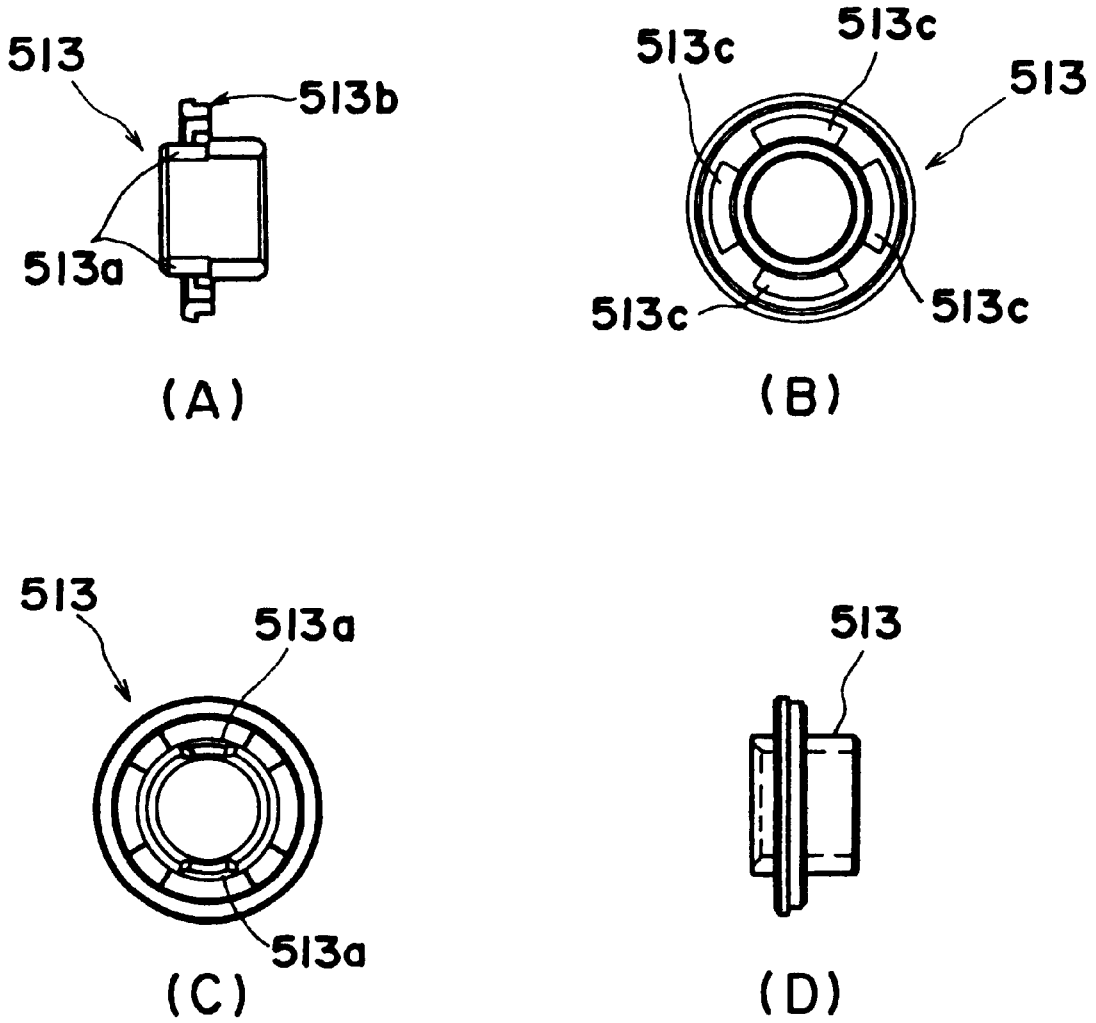
FIG. 20 is a detailed illustration of a movable member.

FIG. 19 is a detailed plan of the compound gear 512. FIG. 19, (A), is a sectional view of the gear portion as seen from the direction perpendicular to the axis of the gear portion; (B), is a right side view of the gear portion, with reference to (A) and (C), is a left side view of the gear portion, with reference to (A). FIG. 20 is a detailed plan vie of the mobile member 513. FIG. 20, (A), is a sectional view of the mobile member 513 as seen from the direction perpendicular to the axis of the mobile member 513; (B), is a right side view of the mobile member 513, with reference to (A); and (C), is a left side view of the mobile member 513, with reference to (A); (D), is an external view of the mobile member 513 as seen from the direction perpendicular to the axis of the mobile member.

Referring to FIG. 19, the gear portion 512A is provided with four slide guiding ribs 512A1, which are evenly distributed on the inward side. Referring to FIG. 20, the mobile member 513 is provided with four slide guiding rib holes 513*c*, which are evenly distributed in the circumferential direction, and into which the slide guiding ribs 512A of the gear portion 512A fit one for one so that the mobile member 513 is allowed to slide within the compound gear 512.

The mobile member 513 comprises a driving force transmitting portion in the form of a groove, which is designated by a reference character 513*a*. The driving force transmitting portion 513*e* engages with the spline 303*d* of the sealing member 303 to transmit a rotational driving force to the sealing member 303 when the toner supply container 301 is in the apparatus main assembly 100.

Referring to FIG. 18, designated by reference characters 517 and 515 are bearings for rotationally supporting the compound gear 512. Designated by a reference character 516 is an oil seal, which prevents toner from invading the bearings 515 and 517 and locking the compound gear 512 after being discharged through toner supply outlet opening 301*g*. A reference character 519 designates a gear shield, which presses on the sealing member 303 to prevent toner from invading the interior of the compound gear 512 after being discharged from the toner supply outlet opening 301*g*, when the toner supply container 301 is in the apparatus main assembly 100. Reference characters 511 and 510 designate side plates on the driving side of the toner supply container 301, for supporting the first coupling 304. A reference character 518 designates a bearing holder, which is fixed to the side plate 511 with the use of small screws, adhesive, or the like, and holds the bearing 515 and oil seal 516. A reference character 520 designates a holder seal, which prevents toner from leaking from between the holder 5 illustrated in FIG. 8, and bearing holder 518.

The gear seal 519 and holder seal 520 are fixed to the compound gear 512 and bearing holder 518, respectively, with the use of double-sided adhesive tape or the like. Their material is such material as foamed urethane, which is elastic.

Next, the operation of the first coupling 304 will be described. The mobile member 513 of the first coupling 304 is retractable by the above described structure in the direction A in FIG. 18. When not in action, it is at the position given in FIG. 18, being kept under the pressure applied by a pressure generating means 514. As the toner supply container 301 is inserted into the apparatus main assembly 100, the sealing member 303 advances into the coupling 304 as shown in FIG. 9. During this advancement, if the projection 303*d* of the sealing member 303 is in alignment with the driving force transmitting portion 513*a* of the mobile member 513, the compound gear 512 and mobile member 513 are rotated by an unillustrated driving apparatus on the apparatus main assembly 100 side, and therefore, the sealing member 303 is rotated through the driving force transmitting portion 513*a*. However, if the projection 303*d* of the sealing member 303 is not in alignment with the driving force transmitting portion 513*a* of the mobile member 513, the mobile member 513 is pressed by the projection 303*d* of the sealing member 303 in the direction A in FIG. 18. Then, as the compound gear 512 and mobile member 513 are rotated by the driving apparatus on the apparatus main assembly 100 side, and the mobile member 513 slips against the sealing member 303 until the projection 303*d* of the sealing member 303 and the driving force transmitting portion 513*a* of the mobile member 513 synchronize in rotational phase. Then, as they synchronize in rotational phase, the mobile member 513 is caused to slide by the pressure generating member 514 until the driving force transmitting portion 513*a* of the mobile member 513 engages with the spline 303*d* of the sealing member 303 in the state illustrated in FIG. 18, and the driving force is transmitted to the sealing member 303.

Figure 21:
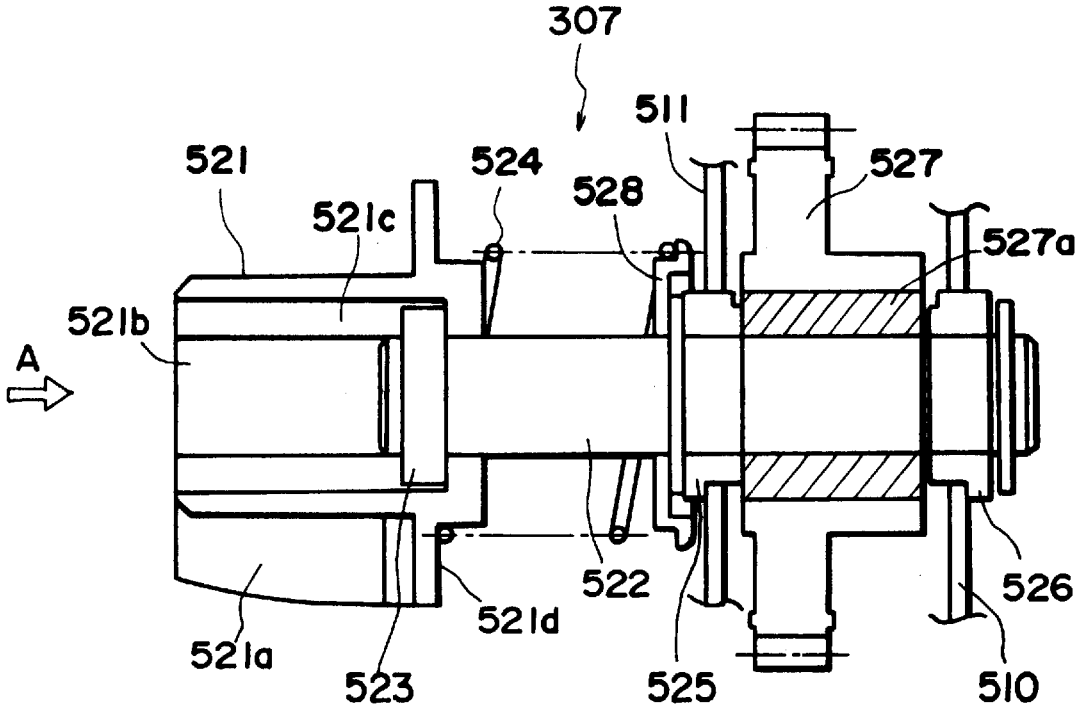
FIG. 21 is a detailed illustration of a second coupling member.
Figure 22:
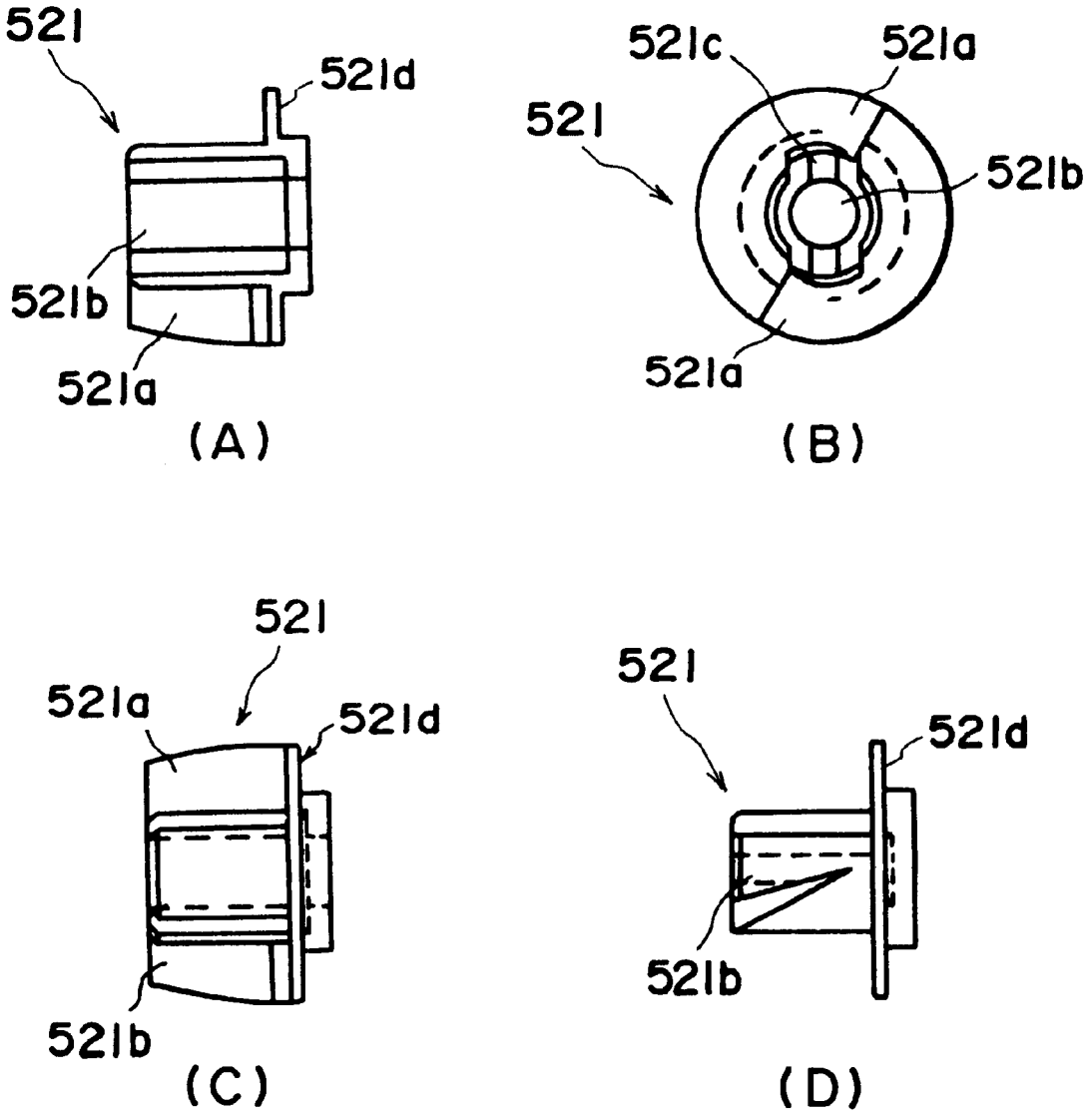
FIG. 22, (A) is a sectional front view of a drive transmission claw, (B) is a side view thereof, (C) is a front view thereof, and (D) is a top plan view thereof.
Figure 23:
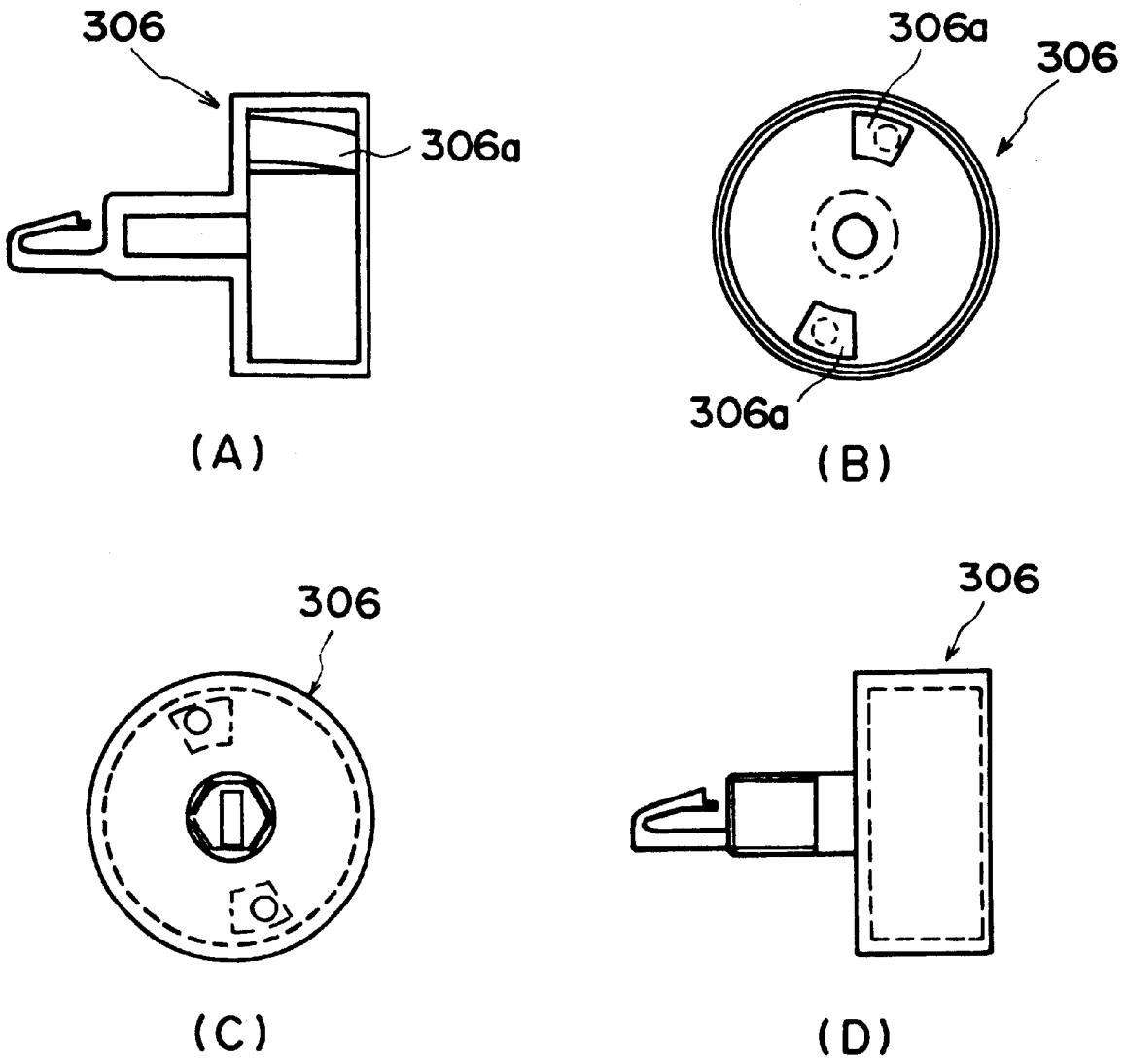
FIG. 23, (A) is a sectional front view of a transmission member, (B) is a right side view thereof, (C) is a left side view thereof, (D) is a front view thereof.

FIG. 21 shows in detail the configuration of the second coupling 307. Designated in FIG. 21 by a reference character 521 is a pawl-type, driving force transmitting portion. FIG. 22 shows in detail the configuration of the pawl-type, driving force transmitting portion 521. FIG. 22, (A), is a sectional view of the pawl-type, driving force transmitting portion as seen from the direction perpendicular to the axis of the pawl type driving force transmitting portion; (B), is a left side view of the pawl-type, driving force transmitting portion, with reference to (A); (C), is an external view of the pawl-type, driving force transmitting portion as seen from the direction perpendicular to the axis of the pawl-type, driving force transmitting portion; and (D), is a top view of the pawl-type, driving force transmitting portion. In FIG. 22, reference characters 521*a* designates a pawl portion; 521*b* denotes a slide guiding portion; 512*c* denotes parallel pin grooves; and reference character 521*d* designates a spring seat. FIG. 23 is a detailed view of a driving force transmitting member 306 illustrated in FIG. 7. FIG. 23, (A), is a sectional view of the driving-force transmitting member 306 as seen from the direction perpendicular to the axis of the driving force transmitting member 306; (B), is a right side view of the driving-force transmitting member 306, with reference to (A); and (C), is a left side view of the driving-force transmitting member 306, with reference to (A); (D) is an external view of the driving-force transmitting member 306 as seen from the direction perpendicular to the axis of the driving force transmitting member 306. Designated in FIG. 23 by a reference character 306*a* is a pawl.

In FIG. 21, designated by a reference characters 522 is a drive shaft, which is rotationally supported by side plates 510 and 511 on the driven side, with the use of bearings 525 and 526. The drive shaft 522 is provided with a one-way gear 527, which integrally comprises a one-way clutch 527*a* (member that transmits torque only in a designated direction), which is positioned to make contact with the drive shaft 522.

The engagement between the slide guiding portion 521*b* and drive shaft 522 makes the pawl type driving-force transmitting portion 521 slidable. As the parallel pins 523 of the drive shaft 522 fit in the parallel pin grooves 521*c* of the pawl type diving force transmitting portion 521, the rotation of the drive shaft 522 is transmitted to the pawl-type, driving force transmitting portion 521. Designated by a reference character 524 is a pressure generating means, which is disposed in contact with the spring sat 528 of the bearing 525 and the spring seat 521*d* of the pawl-type, driving-force transmitting portion 521.

Next, the operation of the second coupling 307 will be described. With the provision of the above described structural arrangement, the pawl-type, driving-force transmitting portion 521 of the second coupling 307 is movable in the direction A in FIG. 21, and normally, it is at a position given in FIG. 21, being kept under the pressure applied by the pressure generating means 524. As the toner supply container 301 is inserted into the apparatus main assembly 100, the driving-force transmitting member 306 advances toward the second coupling 307, and engages therewith (FIG. 9). During this advancement of the driving-force transmitting member 36, if the pawl 306*a* of the driving-force transmitting member 306 and the pawl 521*a* of the pawl-type, driving force transmitting portion 521 are in alignment with each other, the pawl 521*a* of the pawl-type, driving force transmitting portion 521 is rotated by the pawl 306*a* of the driving-force transmitting member 306. Thus, as the driving-force transmitting member 306 rotates, the drive shaft 522 also rotates, but the clutch 527*a* of the one-way gear 527 slips, preventing the pawl-type, driving force transmitting portion 521 and driving-force transmitting member 306 from interfering with each other during the insertion of the toner supply container 301 into the apparatus main assembly 100.

Next, after the toner supply container 301 is moved by the toner supply outlet opening-closing means from the position given in FIG. 9 to the position give in FIG. 8, as the driving-force transmitting member 306 retracts leftward, the pawl-type, driving force transmitting portion 521 moves due to the pressure from the pressure generating means 524. Therefore, the pawl 306*a* of the driving-force transmitting member 306 remains engaged with the pawl 521*a* of the pawl-type, driving force transmitting portion 521.

Thus, the rotational driving force from the driving means on the apparatus main assembly 100 side is transmitted to the driving force transmitting member 306 by way of the one-way gear 527, drive shaft 522, and pawl-type, driving force transmitting portion 521, and consequently, the stirring member 305 rotates.

[Description of Toner Discharge]

Next, toner discharge will be described.

As described above, during the insertion of the toner supply container 301 into the apparatus main assembly 100, the engagement portion 303*e* (engagement projection) located at the front end, in terms of the inserting direction of the toner supply container 301, of the sealing member 303 is caught by the engagement portion 51*c* of the container catching member 51, and therefore, the sealing member 303 is held separated from the toner supply outlet opening 301*g* of the container housing 301A (FIG. 5). In this state, the engagement between the conveying member 302 and sealing member 303 in terms of their rotational direction remains unchanged.

The sealing member 303 engages with the first coupling 304 of the apparatus main assembly 100, by its engagement portion (driving force receiving portion) 303*c*. The first coupling 304 receives a driving force from the power source (unillustrated), such as a motor of the apparatus main assembly 100, through a driving-force transmitting means (unillustrated) such as gears. The received driving force is transmitted to the sealing member 303 by the engagement between the driving force transmitting member 513*a* of the first coupling 304 and the spline 303*d* of the sealing member 303. Then, the driving force is further transmitted to the conveying member 302 by the engagement of the square hole 303*a* (engagement hole) and the longitudinal end 302*a* of the conveying member 302. Similarly, the driving-force transmitting member 306 which engages with the longitudinal end 305*d* of the stirring member 305 engages with the second coupling 307 of the apparatus main assembly 100. The second coupling 307 of the apparatus main assembly 100 receives the rotational a driving force from a power source (unillustrated), such as a motor of the apparatus main assembly 100, through a driving-force transmitting means such as gears (unillustrated). The driving force is transmitted to the stirring member 305 by the engagement between the pawl 521*a* of the pawl-type, driving-force transmitting portion 521 and the pawl 306*a* of the driving-force transmitting member 306. The revolutions of the conveying member 302 and stirring member 305 are set at approximately 52 rpm and approximately 10 rpm, respectively.

The toner within the toner supply container 301 aggregates due to escape of air, which is caused by the variations which occur during the transportation of the toner supply container 301, or simply because the toner supply container 301 is in storage for a very long time. This aggregated toner is broken up by the rotation of the stirring member 305, and conveyed to the toner supply outlet 301*a* by the rotation of the conveying member 302. Then, the toner is discharged from the toner supply outlet opening 301*g* and falls downward to be supplied into the toner hopper 201*a* of the apparatus main assembly 100.

The toner supply container 301 structured as described above was tested for toner discharge performance. More specifically, the toner supply container 301A was filled with toner, and toner was discharged from the toner supply container 301, with the revolutions of the stirring member 305 and conveying member 302 set at approximately 10 rpm and 52 rpm, respectively. Then, the toner discharged from the toner supply container 301 was sifted with the use of a sieve (75 $\mu$m in mesh size: product of SUS) to confirm the generation of large toner particles. However, generation of large toner particles could not be confirmed. Further, the amount of the toner that remained in the toner supply container 301, that is, the amount of the toner in the toner supply container 301 which failed to be discharged was 20 g, which confirmed that the toner supply container 301 in this embodiment was effective to reduce the unusable amount of the toner in the toner supply container 301.

[Other Embodiments of Sealing Member]

Figure 24:
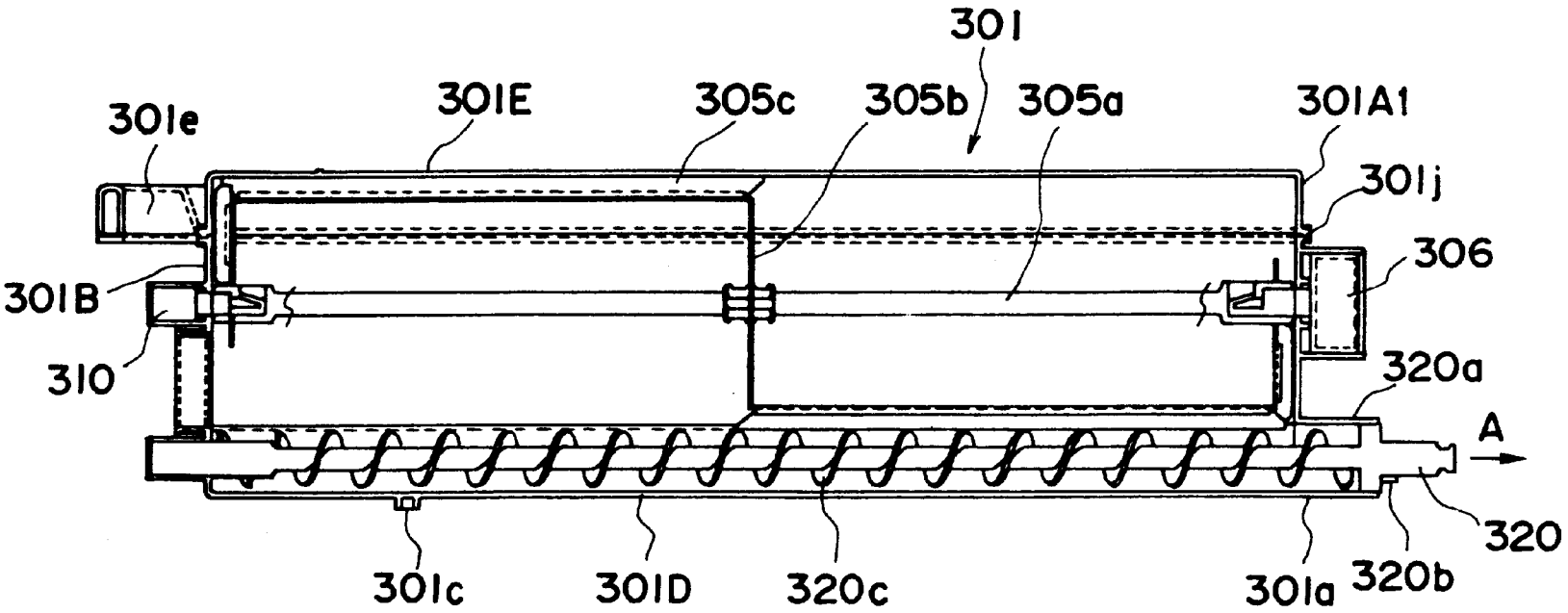
FIG. 24 is shown an example wherein a sealing member and a feeding member are integral.

In the preceding embodiment, the toner supply container 301 was structured so that the sealing member 303 was movable relative to the conveying member 302 in their axial direction. However, a sealing member may be formed as a part of a conveying member as shown in FIG. 24. In FIG. 24, a sealing member 320 has a sealing portion 302*a*, a driving-force receiving portion 320*b*, and a toner conveying portion 320*c*, and is movable relative to the container housing 301A in the direction A in FIG. 24.

Figure 25:
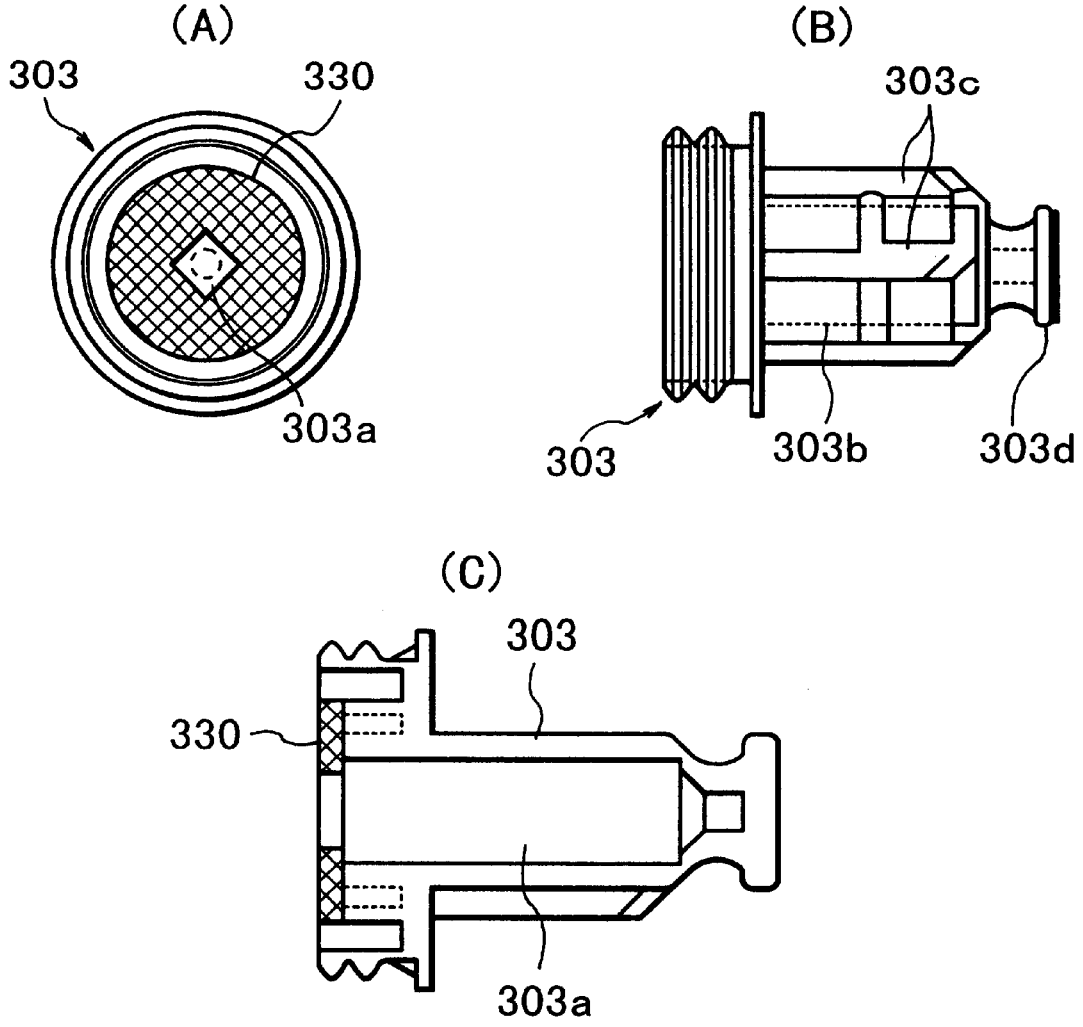
FIG. 25, (A) is a front view of a sealing member, (B) is a side view thereof, and (C) is a sectional side view thereof.

Further, the aforementioned driving portion 303*a* (driving force transmitting portion) of the sealing member 303 shown in FIG. 12 may be fitted with a sealing member independent from the sealing member 303. FIG. 25, (A), is a front view of a sealing member fitted with a sealing member independent from the sealing member 303; (B), is a side view of the sealing member illustrated in (B); and FIG. 25, (C) is a sectional view of the sealing member fitted with another sealing portion, as seen from the direction perpendicular to the axial line of the sealing member 303.

A reference character 330 designates a disc-like sealing member, which is provided with a rectangular hole 330*a*, the shape of which matches the shape of the shaft end portion 302*a* of the conveying member 302. In this embodiment, the cross section of the hole 330*a* is made square as the shaft end portion 302*a*. The sealing member 330 is attached to the sealing member 303, on the side which faces the container housing 301A, and the shaft end portion 302*a* of the conveying member 302 loosely fits through the hole 330*a*.

Figure 26:
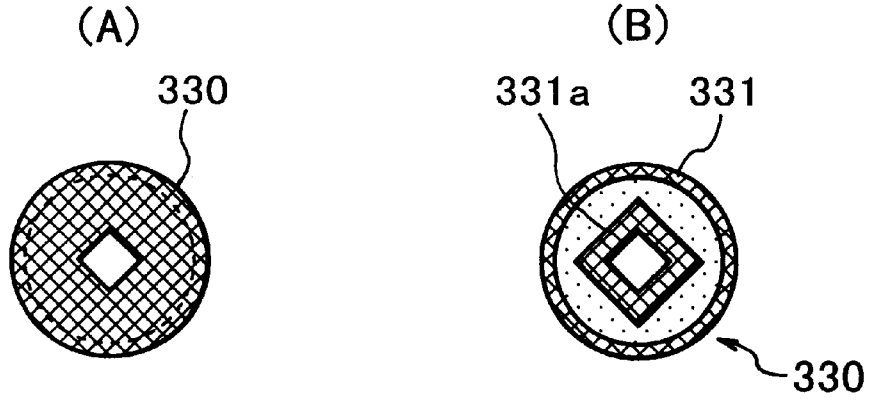
FIG. 26, (A) is a container body side front view of the seal member, and (B) is a sealing member side front view.

FIG. 26 is a plan of the sealing member 330 in this embodiment. A reference character 331 designates a piece of double-sided adhesive tape, which is adhered to the sealing member 330, on the side which faces the sealing member 303. The piece of double-sided adhesive tape 331 is provided with a hole 331*a*, which is shaped so that when the shaft end portion 302*a* is loosely put through the hole 330*a*, the shaft end portion 302*a* can be also loosely put through the hole 331*a*. Further, in order to prevent the piece of double-sided adhesive tape 331 from coming into contact with the shaft and portion 302*a*, the size of the opening of the hole 331*a* is made larger than that of the hole 330*a*.

In this embodiment, the seal 330 is fixed to the sealing member 303 with the use of the piece of double-sided adhesive tape 331. However, the seal 330 may be fixed to, or integrated with, the sealing member 303 with the use of other methods for example, two color injection molding, insert moulding, or the like.

Figure 27:
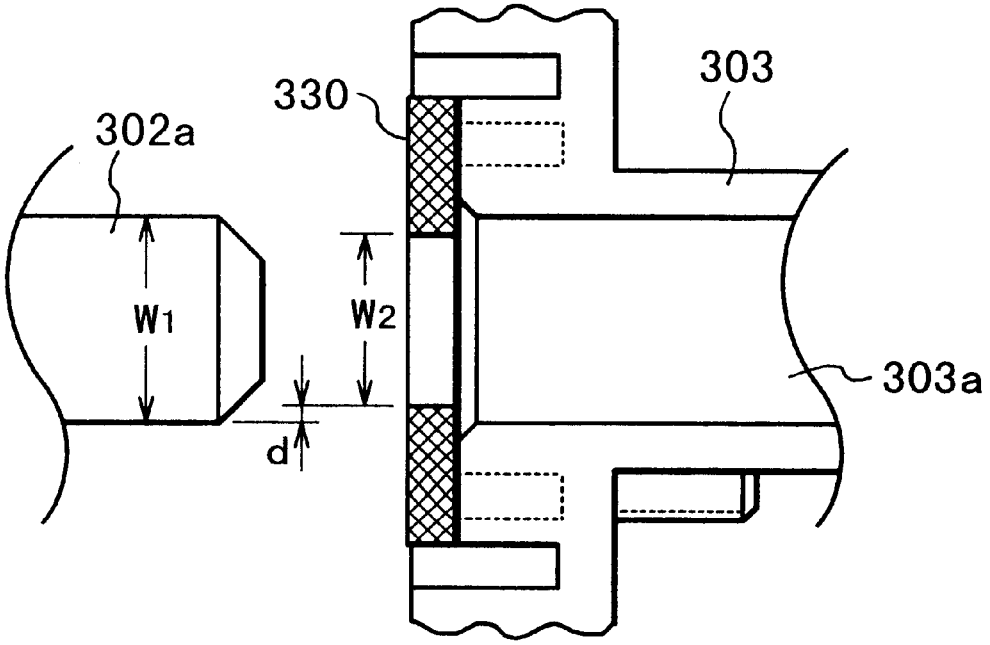
FIG. 27 is an enlarged side view of a feeding member and a sealing member.

FIG. 27 is an enlarged sectional view of the conveying member 302 and sealing member 303 in this embodiment, as seen from the direction perpendicular to their axial lines. The diameter (W2) of the hole 330*a* is made smaller than the external diameter (W1=6 mm) of the shaft end portion 302*a*. More specifically, the difference (d) between W1 and W2 is desired to be 0.5 mm–2 mm. In this embodiment, W2=5 mm, d=W1−W2=1 mm. The thickness of the seal 330 is desired to be 0.5 mm–5 mm in consideration of sealing performance and assembly efficiency. Preferably, it is desired to be 1 mm–3 mm. In this embodiment, it is approximately 2 mm. As for the material for the seal 330, it is desired to be soft and elastic, also in consideration of sealing performance and assembly efficiency. In this embodiment, foamed polyurethane with a low level of porosity, which is 20–70 degrees in hardness, no more than 4% in permanent compression distortion, no more than 0.8 in coefficient of friction. 60–300 $\mu$m in cell size, and 0.2–0.5 in specific weight, is used.

[Description of Refurbishing Process for Toner Supply Container]

Next, referring to FIGS. 23–34, a refurbishing process for a toner supply container will be described with reference to the toner supply container 301 described above.

Figure 28:
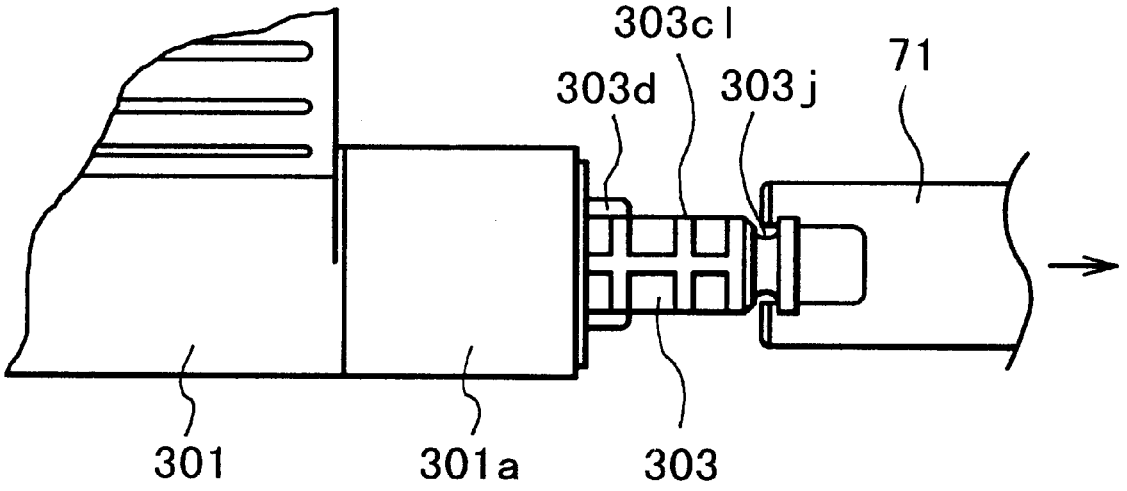
FIG. 28 is a side view illustrating a sealing member dismounting process (first step) of the recycling method for the toner supply container according to an embodiment.
Figure 29:
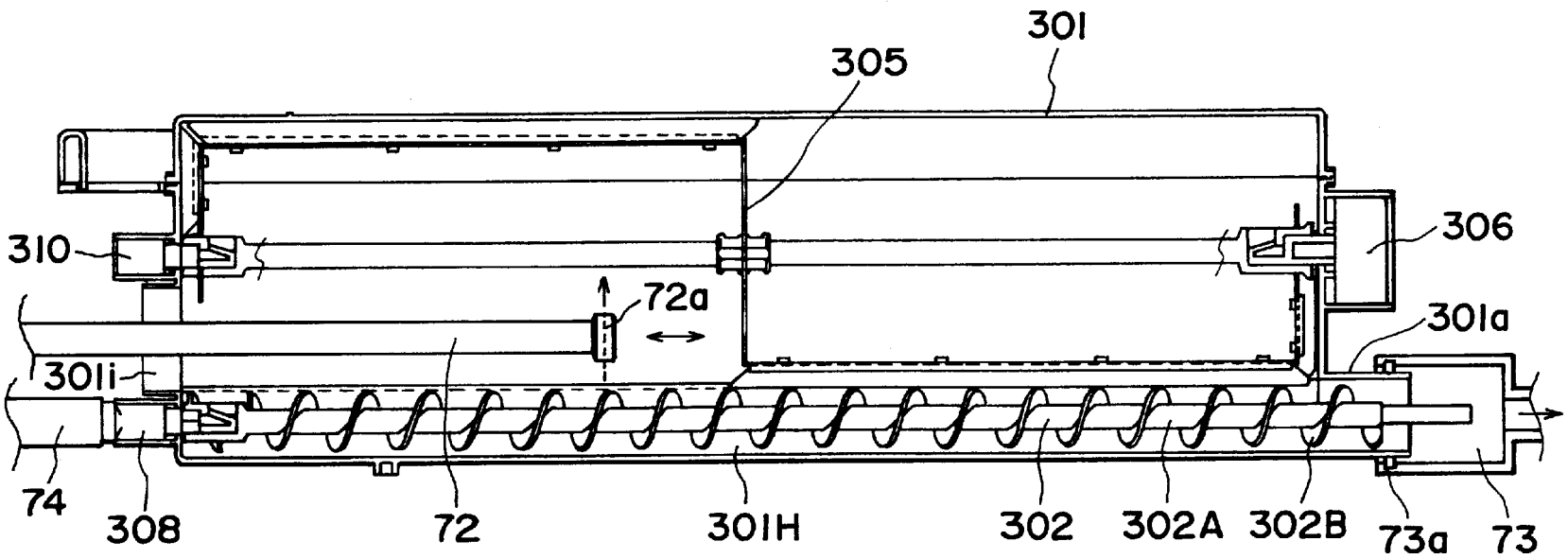
FIG. 29 is a sectional view illustrating a cleaning step (second step) of the recycling method for the toner supply container according to the embodiment of the present invention.
Figure 30:
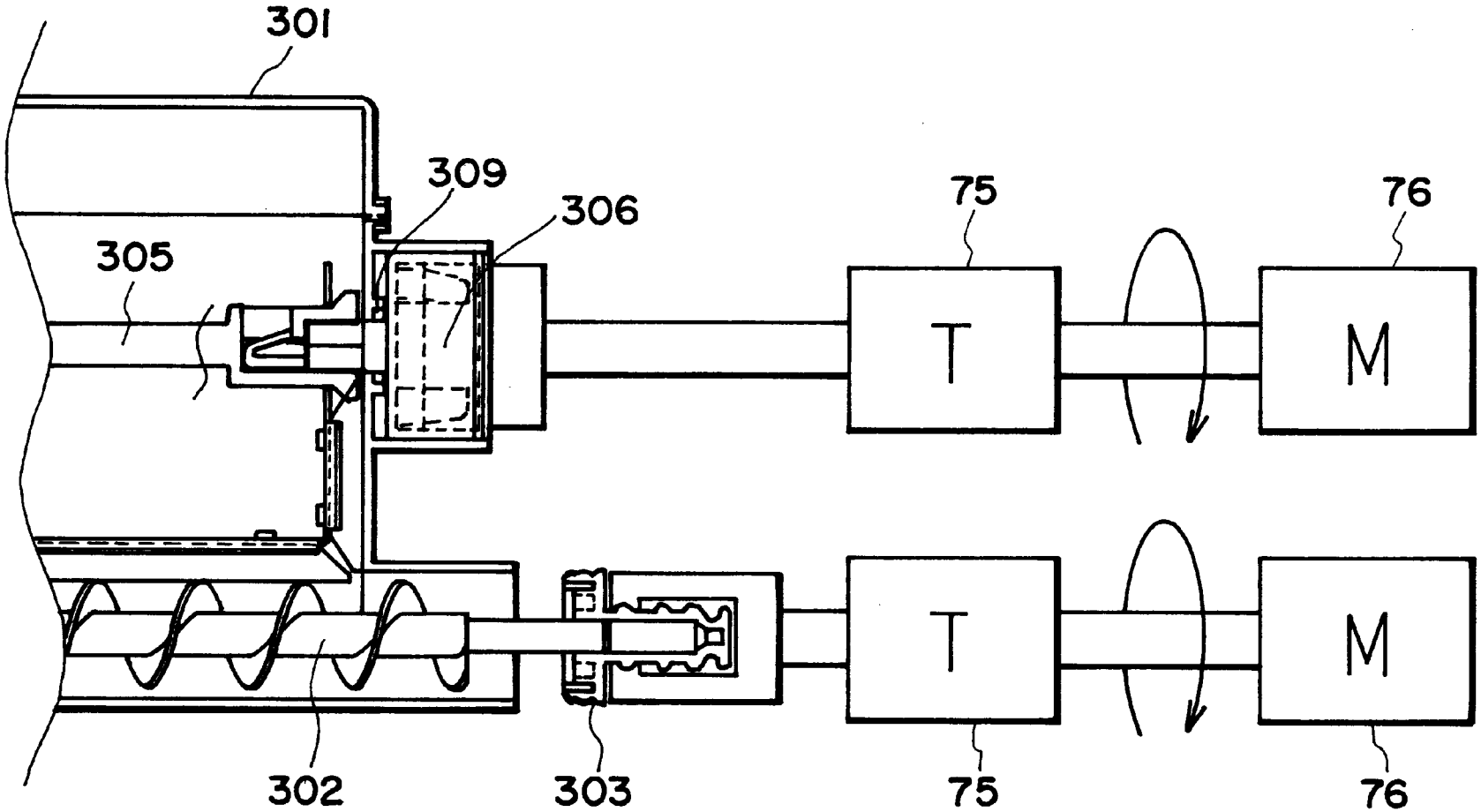
FIG. 30 is a sectional view showing a rotation torque checking step.
Figure 31:
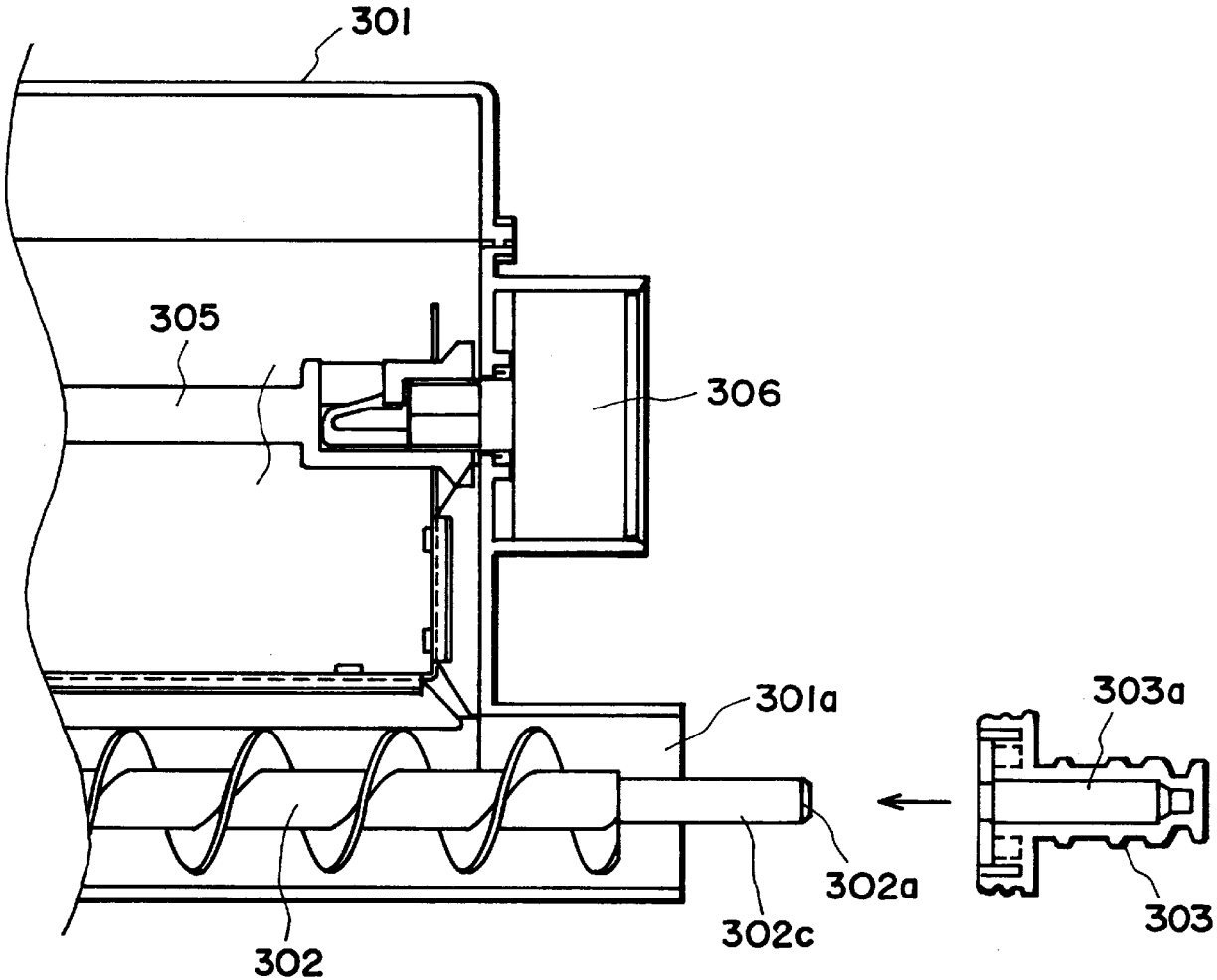
FIG. 31 is a side view showing a sealing member mounting step to a toner supply opening (second step) of the recycling method for the toner supply container according to the embodiment of the present invention.
Figure 32:
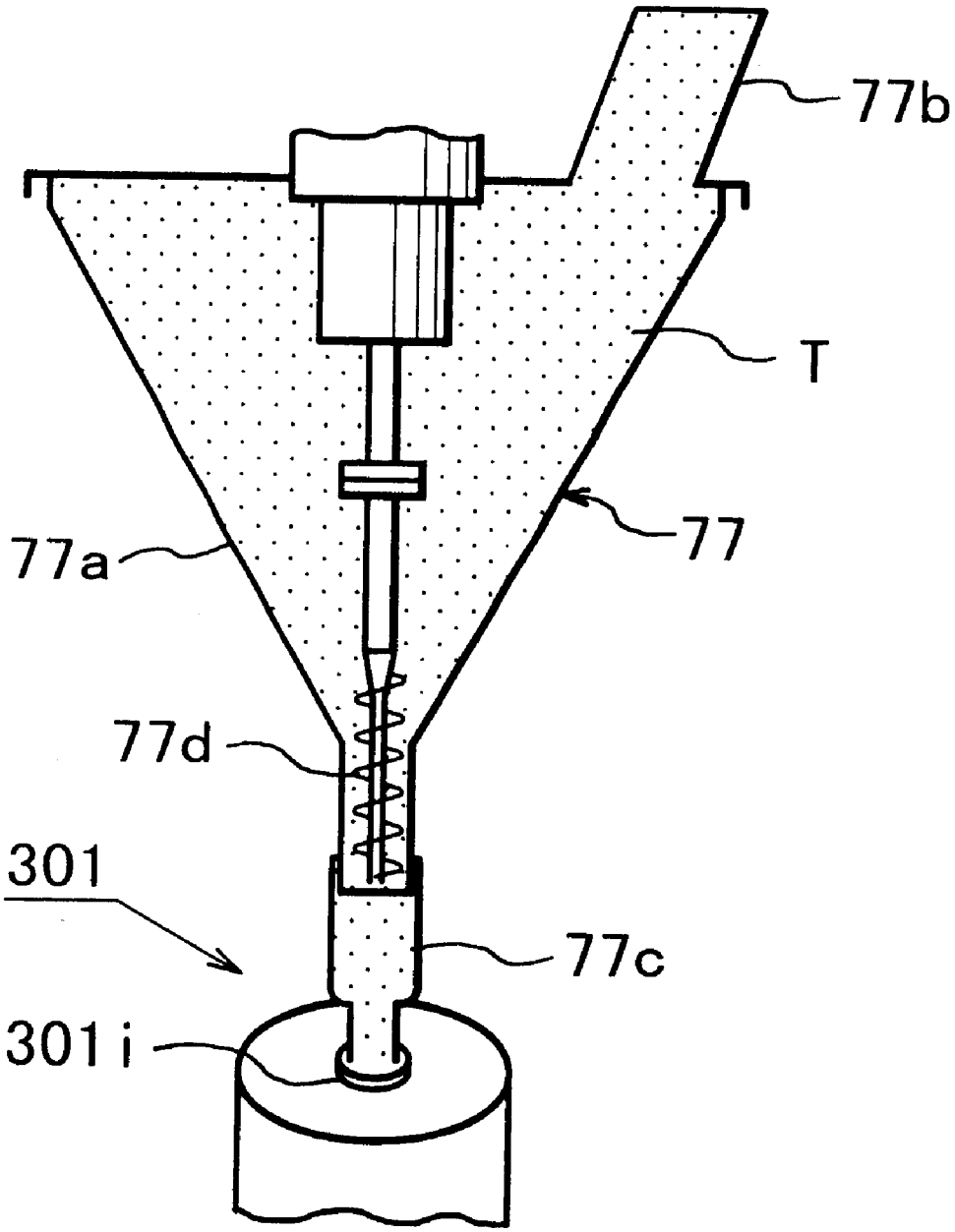
FIG. 32 is a perspective view showing a toner filling step (fourth step) of the recycling method for the toner supply container according to an embodiment of the present invention.
Figure 33:
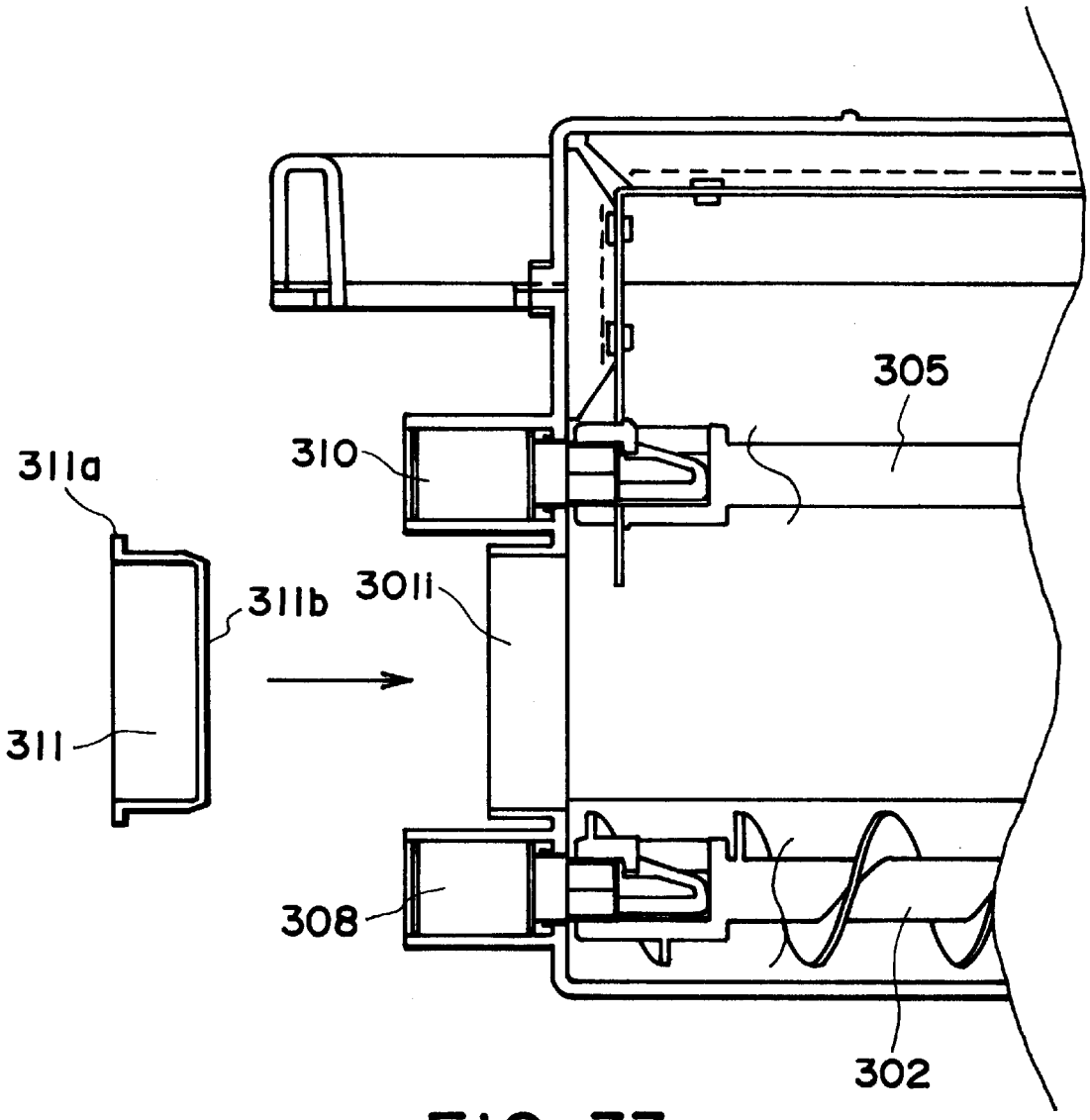
FIG. 33 is a side view showing a mounting step of a sealing member to a toner filling opening (fifth step) of the recycling method for the toner supply container according to the embodiment of the present invention.
Figure 34:
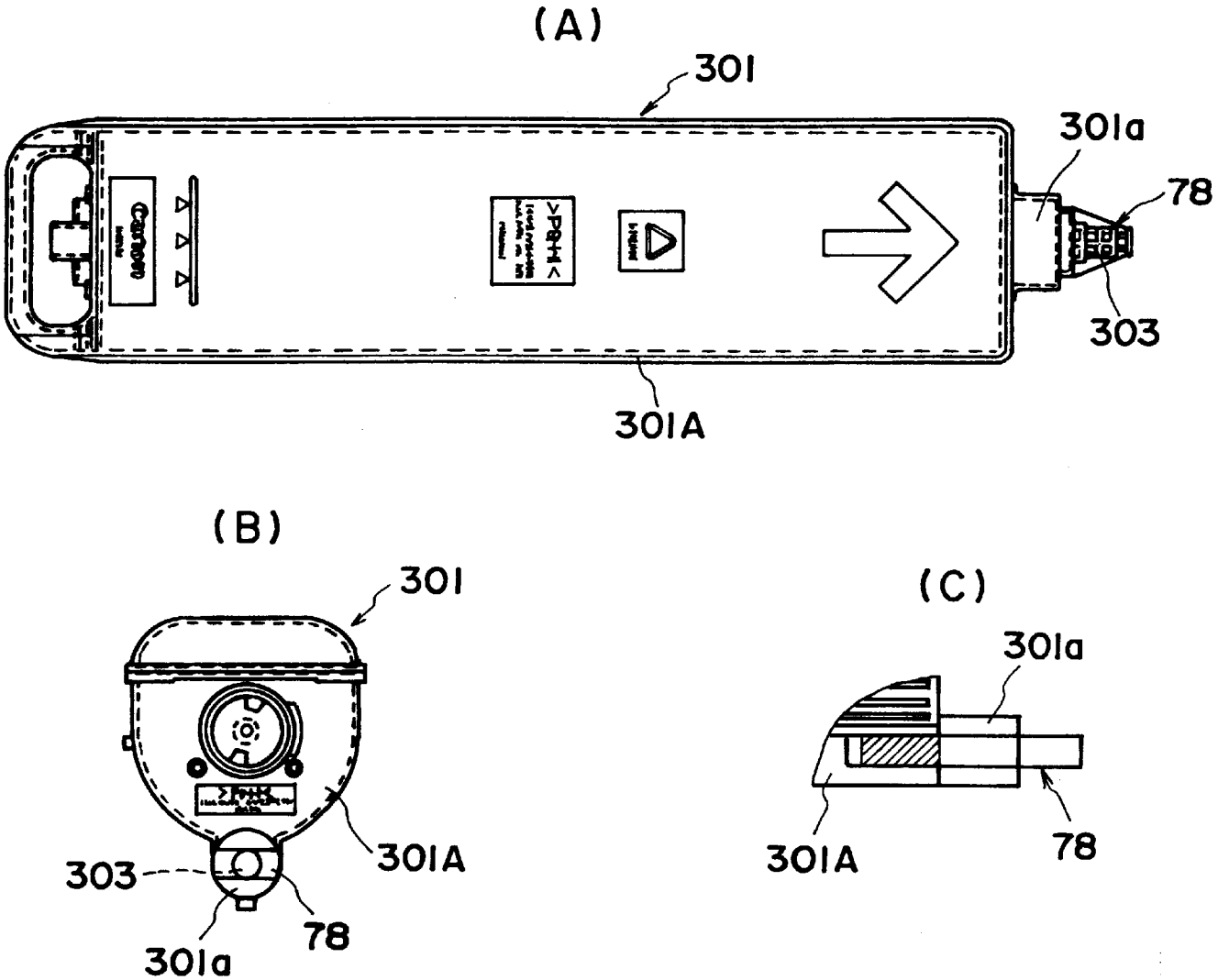
FIG. 34, (A) is a top plan view of a sealing member fixed by an adhesive tape, (B) is a front view, (C) is an enlarged view.

FIG. 28 is a side view of a toner supply outlet and a sealing member, and their adjacencies, and depicts the first step of the toner supply container refurbishing method, that is, the step in which the sealing member is removed. FIG. 29 is a sectional view of the toner supply container, and depicts the second step, that is, the cleaning step. FIG. 30 is a sectional view of the driven end portion of the toner supply container and its adjacencies, and depicts the step in which torque is checked. FIG. 31 is also a sectional view of the driven end portion of the toner supply container, and depicts the third step of the toner supply container refurbishing method, that is, the step in which the sealing member is attached to the toner supply outlet opening. FIG. 32 is a perspective view of a toner filling machine and the toner supply inlet, and depicts the fourth step, that is, the step in which the toner supply container is filled with a fresh supply of toner. FIG. 33 is a sectional view of the non-driven end portion of the toner supply container, and depicts the fifth step, that is, the step in which the sealing member is attached to the toner supply inlet opening. FIG. 34 depicts a state of the toner supply container to which the sealing member has been fixed with the use of adhesive tape. FIG. 34, (A) is a top view of the toner supply container; (B), is front view of thereof; (C) is an enlarged view of the toner supply outlet.

In FIGS. 28–33, a reference character 71 designates a sealing member removal tool; 72 denotes an air nozzle 73, a section nozzle 74, a driving force transmitting member 75, a torque converter 76, a motor 77, a toner filling machine 77*a*, the main assembly of the toner filling machine; 77*b*, denotes the toner supply inlet; 77*c* denotes an adapter; and a reference character 78 designates a piece of adhesive tape.

(First Step: Sealing Member Removal)

As described above, after the toner supply container 301 becomes empty by discharging toner, it is removed from the apparatus main assembly 100. After removal, both the toner supply outlet 301*a* and toner supply inlet 301*i* of the removed toner supply container 301 remain air-tightly sealed as shown in FIG. 6. In order to begin refurbishing the toner supply container 301, first, these sealing members 303 and 311 must be removed.

The step for removing the sealing member 303 which is sealing the toner supply outlet 301*a* is depicted in FIG. 28. As stated before, the sealing member 303 is provided with the engagement groove 303*j* (FIG. 12). Therefore, the sealing member 303 is desired to be pulled off by the force applied by the hand, an air cylinder, a robot (unillustrated) or the like, by engaging the sealing member removal tool 71 in this engage groove 303*j*. In this embodiment, the amount of the force necessary to pull off the sealing member 303 is approximately 5 kgf, and the sealing member 303 is removed by applying the force to the removal tool 71 with the use of an air cylinder.

The method for removing the sealing member 303 does not need to be limited to the above described one. For example, the sealing member 303 may be pulled off by grasping the projecting portion 303*cl*, or may be caused to pop out by air-tightly sealing the toner supply container 301 and then, increasing the internal pressure of the toner supply container 301 with the use of air or the like.

The sealing member 311, which is sealing the toner supply inlet 301*i*, can be removed with the use of various known conventional methods as can the sealing member 303. For example, it may be pulled off by holding the mandible-like portion 311*a* of the sealing member 311 with the use of a tool such as a pair of pliers; it may be pulled off by making a hole in the sealing member 311, at the appropriate center thereof, and hooking the sealing member 311 by inserting a tool through the hole; it may be caused to pop out by air-tightly sealing the toner supply container 301 and increasing the internal pressure of the toner supply container 301 with the use of air or the like. In this embodiment, the sealing member 311 was removed with the use of a pair of radio pliers. The amount of the force needed was approximately 2–5 kgf.

(Second Step: Cleaning of Container)

After the removal of the two sealing members 303 and 301, the interior of the toner supply container 301 is cleaned (FIG. 29). At this stage, the toner supply container 301 is open at two portions: the toner supply outlet 301*a* and toner supply inlet 301*i* of the toner supply container 301. Therefore, a small amount of the toner that remains in the toner supply container 301, for example, the toner adhering to the internal wall, can be removed by blowing air into the toner supply container 301 through the toner supply outlet 301*a* or toner supply inlet 301*i*. It is preferred that at the same time as air is blown into the toner supply container 301 through one of the openings, air is sucked out through the other opening. Such a method can increase cleaning efficiency.

In the case of the toner supply container 301 in this embodiment, the conveying member 302 extends through the toner supply outlet 301*a*, and also, the internal diameter of the toner supply outlet 301*a* must meet a certain requirement to provide proper clearance between the screw portion 302B and the inward surface of the toner supply outlet 301*a*. On the other hand, more latitude is afforded for the internal diameter of the toner supply inlet 301*i*. Thus, the most efficient cleansing method, which, of course, is desired, can be realized by blowing air into the toner supply container 301 through the toner supply inlet 301*i* while sucking air out of the toner supply outlet 301*a* of the toner supply container 301, with the internal diameter of the toner supply inlet 301*i* set as large as possible. Further, the toner supply outlet 301*a* is cylindrical and projects outward, which makes it easy to make an air-tight connection for the air suction. This aspect of the toner supply outlet 301*a* alone can be a legitimate reason to choose the air suction through the toner supply outlet 301*a* as a desirable method. In this embodiment, the air suction nozzle 73 and toner supply outlet 301*a* is air-tightly connected with the use of an O ring, a simple and very effective component.

As for the timing with which air is blown in, and the timing with which air is sucked out, they may be concurrent. Also, in order to swish out the toner that has adhered to the internal surface of the container housing 301A, and the surface of the stirring member 305 and conveying member 302, the blowing-in and sucking-out of air may be carried out at the same time, after only the sucking-out of air is carried out to such out most of the residual toner. In other words, the timings for the blowing-in and sucking-out of air may be optionally set.

Air may be blown into the container housing 301A from a nozzle, for example, the nozzle of an air gun, placed adjacent to the toner supply inlet 301*i*. However, it is desired that air is blown into the toner supply container 301 with an air nozzle inserted into the toner supply container 301A through the toner supply inlet 301*i* as shown in FIG. 29. In this case, the distribution of four to sixteen air outlets 72*a* at the end portion of the air nozzle 72, in the circumferential direction, that is, aiming in every direction: upward, downward, leftward, rightward, etc., makes it possible to clean the interior container housing 301A without missing any spot. Also, moving the air nozzle 72 back and fourth in the longitudinal direction of the toner supply container 301, that is, the axial direction of the conveying member 302, while blowing air, further improves cleaning efficiency. Further, distribution of a plurality of air nozzle 72 in the longitudinal direction as well as in the circumferential direction along the end portion of an air gun make it possible to clean the container housing 301A without moving the air gun back and forth.

Rotation the stirring member 305 or conveying member 302 while air is blown into the container housing 301A or sucked out of the container housing 301A makes it possible to sweep the all surfaces of the stirring member 305 or conveying member 302 with air, further reducing the amount of the toner which may remain in spite of cleaning. Preferably, the direction of the air flow should be matched with the direction of which toner is conveyed by these members 305 and 302, so that cleaning efficiency is further improved.

In this embodiment, first, only the process of sucking out air was carried out for ten seconds, with the degree of vacuum and air volume set at 2000 mmAq and 2.2 $m^3$/min, respectively. Then, air was blown in for 15 seconds with the air pressure set at 5 kgf/$cm^2$, while moving the air nozzle 72 back and forth in the container housing 301A across approximately the entire length of the container housing 301A three times.

In the case of the structure of the toner supply container 301 in this embodiment, the area below the spiral conveying member 302 (semicylindrical portion 301H) is the most likely location for the toner to remain unremoved.

Thus, in this embodiment, the conveying member 302 is kept rotating at 50 rpm while air is sucked out or blown in. Also during this process, the rotational direction of the conveying member 302 is matched with the direction of the air flow. In other words, the conveying member 302 is rotated in the direction to convey the toner from the toner supply inlet 301*i* to the toner supply outlet 301*a*.

(Third Step: Attachment of Sealing Member to Toner Supply Outlet)

After the completion of the cleaning of the container housing 301A interior, the sealing member 303 is attached to the toner supply outlet 301*a* (FIG. 31). During this process, the sealing member 303 is pressed into the toner supply outlet 301*a* while inserting the end portion 302*a* of the extension portion 302*c* of the conveying member 302 into the engagement hole 303*a* of the sealing member 303.

As for means for pressing the sealing member 303 into the toner supply outlet 301*a*, various known conventional methods may be used. For example, the sealing member 303 may be manually pressed in, or an air cylinder or a robot may be used. In this embodiment, the sealing member 303 was manually pressed in, and the amount of the necessary pressure was approximately 5 kgf to 8 kgf.

The sealing member 303 removed in the aforementioned first step may be reattached as is. However, it is desired that a new sealing member is attached in place of the removed sealing member 303. This is for the following reason. The sealing member 303 remains in the toner supply outlet 301*a* for a long time after it is pressed into the toner supply outlet 301*a*. Therefore, it is possible for the sealing member 303 to slightly shrink, or deform, over time. Thus, it is desired that the old sealing member 303 be replaced with a new sealing member 303 in order to guarantee air-tightness. In case the removed sealing member 303 is reused, adhesive tape 78 or the like may be applied to hold the sealing member 303 in place (FIG. 34) to assist the sealing member 303 to keep the toner supply container 301 air-tightly sealed until the toner supply container 301 is used. Obviously, this adhesive tape 78 or the like is removed immediately before the usage of the toner supply container 301.

(Fourth Step: Filling of Toner)

Next, toner T (in this embodiment, single component magnetic toner) is filled through the toner supply inlet 301*i*. This process can be facilitated with the use of a toner filling machine 77 or the like as shown in FIG. 32. This filling machine 77 comprises a main assembly 77*a* in the form of a funnel, a toner inlet 77*b* located at the top of the main assembly 77*a* to fill the toner into the filling machine 77, and an adapter 77*c* attached to the bottom end of the main assembly 77*a*. In this embodiment, the size of the adaptor 77*c* is matched with the size of the tone supply inlet 301*i* of the toner supply container 301. The filling machine main assembly 77*a* is provided with an rotatable auger 77*d*, which is disposed in the main assembly 77*a*. The rate at which the toner T is dispensed from the filling machine 77 is controlled by controlling the rotation of the auger 77*d*. The internal surface or the like of the filling machine main assembly 77*a* may be treated with a fluorine compound to reduce coefficient of friction, to improve the efficiency with which the toner T is filled into the toner supply container 301 from the filling machine 77.

The toner supply container 301 may be filled up all at once with the toner T, by an amount that matches the predetermined capacity of the toner supply container 301. However, it is desired that this amount of toner is filled through two or more steps, because such a filling method makes it possible to fill the toner very densely. In this embodiment, the toner supply container 301 was first filled with 825 g of toner that is, half the amount of the toner corresponding to the predetermined capacity of the toner supply container 301, and then, after giving approximately one minute to let the filled toner settle, the toner supply container 301 was filled with another 825 g of toner, that is, the other half of the toner. In other words, a total of 1650 g of toner was filled into the toner supply container 301 in two steps.

(Fifth Step: Attachment of Sealing Member to Toner Inlet)

After the filling of the toner T, the toner inlet 301*i* is sealed by pressing the sealing member 311 into the toner inlet 301*i* (FIG. 33). As for means for pressing the sealing member 311, various known conventional methods may be used. For example, the sealing member 311 may be manually pressed in, or an air cylinder or a robot may be used. In this embodiment, the sealing member 311 was manually pressed in, and the amount of the necessary pressure was approximately 2 kgf to 5 kgf.

The sealing member 311 removed in the aforementioned first step may be reattached as is. However, it is desired that a new sealing member be attached in place of the removed sealing member 311. This is for the following reason. The sealing member 311 remains in the toner supply inlet 301*i* for a long time after it is pressed into the toner supply inlet 301*i*. Therefore, it is possible for the sealing member 311 to slightly shrink, or deform, over time. Thus, it is desired that the old sealing member 311 is replaced with a new sealing member 311 in order to guarantee air-tightness. In case the removed sealing member 311 is replaced with a new sealing member 311, the shape of the new sealing member 311 does not need to be the same as the shape of the old sealing member 311. In other words, the shape and the attributes related to the shape do not matter as long as they do not compromise the ability of the sealing member 311 to air-tightly seal the toner supply inlet 301*i*. For example, a piece of adhesive label may be pasted as depicted in FIG. 34.

(Torque Checking Step)

The torque necessary to rotate the stirring member 305 and conveying member 302 is desired to be checked no earlier than the second step for cleaning the interior of the container housing 301A. This is done by confirming the output of a torque converter 75 while rotating the stirring member 305 or conveying member 302 by transmitting the driving force from a driving-force source, such as a motor or the like, to the stirring member 305 or conveying member 302 through the torque converter 75. During the torque checking, the rotational velocity and direction of the stirring member 305 or conveying member 302 are desired to be matched with those when the toner supply container 301 is being used in the apparatus main assembly 100. However, they may be set differently from the actual rotational velocity and direction. When the aforementioned torque is checked using a rotational velocity and a rotational direction, which are different from the actual ones, it is desired that the relationship between the rotational velocity and direction used for torque check, and the actual ones, is confirmed so that the value of the measured torque can be accurately converted into the normal torque value.

In this embodiment, the torque necessary to rotate the stirring member 305 and conveying member 302 was confirmed while rotating the stirring member 305 and conveying member 302 at 7 rpm and 37 rpm, respectively, in the same direction as they are rotated in the apparatus main assembly 100.

Excessive increase in the necessary torque suggests the presence of toner invasion into the bearing seal 309 (oil seal), and/or deformation, or the like, of the stirring member 305 or conveying member 302. Therefore, when the used stirring member 305 or conveying member 302 requires excessively high torque, it should be labeled unusable, so that the quality of a refurbished toner supply container 301 can be maintained at the same level as that of a new toner supply container 301.

In other words, when excessively high torque is required, the driving-force transmitting member 306, couplings 304 and 307, and the like should be disassembled to examine if the stirring member 305 and conveying member 302 were deformed. Then, if their deformation is confirmed, the old bearing seal 309, driving force transmitting member 306, and couplings 304 and 307, should be replaced with new ones when refurbishing the old toner supply container 301. Obviously, a toner supply container 301 with the new components is desired to be checked once more for torque.

In this embodiment, the highest permissible torque levels for the stirring member 305 and conveying member 302 were set at 2.0 kgf-cm and 0.2 kgf-cm, respectively. When the torque necessary to rotate the stirring member 305 or conveying member 302 in a toner supply container 301 exceeded the aforementioned highest permissible torque levels, this toner supply container 301 was set aside, so that its oil seal 309 was replaced before it was refurbished.

The above described refurbishing method for a toner supply container 301 removably installable in the main assembly 100 of an electrophotographic image forming apparatus may be summarized as follows:

(1) A method for refurbishing a toner supply container 302 in accordance with the present invention comprises:

(a) preparation of a toner supply container 301 provided with a hole 301*i* (toner inlet) for receiving toner and a hole 301*a* (toner outlet) for discharging toner, and sealing members 303 and 311 for sealing the two holes 301*i* and 301*a;*

(b) a first step for removing from the toner supply container 301, the sealing members 311 and 303, that are sealing the holes 301*i* and 301*a* for receiving and discharging the toner, respectively;

(c) a second step for cleaning the toner supply container 301;

(d) a third step for attaching the sealing member 303 to the toner supply outlet 301*a;*

(e) a fourth step for filling the toner supply container 301 with toner through the toner supply inlet 301*i*; and (f) fifth step for attaching the sealing member 311 to the toner supply inlet 301*i.*

With the use of the above described refurbishing method for a toner supply container 301, it is possible to recycle a used toner supply container 301 after cleaning it and refilling it with a fresh supply of toner, In other words, the structural components of a toner supply container 301, for example, the toner supply container housing 301A, the conveying member 302 and stirring member 305 disposed within the toner supply container housing 301A, can be effectively recycled.

(2) In the above described method for refurbishing toner supply container, in the second step for cleaning a toner supply container 301, the toner supply container 301 is cleaned by blowing air into the toner supply container 301 through one of the aforementioned openings, that is, the opening of either the toner supply inlet 301*i* or the toner supply outlet 301*a* which are projecting one for one from the opposing two walls 301Al and 301B of the toner supply container 301, that is, the side walls of the toner supply container 301 at the longitudinal ends of the toner supply container 301.

Blowing air out of either of the openings (opening in toner supply inlet 301*i* or toner supply outlet 301*a*) made in the opposing two walls 301Al and 301B can remove the toner, which has adhered to the interior of the container housing 301A, so effectively that the used toner supply container 301 can be refurbished to be just as good as a new one.

(3) In the above described second step for cleaning a toner supply container 301, the toner supply container 301 is cleaned by blowing air into the toner supply container 301 through one or two openings, that is, the openings of the toner supply inlet 301*i* and toner supply outlet 301*a* that project one for one from the opposing two side walls 301Al and 301B, while sucking air out of the other opening.

Blowing air into the toner supply container 301 through one of the two openings, that is, the openings of the toner supply inlet 301*i* and toner supply outlet 301*a* that project from the opposing two side walls 301Al and 301B, while sucking air out of the other opening, improves the efficiency with which the toner supply container 301 is cleaned.

(4) In the above described second step for cleaning a toner supply container 301, the toner supply container 301 is cleaned by blowing air into the toner supply container 301 through the toner supply inlet 301*i* while sucking air out of the toner supply outlet 301*a.*

Blowing air into the toner supply container 301 from the toner supply inlet 301*i*, the internal diameter of which can be set larger than that of the toner supply outlet 301*a,* allows a larger amount of air to be blown into the toner supply container 301, improving the efficiency with which the interior of the toner supply container 301 is cleaned.

(5) In the above described second step for cleaning a toner supply container 301, the toner supply container 301 is cleaned by inserting the air nozzle 72 into the toner supply container 301 through the toner supply inlet 301*i*, and blowing air into the toner supply container 301 from the inserted air nozzle.

Inserting the air nozzle 72 into the toner supply container 301 through the toner supply inlet 301*i*, the internal diameter of which can be set larger than that of the toner supply outlet 301*a*, and blowing air into the toner supply container 301 through the inserted nozzle 72 as described above, makes it possible to satisfactorily clean the interior of the toner supply container 301, including all the places possibly missed previously.

(6) In the above described second step for cleaning a toner supply container 301, the toner supply container 301 is cleaned by inserting the air nozzle 72 into the toner supply container 301 through the toner supply inlet 301*i*, and blowing air into the toner supply container 301 from the inserted air nozzle, while moving the air nozzle 72 moving back and forth in the longitudinal direction of the toner supply container 301.

Inserting the air nozzle 72 into the toner supply container 301, and blowing air into the toner supply container 301 from the inserted air nozzle, while moving the air nozzle 72 moving back and forth in the longitudinal direction of the toner supply container 301, makes it possible to satisfactorily clean the interior of the toner supply container 301, including all the places possibly missed previously.

(7) In the above described second step for cleaning a toner supply container 301, the toner supply container 301 is cleaned while rotating the two or more rotational stirring members 305 which are provided in the toner supply container 301.

Cleaning the toner supply container 301 while rotating the two or more rotational stirring members 305, which are provided in the toner supply container 301, makes it possible not only to effectively remove the toner which is adhering to the stirring member 305, but also to move the toner that is adhering to the internal surface or the like of the toner supply container 301 by the function of the stirring member 305.

(8) In the above described second step for cleaning a toner supply container 301, the toner supply container 301 is cleaned while rotating the toner conveying member 302 in the form of a screw disposed in the toner supply container 301.

Cleaning the toner supply container 301 while rotating the toner conveying member in the form of a screw disposed in the toner supply container 301 makes it possible not only to effectively remove the toner adhering to the conveying member 303, but also to convey and discharge the toner remaining in the toner supply container 301, by the function of the conveying member 302.

(9) The torque necessary to rotate the stirring member 305 and conveying member 302 is checked no earlier than the second step for cleaning the interior of the container housing 301A.

Checking the torque necessary to rotate the stirring member 305 and conveying member 302 after the cleaning of the toner supply container 301 makes it possible to provide a refurbished toner supply container 301 with quality equal to the quality of a new toner supply container 301.

(10) A toner supply 301 is reassembled and filled with toner, after the toner supply container 301 is disassembled based on the results or the torque check, and the bearing seals 309 of the rotational stirring member 305 and/or toner conveying member 302, and driving-force transmitting member 306 for transmitting the driving force to the rotational stirring member 305 and/or toner conveying member 302, are replaced.

Replacing, as needed, the components such as bearing seals 309, driving-force transmitting member 306, and the like, based on the results of the torque check, makes it possible to refurbish a used toner supply container 301 in such a way that the quality of a refurbished toner supply container 301 equals the quality of new one.

(11) In the aforementioned third step, the sealing member 303 removed in the first step is reattached to the cleaner toner supply container 301 which comprises: a toner storing portion 301A; a toner outlet 301*a* for discharging the toner stored in the toner storing portion 301A; a toner conveying member 302 for conveying the toner stored in the toner storing portion 301A, toward the toner supply outlet 301*a*; and a sealing member 303 for sealing the toner outlet 301*a*, the sealing member 303 having a sealing portion 303*b* for unsealably sealing the toner outlet 301*a* and a driving portion 303*a* for driving the toner conveying member 302.

Reattaching, in the third step, the sealing member 303 removed in the first step, makes it possible to effectively prevent the components from being wasted, improving recycling efficiency.

(12) In the aforementioned third step, in place of the sealing member 303 removed in the first step, a new sealing member 303 is attached to the cleaned toner supply container 301 which comprises: a toner storing portion 301A; a toner outlet 301*a* for discharging the toner stored in the toner storing portion 301A; a toner conveying member 302 for conveying the toner stored in the toner storing portion 301A, toward the toner supply outlet 301*a*; and a sealing member 303 for sealing the toner outlet 301*a*, the sealing member 303 having (a) a sealing portion 303*b* for unsealably sealing the toner outlet 301*a* and (b) a driving portion 303*a* for driving the toner conveying member 302.

Attaching a new sealing member 303 in the third step make it possible to provide a refurbished toner supply container 301 equal in quality to a new toner supply container 301.

(13) A toner supply container 301 refurbishable by a method in accordance with the present invention comprises: (a) a toner storing portion 301A; (b) a toner outlet 301*a* for discharging the toner stored in the toner storing portion 301A; (c) a toner conveying member 302 for conveying the toner stored in the toner storing portion 301A, toward the toner supply outlet 301*a*; and a sealing member 303 for sealing the toner outlet 301*a*, (d) the sealing member 303 having a sealing portion 303*b* for unsealably sealing the toner outlet 301*a* and a driving portion 303*a* for driving the toner conveying member 302.

(14) A toner supply container 301 refurbishable by a method in accordance with the present invention comprises: (a) a toner storing portion 301A; (b) a toner outlet 301*a* for discharging the toner stored in the toner storage portion 301A; (c) a toner conveying member 302 for conveying the toner stored in the toner storing portion 301A, toward the toner supply outlet 301*a*; and a sealing member 303 for sealing the toner outlet 301*a*, (d) (1) the sealing member 303 having a sealing portion 303*b* for unsealably sealing the toner outlet 301*a*, (2) a driving portion 303*a* for driving the toner conveying member 302, (3) a driving force receiving portion 303*c* for receiving driving force from the apparatus main assembly 100 and rotationally driving the toner conveying member 302 by its driving portion 303*a*, (4) an engagement portion 303*j* engageable with the apparatus main assembly 100 to receive the force for unsealing the toner supply outlet 301*a* sealed with the sealing portion 303*b*, as the toner supply container housing 301A is installed into the apparatus main assembly 100, wherein the sealing portion 303*b*, the driving force receiving portion 303*c*, and the engagement portion 303*j* are disposed on the peripheral surface of the sealing member 303 in the listed order, and further, the sealing member 303 comprising an opening 303*a* which extends from one longitudinal end of the sealing member 303 toward the other longitudinal end of the sealing member 303, the driving portion 303*a* is the opening 303*a*.

(15) A toner supply container 301 refurbishable by a method in accordance with the present invention comprises: (a) a toner storing portion 301A; (b) a toner outlet 301*a* for discharging the toner stored in the toner storing portion 301A; (c) a toner conveying member 302 for conveying the toner stored in the toner storing portion 301A, toward the toner supply outlet 301*a*; and a sealing member 303 for sealing the toner outlet 301*a*, (d) (1) the sealing member 303 having a sealing portion 303*b* for unsealably sealing the toner outlet 301*a*, (2) a driving portion 303*a* for driving the toner conveying member 302, (3) a driving force receiving portion 303*c* for receiving a driving force from the apparatus main assembly 100 and rotationally driving the toner conveying member 302 by its driving portion 303*a*, (4) an engagement portion 303*j* engageable with the apparatus main assembly 100 to receive the force for unsealing the toner supply outlet 301*a* sealed with the sealing portion 303*b*, as the toner supply container housing 301A is installed into the apparatus main assembly 100, and (5) a seal 330 for preventing toner from invading the driving portions 303*a*, wherein the peripheral surface of the driving force receiving portion 303*c* is provided with a spline 303*d* for receiving a driving force from the apparatus main assembly 100, and the seal 330 is attached to the one of the longitudinal end of the sealing member 303, and wherein the toner stored in the toner supply container 301 is supplied into the apparatus main assembly 100 through the toner supply outlet 301*a* by the toner conveying member 302 in response to the toner consumption within the apparatus main assembly 100, after the installation of the toner supply container 301 into the apparatus main assembly 100.

In a toner supply container 301 structured as described in paragraphs (13)–(15), the force for rotationally driving the toner conveying member 302 is transmitted to the toner conveying member 302 from outside the toner supply container 301 through the sealing member 303. Therefore, an oil seal (O ring) such as the bearing seal 309 is unnecessary. In other words, not only can the number of components which must be replaced due to wear or damage be reduced, but also is it possible to simplify the disassembly or assembly, making it easier to refurbish a used toner supply container 301.

(16) A toner supply container 301 refurbishable by a method in accordance with the present invention comprises: (a) a toner storing portion 301A; (b) a toner supply outlet 301*a* for discharging the toner stored in the toner storing portion 301A; and (c) a toner conveying member 302 for conveying the toner stored in the toner storing portion 301A, toward the toner supply outlet 301*a* by rotating in the toner storing portion 301A, wherein, as seen from the longitudinal direction of the toner conveying member 302, the rotational center of the toner conveying member 302 is within the opening of the toner supply outlet 301*a*.

(17) A toner supply container 301 refurbishable by a method in accordance with the present invention comprises: (a) a toner storing portion 310A; (b) a toner supply outlet 301*a* for discharging the toner stored in the toner storing position 301A; and (c) a toner conveying member 302 for conveying the toner stored in the toner storing portion 301A, toward the toner supply outlet 301*a* by rotating in the toner storing portion 301A, wherein the toner supply outlet 301*a* is extended outward from the side wall 301A1 of the toner storing portion 301A perpendicular to the longitudinal direction of the toner storing portion 301A; as seen from the longitudinal direction of the toner conveying member 302, the rotational center of the toner conveying member 302 is within the opening of the toner supply outlet 301*a*; the toner conveying member 302 has a driving force receiving portion 303*c*, which is on the toner supply outlet 301*a* side in terms of the longitudinal direction of the toner conveying member 302; and the driving force receiving portion 303*c* is structured so that it receives a driving force from the apparatus main assembly 100 through the toner supply outlet 301*a* after the toner supply container 301 is installed in the apparatus main assembly 100.

(18) A toner supply container 301 refurbishable by a method in accordance with the present invention comprises: (a) a toner storing portion 301A; (b) a toner supply outlet 301*a* for discharging the toner stored in the toner storing portion 301A; and (c) a toner conveying member 302 for conveying the toner stored in the toner storing portion 301A, toward the toner supply outlet 301*a* by rotating in the toner storing portion 301A, wherein the toner supply outlet 301*a* is extended outward from the side wall 301A1 of the toner storing portion 301A perpendicular to the longitudinal direction of the toner storing portion 301A; the toner conveying member 302 has a shaft portion 302A, a spiral conveying portion 302B extended in the longitudinal direction of the toner conveying member 302, on the peripheral surface of the shaft portion 302A, and a driving force receiving portion 303*c* which projects outward beyond the toner supply outlet 301*a*, from the shaft portion 302A and wherein as seen from the longitudinal direction of the toner conveying member 302, the rotational center of the toner conveying member 302 substantially coincides with the center of the opening of the toner supply outlet 301*a*; the length of the portion of the spiral conveying portion 302B in the toner supply outlet 301*a* is equivalent to no less than one full turn about the shaft portion 303A; the driving force receiving portion 303*c* extends outward from the longitudinal end of the shaft portion 302A on the toner supply outlet 301*a* side, and receives a driving force from the apparatus main assembly 100 through the toner supply outlet 301*a* after the installation of the toner supply container 301 into the apparatus main assembly 100, and wherein the toner stored in the toner supply container 301 is supplied into the apparatus main assembly 100 through the toner supply outlet 301*a* by the toner conveying member 302 in response to the toner consumption within the apparatus main assembly 100, after the installation of the toner supply container 301 into the apparatus main assembly 100.

Structuring a toner supply container 301 as described in preceding paragraphs (16)–(18) makes it possible to efficiently refurbish even a toner supply container which is difficult to clean due to the positioning of the rotational center of the toner conveying member 302 within the opening of the toner supply outlet 301*a*.

(19) A toner supply container 301 refurbishable by a method in accordance with the present invention comprises: (a) a toner storing portion 301A; (b) a toner supply outlet 301*a* for discharging the toner stored in the toner storing portion 301A; (c) a toner conveying member 302 for conveying the toner stored in the toner storing portion 301A, toward the toner supply outlet 301*a* by rotating in the toner storing portion 301A, (d) a toner stirring member 305 for stirring the toner stored in the toner storing portion 302A by rotating in the toner storing portion 302A, and (e) toner supply inlet 301*i* for filling toner into the toner storing portion 302A, wherein the toner storing portion 302A has a curved wall portion 301F, the width of which in terms of the direction perpendicular to the longitudinal direction of the toner storing portion 301A becomes narrower toward the bottom, a straight wall portion 301G immediately below the curved wall portion 301F, the width of which in the above described terms is even from the top to the bottom, and a semicylindrical wall portion 301H immediately below the straight wall portion 301G; the toner supply outlet 301*a* is extended outward from the side wall 301A1 of the toner storing portion 301A perpendicular to the longitudinal direction of the toner storing portion 301A; the toner conveying member 302 has a shaft portion 302A, from the area correspondent to the straight wall portion 301G and semicylindrical wall portion 301H; the toner conveying member 302 has a shaft portion 302A, a spiral conveying portion

302B extended in the longitudinal direction of the toner conveying member 302, on the peripheral surface of the shaft portion 303A, and a driving force receiving portion 303*c* which projects outward beyond the toner supply outlet 301*a*, from the shaft portion 302A, wherein as seen from the longitudinal direction of the toner conveying member 302, the rotational center of the toner conveying member 302 substantially coincides with the center of the opening of the toner supply outlet 301*a*; the length of the portion of the spiral conveying portion 302B in the toner supply outlet 301*a* is equivalent to no less than one full turn about the shaft portion 302A; the driving force receiving portion 303*c* extends outward from the longitudinal end of the shaft portion 302A on the toner supply outlet 301*a* side, and receives a driving force from the apparatus main assembly 100 through the toner supply outlet 301*a* after the installation of the toner supply container 301 into the apparatus main assembly 100; and as seen from the longitudinal direction of the toner stirring member 305, the rotational center of the toner stirring member 305 substantially coincides with the center of the theoretical circle which includes the inward surface of the curved portion 301F of the toner storing portion 301A; the toner supply inlet 301*i* is extended outward from the side wall 301B of the toner storing portion 301A perpendicular to the longitudinal direction of the toner storing portion 301A, and is positioned so that its rotational center comes between the rotational centers of the toner conveying member 302 and toner stirring member 305, and wherein the toner stored in the toner supply container 301 is supplied into the apparatus main assembly 100 through the toner supply outlet 301*a* by the toner conveying member 302 in response to the toner consumption within the apparatus main assembly 100, after the installation of the toner supply container 301 into the apparatus main assembly 100.

According to the present invention, it is possible to provide an efficient method for refurbishing even a toner supply container 301 characterized by the structure and operation described in preceding Paragraph (19).

As described above, the toner supply container refurbishing method in this embodiment provides the following effects:

(1) A toner supply container can be recycled, preventing the components such as the toner supply container housing, stirring member, and the like, from being wasted, and therefore, contributing to the preservation of natural resources and reduction in energy consumption.

(2) The interior of a toner supply container can be easily cleaned when refurbishing a toner supply container.

(3) When refurbishing a toner supply container, the torque necessary to rotate the stirring and conveying members is checked after the interior of the toner supply container is cleaned and the sealing member is replaced. Therefore, it is possible to refurbish a used toner supply container in such a way that the quality of a refurbished toner supply container is not different at all from that of a new one.

While the invention has been described with reference to the structures disclosed herein, it is not confined to the details set forth and this application is intended to cover such modifications or changes as may come within the purposes of the improvements or the scope of the following claims.

What is claimed is:

1. A recycling method for a toner supply container which is detachably mountable to a main assembly of an image forming apparatus to supply toner into the main assembly, said method comprising the steps of:

providing a toner supply container including a filling opening for filling the toner, a supply opening for supplying the toner, a first seal member for sealing the filling opening, and a second seal member for sealing the supply opening;

a first step of dismounting the first and second seal members from the toner supply container;

a second step, after said first step, of cleaning an inside of said toner supply container by blowing air with an air blower into the toner supply container through either one of the filling opening and the supply opening, and simultaneously sucking the air with an air suction device through the other one of the openings; and a third step, after said second step, of filling the toner through the filling opening.

2. A method according to claim 1, wherein said filling opening is provided in a surface at one longitudinal end of said toner supply container, and said supply opening is provided in a surface at the other longitudinal end of said toner supply container, and the surfaces are opposed to each other.

3. A method according to claim 1, further comprising a fourth step of mounting a seal member for sealing the supply opening after said second step.

4. A method according to claim 3, wherein the seal member mounted to the supply opening in said fourth step is a new member different from said second seal member.

5. A method according to claim 3, wherein the seal member mounted to said supply opening in said fourth step is the second seal member removed by said first step.

6. A method according to claim 1, further comprising a fourth step of mounting a seal member for sealing said filling opening after said third step.

7. A method according to claim 6, wherein the seal member mounted to said filling opening in said fourth step is a new member different from the first seal member.

8. A method according to claim 6, wherein the seal member mounted to said filling opening in said fourth step is the first seal member dismounted by said first step.

9. A method according to claim 1, wherein in said second step, the air is blown through said filling opening, and the air is sucked through said supply opening simultaneously.

10. A method according to claim 9, wherein in said second step, an air nozzle is inserted into the toner supply container through said filling opening, and the air is blown form the air nozzle.

11. A method according to claim 10, wherein in said second step, while the air is blown from the air nozzle, said air nozzle is reciprocated in the longitudinal direction of the toner supply container.

12. A method according to claim 1, wherein said toner supply container has therein a rotatable stirring member for stirring the toner, and said second step is carried out while the stirring member is rotated.

13. A method according to claim 1, wherein said toner supply container is provided with a feeding screw for feeding the toner therein and discharging the toner from the supply opening, and said second step is carried out while the feeding screw is being rotated.

14. A method according to claim 12, further comprising a checking step, after said second step, of checking the rotation torque of the stirring member.

15. A method according to claim 13, further comprising a checking step, after said second step, of checking a rotation torque of said feeding screw.

16. A method according to claim 14, further comprising a determining step of determining whether said toner supply container is disassembled or not to exchange a bearing seal member for sealing a bearing of the stirring member or a drive transmission member for transmitting driving force to said stirring member on the basis of a result of said checking step.

17. A method according to claim 15, further comprising a determining step of determining whether said toner supply container is disassembled or not to exchange a bearing seal member for sealing a bearing of the feeding screw or a drive transmission member for transmitting a driving force to said feeding screw on the basis of a result of said checking step.

18. A method according to claim 1, wherein said toner supply container includes a feeding member for feeding toner into said toner supply container and discharging toner from said supply opening, and said second seal member is provided with a drive transmitting portion for transmitting a driving force to said feeding member.

19. A method according to claim 18, wherein said second seal member is provided with a driving force receiving portion for receiving a driving force from the main assembly of said apparatus when said toner supply container is mounted to the main assembly of said image forming apparatus, and the driving force is transmitted to said drive transmitting portion.

20. A method according to claim 18, wherein the second seal member is provided with a protection member for preventing the toner from entering said drive transmitting portion.

21. A method according to claim 1, wherein said second seal member is provided with an engaging portion engageable with a main assembly of said apparatus to receive from the main assembly of said apparatus a force for opening said supply opening when said toner supply container is mounted to the main assembly of said image forming apparatus.

22. A method according to claim 19, wherein said second seal member is provided with an engaging portion engageable with the main assembly of said apparatus to receive from the main assembly of said apparatus a force for opening said supply opening when said toner supply container is mounted to the main assembly of said image forming apparatus.

23. A method according to claim 22, wherein said second seal member is provided with the engaging portion, the driving force receiving portion, and a sealing portion for sealing the supply opening in the order named in a longitudinal direction of said toner supply container from its end.

24. A method according to claim 1, wherein said toner supply container is provided with a rotatable feeding member for feeding the toner into said toner supply container and discharging the toner from said supply opening, wherein said feeding member is provided such that a center of rotation of said feeding member is within a range of an opening of said supply opening.

25. A method according to claim 19, wherein said toner supply container includes a toner accommodating portion for accommodating the toner, and said second seal member and said supply opening are provided on a portion projected from a longitudinal end surface of said toner accommodating portion.

26. A method according to claim 25, wherein said toner accommodating portion is provided with a curved portion having a section in a direction crossing with a longitudinal direction of said toner accommodating portion, a width of the section being decreasing downwardly when said toner supply container is mounted to the main assembly of said apparatus, and said feeding member has a center of rotation which is located in a range of an opening of said supply opening as seen in a longitudinal direction of said feeding member, and is lower than said curved portion.

27. A method according to claim 26, wherein said feeding member is provided with a portion projected outward beyond a longitudinal end surface of said toner accommodating portion, and said portion receives a driving force through said driving force transmitting portion.

28. A method according to claim 1, wherein said toner supply container is provided therein with a rotatable stirring member for stirring the toner, a rotatable feeding member for discharging the toner from said supply opening, and said filling opening is disposed between a center of rotation of said stirring member and a center of rotation of said feeding member as seen from a longitudinal direction of said toner supply container.

29. A method according to claim 1, wherein said toner supply container is provided therein with a rotatable stirring member for stirring the toner, a rotatable feeding member for discharging the toner from said supply opening, and when the toner is supplied into the main assembly of the apparatus, said stirring member and said feeding member are rotated.

30. A method according to claim 1, wherein said air blower is provided with a first air nozzle, and said air suction device is provided with a second air nozzle.

* * * * *

UNITED STATES PATENT AND TRADEMARK OFFICE

CERTIFICATE OF CORRECTION

PATENT NO. : 6,278,853 B1
DATED : August 21, 2001
INVENTOR(S) : Yutaka Ban et al.

It is certified that error appears in the above-identified patent and that said Letters Patent is hereby corrected as shown below:

Column 2,
Line 52, “is shown” should read -- shows --.

Column 7,
Line 16, “hearing” should read -- bearing --.

Column 10,
Line 17, “order:” should read -- order. --.
Line 67, “an” (1st occurrence) should read -- and --.

Column 11,
Line 1, “member 5” should read -- member 6 --.
Line 57, “for” should read -- four --.

Column 12,
Line 67, “50 deg.” should read -- 40 degrees --.

Column 17,
Line 5, “instil” should read -- instal --.

Column 20,
Line 12, “vie” should read -- view --.

Column 21,
Line 34, “pawl type driving” should read -- pawl-type, driving --.
Line 37, “pawl-type;” should read -- pawl-type, --.

Column 22,
Line 1, “pawl type driving” should read -- pawl-type, driving --.
Line 5, “sat” should read -- seat --.

Column 24,
Line 22, “and” should read -- end --.

Column 25,
Line 8, “(A)” should read -- (A), --.
Line 10, “(C)” should read -- (C), --.

UNITED STATES PATENT AND TRADEMARK OFFICE

CERTIFICATE OF CORRECTION

PATENT NO. : 6,278,853 B1
DATED : August 21, 2001
INVENTOR(S) : Yutaka Ban et al.

It is certified that error appears in the above-identified patent and that said Letters Patent is hereby corrected as shown below:

Column 26,
Line 61, “Rotation” should read -- Rotating --.

Column 29,
Line 62, “fifth” should read -- a fifth --.

Column 31,
Line 31, “303,” should read -- 302, --.

Column 32,
Line 18, “make” should read -- makes --.

Column 33,
Line 48, “position” should read -- portion --.

Signed and Sealed this

Twenty-seventh Day of August, 2002

*Attest:*

*Attesting Officer*

JAMES E. ROGAN
*Director of the United States Patent and Trademark Office*